US008142173B2

(12) United States Patent
Saga et al.

(10) Patent No.: US 8,142,173 B2
(45) Date of Patent: Mar. 27, 2012

(54) VARIABLE DISPLACEMENT VANE PUMP

(75) Inventors: Koji Saga, Ebina (JP); Yasushi Watanabe, Kanagawa (JP); Hideaki Ohnishi, Atsugi (JP)

(73) Assignee: Hitachi, Ltd., Tokyo (JP)

( * ) Notice: Subject to any disclaimer, the term of this patent is extended or adjusted under 35 U.S.C. 154(b) by 392 days.

(21) Appl. No.: 12/469,318

(22) Filed: May 20, 2009

(65) Prior Publication Data

US 2009/0291000 A1 Nov. 26, 2009

(30) Foreign Application Priority Data

May 22, 2008 (JP) ..... 2008-133889

(51) Int. Cl.
*F04B 35/00* (2006.01)
*F01C 1/30* (2006.01)

(52) U.S. Cl. ..... 417/364; 418/24

(58) Field of Classification Search ..... None
See application file for complete search history.

(56) References Cited

U.S. PATENT DOCUMENTS

| | | | | |
|---|---|---|---|---|
| 5,090,881 | A * | 2/1992 | Suzuki et al. | 418/26 |
| 6,763,797 | B1 * | 7/2004 | Staley et al. | 123/196 R |
| 2008/0308062 | A1 * | 12/2008 | Morita et al. | 123/196 R |

FOREIGN PATENT DOCUMENTS

| | | | |
|---|---|---|---|
| JP | 61-055386 | A | 3/1986 |
| JP | 03-052390 | U | 5/1991 |
| JP | 5-079469 | A | 3/1993 |
| JP | 09-088846 | A | 3/1997 |

* cited by examiner

*Primary Examiner* — Toan Ton
*Assistant Examiner* — Britt D Hanley
(74) *Attorney, Agent, or Firm* — Foley & Lardner LLP

(57) ABSTRACT

In a variable displacement vane pump employing a cam ring, a pump rotor, and a plurality of vanes, each slidably fitted into the rotor, a biasing member is provided to force the cam ring in a direction that a geometric center of an inner peripheral surface of the cam ring and a rotation center of the rotor are spaced apart from each other. A force, by which the cam ring can be oscillated against the biasing member in accordance with a buildup of a pressure in a pump discharge portion, acts on the inner peripheral surface of the cam ring.

20 Claims, 20 Drawing Sheets

VARIABLE DISPLACEMENT VANE PUMP

TECHNICAL FIELD

The present invention relates to a variable displacement vane pump whose discharge can be varied by changing an eccentricity of a geometric center of a cylinder bore of a cam ring with respect to the axis of rotation of a vane rotor.

BACKGROUND ART

In recent years, there have been proposed and developed various variable displacement vane pumps capable of varying a discharge of working fluid, usually expressed as a fluid flow rate per one revolution of a vane-pump rotor. One such variable displacement vane pump has been disclosed in Japanese Patent Provisional Publication No. 05-79469 (hereinafter is referred to as "JP5-079469"). The variable displacement vane pump disclosed in JP5-079469, has a control oil chamber defined between the inner periphery of a vane-pump housing and the outer periphery of a cam ring and partitioned by a cam-ring pivot pin fixedly connected to the pump housing and a seal member attached to the outer periphery of the cam ring. The eccentricity of the cam ring with respect to the vane rotor, exactly, the distance from the axis of rotation of the vane rotor to the geometric center of the cylinder bore of the cam ring, can be controlled or adjusted by varying a hydraulic pressure supplied into the control oil chamber, thereby varying the discharge of the vane pump.

However, to produce an oscillating motion of the cam ring pivoted to the pivot pin, the variable displacement vane pump of JP5-079469 requires the previously-noted oil control chamber defined between the pump-housing inner periphery and the cam-ring outer periphery and partitioned by the pivot pin and the seal member. The disadvantages of the variable displacement vane pump of JP5-079469 are the difficulty of reducing the number of component parts constructing the variable displacement vane pump assembly and the increased vane pump manufacturing costs.

Thus, it would be desirable to provide a variable displacement vane pump of reduced number of component parts.

SUMMARY OF THE INVENTION

It is, therefore, in view of the previously-described disadvantages of the prior art, an object of the invention to provide a variable displacement vane pump, which is configured to realize reduced number of component parts without the need for a control oil chamber, defined between a pump-housing inner periphery and a cam-ring outer periphery and partitioned by a plurality of components, namely, a cam-ring pivot pin and a seal member.

In order to accomplish the aforementioned and other objects of the present invention, a variable displacement vane pump comprises a rotor driven by an internal combustion engine, a cam ring configured to accommodate therein the rotor and further configured to oscillate about a fulcrum of oscillating motion along two axially opposed sidewalls facing both sides of the cam ring respectively, a plurality of vanes, each of which is fitted into the rotor to slide from the rotor toward an inner peripheral surface of the cam ring and set to be kept in abutted-engagement with the inner peripheral surface of the cam ring, the vanes being configured to define a plurality of working chambers in cooperation with an outer peripheral surface of the rotor, the inner peripheral surface of the cam ring, and the two axially opposed sidewalls, a biasing member configured to force the cam ring in a direction that a geometric center of the inner peripheral surface of the cam ring and a rotation center of the rotor are spaced apart from each other, and an inlet portion and a discharge portion both formed in at least one of the two axially opposed sidewalls, the inlet portion being configured to open into a first group of working chambers of the plurality of working chambers so as to extend over the first group of working chambers within an area where volumes of the first group of working chambers increase, and the discharge portion being configured to open into a second group of working chambers of the plurality of working chambers so as to extend over the second group of working chambers within an area where volumes of the second group of working chambers decrease, wherein a force, by which the cam ring can be oscillated against the biasing member in accordance with a buildup of a pressure in the discharge portion, acts on the inner peripheral surface of the cam ring.

According to another aspect of the invention, a variable displacement vane pump comprises a rotor driven in synchronism with rotation of an internal combustion engine, a cam ring configured to accommodate the rotor in an inner peripheral surface of the cam ring and further configured to oscillate about a fulcrum of oscillating motion between two axially opposed sidewalls facing both sides of the cam ring respectively, a plurality of vanes, each of which is fitted into the rotor to slide from an outer peripheral surface of the rotor toward the inner peripheral surface of the cam ring, the vanes being configured to define a plurality of working chambers in cooperation with the outer peripheral surface of the rotor, the inner peripheral surface of the cam ring, and the two axially opposed sidewalls, a biasing member configured to force the cam ring in a direction that a volume difference between a volume of the largest working chamber of the plurality of working chambers and a volume of the smallest working chamber of the plurality of working chambers increases, and an inlet portion and a discharge portion both formed in at least one of the two axially opposed sidewalls, the inlet portion being configured to open into a first group of working chambers of the plurality of working chambers so as to extend over the first group of working chambers within an area where volumes of the first group of working chambers increase, and the discharge portion being configured to open into a second group of working chambers of the plurality of working chambers so as to extend over the second group of working chambers within an area where volumes of the second group of working chambers decrease, wherein the fulcrum of oscillating motion of the cam ring is laid out to be offset in a biasing direction of the biasing member within an opening range of the discharge portion.

According to a further aspect of the invention, a variable displacement vane pump comprises a rotor rotated by a drive source, a cam ring configured to accommodate therein the rotor and further configured to oscillate about a fulcrum of oscillating motion, while being kept in sliding-contact with two axially opposed sidewalls facing both sides of the cam ring respectively, a plurality of vanes, each of which is fitted into the rotor to slide from the rotor toward an inner peripheral surface of the cam ring, the vanes being configured to define a plurality of working chambers in cooperation with an outer peripheral surface of the rotor, the inner peripheral surface of the cam ring, and the two axially opposed sidewalls, a biasing member configured to force the cam ring in a biasing direction that a rate of change of a volume of each of the plurality of working chambers increases, and an inlet portion and a discharge portion both formed in at least one of the two axially opposed sidewalls, the inlet portion being configured to open into a first group of working chambers of the plurality of working chambers so as to extend over the first group of working chambers within an area where volumes of the first group of working chambers increase, and the discharge portion being configured to open into a second group of working chambers of the plurality of working chambers so as to extend over the second group of working chambers within an area where volumes of the second group of working chambers decrease, wherein an integral $\int S2dt$ of a second segmented pressure-receiving area of the inner peripheral surface of the cam ring, extending in the biasing direction of the biasing member with respect to the fulcrum of oscillating motion, for a given cycle, is less than an integral $\int S1dt$ of a first segmented pressure-receiving area of the inner peripheral surface of the cam ring, extending in the direction opposite to the biasing direction of the biasing member with respect to the fulcrum of oscillating motion, for the given cycle.

The other objects and features of this invention will become understood from the following description with reference to the accompanying drawings.

DESCRIPTION OF THE PREFERRED EMBODIMENTS

First Embodiment

Figure 1:
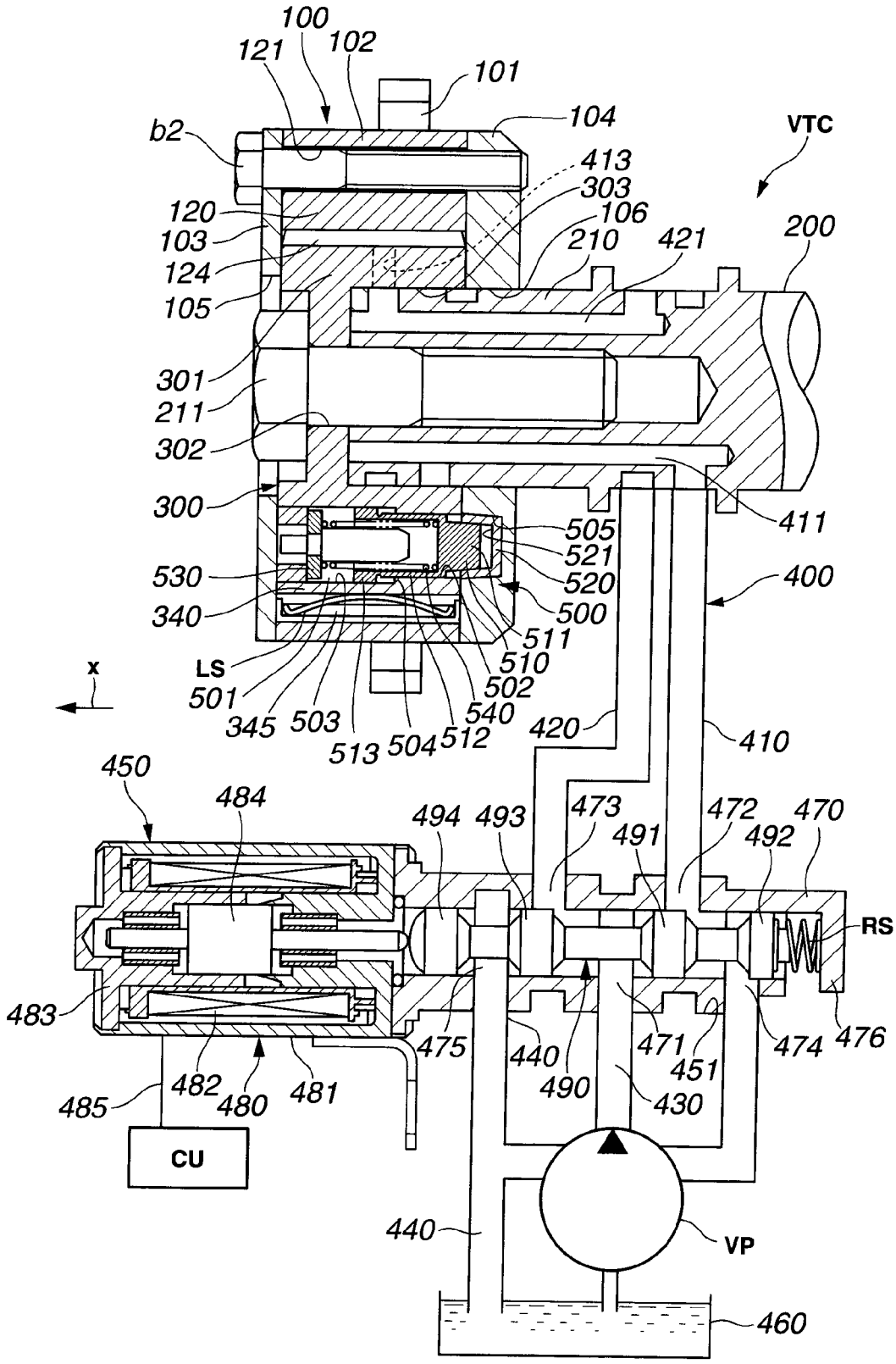
FIG. 1 is a cross-sectional view illustrating a variable valve timing control (VTC) system employing a hydraulically-operated vane-type timing variator (simply, a hydraulic actuator) to which a variable displacement vane pump of the first embodiment is applied.

Referring now to the drawings, particularly to FIG. 1, the variable displacement vane pump (hereinafter is referred to as "pump VP") of the first embodiment is exemplified in an internal combustion engine of an automotive vehicle. Pump VP is installed on the front end of an engine cylinder block, for supplying moving engine parts with lubricating oil and for delivering oil (serving as a working medium as well as a lubricating substance) to a variable valve actuation mechanism, which is installed for variably controlling operating characteristics of engine valves.

(Construction of Valve Timing Control System)

Figure 2:
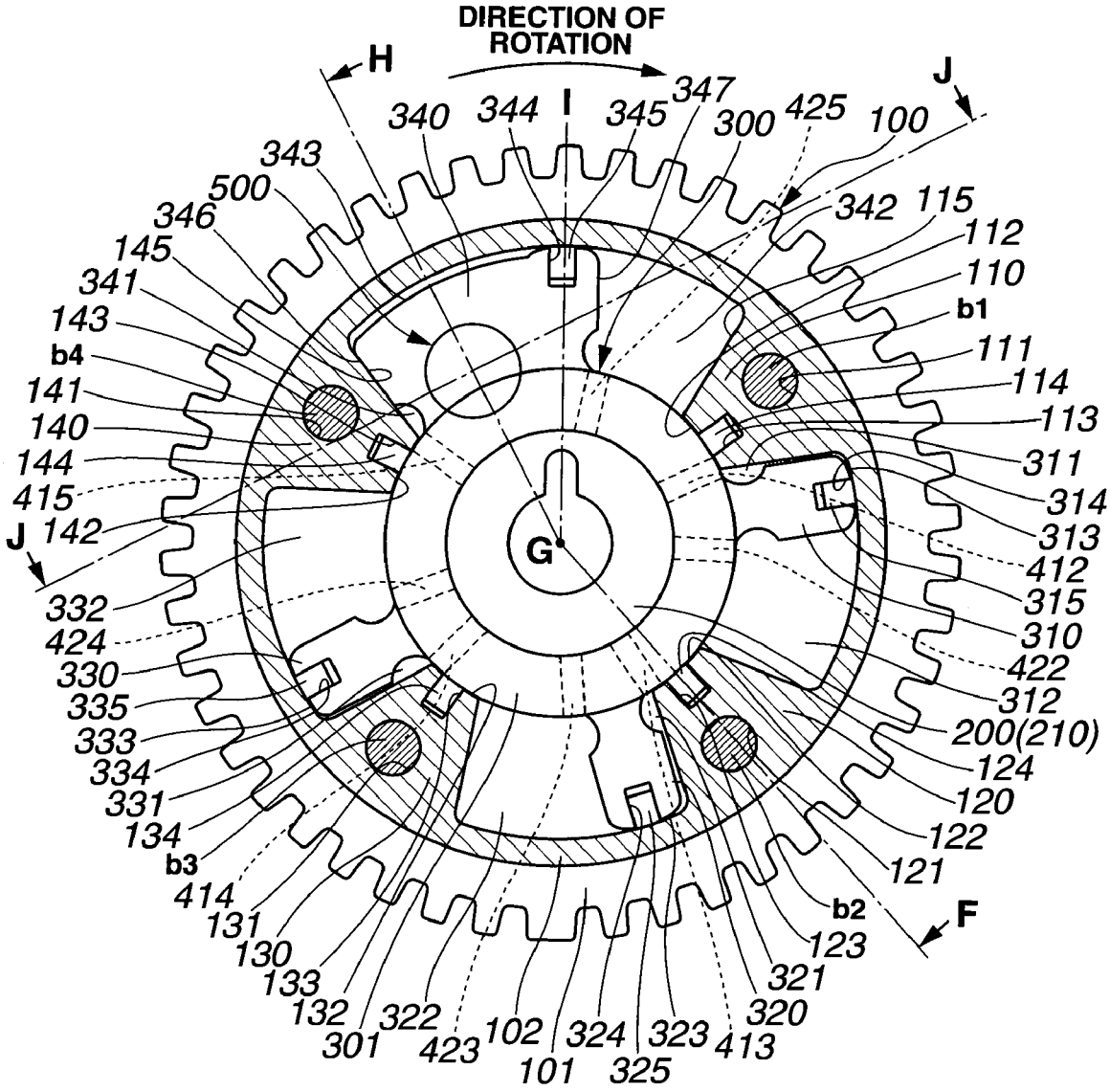
FIG. 2 is a front elevation view of the hydraulic actuator of the VTC device to which the variable displacement vane pump of the first embodiment is applied.

In the first embodiment, a variable valve timing control (VTC) device is used as the variable valve actuation mechanism (the phase converter). As seen from the cross section of FIG. 1, in the shown embodiment, the VTC device is applied to the intake-valve side of the engine. The VTC system is comprised of a disk-shaped timing sprocket 100, a camshaft 200, a vane member 300, and a hydraulic pressure supply-and-exhaust mechanism 400. A phase of camshaft 200 relative to an engine crankshaft (not shown) can be continuously varied hydraulically. As shown in FIG. 1, a hydraulically-operated vane-type timing variator or a hydraulically-operated vane-type phase converter (simply, a hydraulic actuator) of the VTC device includes timing sprocket 100, camshaft 200, and vane member 300. In the cross-sectional view shown in FIG. 1, assume that the direction of the axis of camshaft 200 is taken as x-axis, one axial direction of camshaft 200 oriented from the left-hand side (viewing FIG. 1) of camshaft 200, on which timing sprocket 100 is installed, to the right-hand side of camshaft 200 is defined as a negative x-axis direction, and the opposite axial direction oriented from the right-hand side (viewing FIG. 1) to the left-hand side of camshaft 200 is defined as a positive x-axis direction. FIG. 1 shows the cross section (the cutaway view) of the hydraulic actuator, cut along the x-axis direction and the cross section (the cutaway view) of a directional control valve 450 of hydraulic pressure supply-and-exhaust mechanism 400, cut along the x-axis direction. FIG. 2 shows the front elevation of the hydraulic actuator whose front cover is removed, as viewed from the positive x-axis direction. The cross section of the hydraulic actuator shown in FIG. 1 corresponds to the F-G-H cross section taken along the lines F-G and G-H shown in FIG. 2, but only a portion of an oil seal member 345 is replaced by the G-I cross section taken along the line G-I rather than the G-H cross section taken along the line G-H.

Timing sprocket 100 is driven by the crankshaft via a timing chain and thus rotates in synchronism with rotation of the crankshaft. Camshaft 200 is rotatably supported on the upper portion of an engine cylinder head (not shown) by means of cam bearings, such that relative rotation of camshaft 200 to timing sprocket 100 is permitted. Camshaft 200 has a series of cams formed integral with the camshaft at predetermined axial positions, for operating (opening and closing) intake valves via respective valve lifters. Vane member 300 is fixedly connected to the camshaft axial end (i.e., the left-hand axial end of camshaft 200, viewing FIG. 1), facing in the positive x-axis direction. Vane member 300 is rotatably accommodated in a phase-converter housing (described later) of timing sprocket 100. Regarding the hydraulic actuator (the hydraulically-operated vane-type phase converter), timing sprocket 100, which rotates in synchronism with rotation of the crankshaft, serves as a driving rotational member, whereas vane member 300, which is fixedly connected or bolted to camshaft 200, serves as a driven rotational member. Hydraulic pressure supply-and-exhaust mechanism 400 is configured to rotate vane member 300 in a normal-rotational direction or in a reverse-rotational direction by hydraulic pressure.

Timing sprocket 100 has a phase-converter housing 102, a front cover 103, and a rear cover 104. Housing 102 is formed into a cylindrical shape, opened at both ends in the opposite x-axis directions. The outer periphery of housing 102 is formed integral with a toothed portion 101 in meshed-engagement with the timing chain. Front cover 103 is installed to hermetically cover the opening end of housing 102, facing in the positive x-axis direction, whereas rear cover 104 is installed to hermetically cover the opening end of housing 102, facing in the negative x-axis direction. Housing 102, front cover 103, and rear cover 104 are fastened together with four small-diameter bolts b1-b4.

Housing 102 is integrally formed on its inner periphery with four radially-inward protruded shoes 110, 120, 130, and 140. The four shoes are circumferentially spaced from each other by approximately 90 degrees. As can be appreciated from the cross section of FIG. 1, each of shoes 110-140 is formed as an elongated partition wall portion extending in the x-axis direction of housing 102. These shoes are hereinafter referred to as "partition wall portions". Each of partition wall portions 110-140 has a substantially trapezoidal shape in lateral cross section, taken in the direction perpendicular to the x-axis direction. As seen from the cross section of FIG. 1, the left-hand axial end face of each of partition wall portions 110-140 is in wall-contact with the inner peripheral surface of front cover 103, whereas the right-hand axial end face of each of partition wall portions 110-140 is in wall-contact with the inner peripheral surface of rear cover 104. As seen in FIGS. 1-2, in particular, as clearly seen from the lateral cross section of each of partition wall portions 110-140 in FIG. 2, partition wall portions 110-140 are formed substantially at their centers in trapezoidal lateral cross section with respective bolt insertion holes 111, 121, 131, and 141 (through holes extending in the x-axis direction) into which bolts b1, b2, b3, and b4 are inserted.

As viewed from the positive x-axis direction, the innermost ends 112, 122, 132, and 142 of the radially-inward protruded partition wall portions 110-140 are formed as somewhat concave circular-arc end faces, which are configured to be substantially conformable to the shape of the outer periphery of a vane rotor 301 of vane member 300. Partition wall portions 110-140 have respective axially-elongated seal retaining grooves 113, 123, 133, and 143, formed in their innermost ends 112, 122, 132, and 142 and extending in the x-axis direction. Four oil seal members 114, 124, 134, and 144, each being square in lateral cross section, are fitted into respective seal retaining grooves 113, 123, 133, and 143. Additionally, four leaf springs (not shown) are retained in respective seal retaining grooves 113, 123, 133, and 143, in a manner so as to force four seal members 114, 124, 134, and 144 into sliding-contact with the outer peripheral surface of vane rotor 301.

As can be seen from the cross section of FIG. 1, front cover 103 has a centrally-bored, large-diameter bolt insertion hole (a through hole) 105 into which a cam bolt 211 is inserted. Additionally, front cover 103 is formed with circumferentially equidistant-spaced, four bolt holes into which respective bolts b1-b4 are inserted. As seen from the cross section of FIG. 1, rear cover 104 is formed at its center with a bearing bore (or a housing supporting bore) 106, into which the camshaft end 210 of camshaft 200, facing in the positive x-axis direction, is inserted, so that the inner periphery of rear cover 104 is rotatably supported on the outer periphery of camshaft end 210. As clearly shown in FIG. 1, rear cover 104 is formed with circumferentially equidistant-spaced, four female screw-threaded portions into which the male screw-threaded portions of bolts b1-b4 are screwed.

Vane member 300 is rotatably accommodated in the cylindrical phase-converter housing 102. Vane member 300 is made of metal materials, such as sintered alloy materials. Vane member 300 is comprised of a substantially annular ring-shaped vane rotor 301 and four radially-extending vanes or blades 310, 320, 330, and 340. Vane rotor 301 and four vane blades 310, 320, 330, and 340 are integrally formed with each other. Vane rotor 301 has an axially-extending central bore 302 into which cam bolt (vane mounting bolt) 211 is inserted for bolting vane member 300 to camshaft end 210 by axially tightening the cam bolt. The axis of vane rotor 301 is coaxially aligned with the axis of camshaft 200. Four blades 310, 320, 330, and 340 are formed integral with vane rotor 301, such that the four blades are substantially equidistant-spaced apart from each other in the circumferential direction of vane rotor 301, and extend radially outwards from the outer periphery of vane rotor 301. As viewed in the x-axis direction, vane rotor 300 is formed on its right-hand side, facing camshaft end 210, with a central cylindrical-hollow fitting groove 303 into which camshaft end 210 is fitted from the negative x-axis direction.

As best seen in FIG. 2, in the hydraulically-operated four-blade vane member equipped VTC device, the areas of the outside circumferences of four blades 310-340 of the four-blade vane member 300, in other words, the circumferential widths of four blades 310-340 are dimensioned or set to be somewhat different from each other. Four blades 310-340 are classified into two sorts, namely a maximum-width blade 340 and the remaining narrow-width blades 310, 320, and 330. The maximum-width blade 340 of the four vane blades is configured to have an inverted trapezoidal shape in lateral cross section, whereas the remaining three vane blades 310, 320, and 330 are configured to be substantially rectangular in lateral cross section. The remaining three blades have almost the same circumferential width and the same radial length. The circumferential width of the maximum-width blade 340 having the inverted trapezoidal shape is dimensioned to be greater than that of each of the remaining three rectangular blades 310, 320, and 330. The four blades are circumferentially spaced apart from each other and arranged at predetermined angular positions, taking account of total weight balance of vane member 300, in other words, reduced rotational unbalance of vane member 300 having four blades 310-340. Each of four blades 310-340 is disposed in an internal space defined between the associated two adjacent partition wall portions.

Four blades 310-340 have respective axially-elongated seal retaining grooves 314, 324, 334, and 344, formed in their outermost ends (apexes) 313, 323, 333, and 343 and extending in the x-axis direction. Four oil seal members (four apex seals) 315, 325, 335, and 345 are fitted into respective seal retaining grooves 314, 324, 334, and 344. Additionally, four leaf springs LS (see the cross section of the hydraulic actuator in FIG. 1) are retained in respective seal retaining grooves 314, 324, 334, and 344, in a manner so as to force four seal members 315, 325, 335, and 345 into sliding-contact with the inner peripheral surface of housing 102.

The front end face of each of blades 310-340 and the rear end face of front cover 103 are opposed to each other with a very small clearance space. In a similar manner, the rear end face of each of blades 310-340 and the front end face of rear cover 104 are opposed to each other with a very small clearance space. Four variable-volume phase-advance chambers 311, 321, 331, and 341 and four variable-volume phase-retard chambers 312, 322, 332, and 342 are defined among the rear end face of front cover 103, the front end face of rear cover 104, both sidewalls of each of four blades 310-340 of vane member 300, facing to the rotational direction of the vane rotor, and both sidewalls of each of four partition wall portions 110-140 of housing 102. For instance, as seen in FIG. 2, variable-volume phase-advance chamber 341 is defined between the sidewall 346 of maximum-width blade 340, facing in the counterclockwise direction, and the sidewall 145 of partition wall portion 140, facing in the clockwise direction. Variable-volume phase-retard chamber 342 is defined between the sidewall 347 of maximum-width blade 340, facing in the clockwise direction, and the sidewall 115 of partition wall portion 110, facing in the counterclockwise direction.

As shown in FIG. 1, hydraulic pressure supply-and-exhaust mechanism 400 is comprised of the variable displacement vane pump VP, directional control valve 450, and a dual hydraulic-line system 410-420. The dual line system is comprised of the first hydraulic line 410 provided to supply and exhaust working oil (hydraulic pressure) to and from each of phase-advance chambers 311-341, and the second hydraulic line 420 provided to supply and exhaust working oil (hydraulic pressure) to and from each of phase-retard chambers 312-342. Each of hydraulic lines 410 and 420 are connected through directional control valve 450 to a working-oil supply passage 430 (functioning as a main oil gallery) and a working-oil drain passage 440. Pump VP (serving as a one-way variable displacement vane pump) is disposed in supply passage 430 for sucking or drawing working fluid in an oil pan 460 and for discharging the pressurized working oil from its discharge port. The downstream end of drain passage 440 communicates oil pan 460.

First hydraulic line 410 is provided between directional control valve 450 and each of phase-advance chambers 311-341. First hydraulic line 410 is further provided with a first flow-passage structure 411 and a first branch passage structure including four branch passages 412, 413, 414, and 415. First flow-passage structure 411 is constructed as a fluid-passage structure extending from the inside of the cylinder head via the inside of the cam bearing toward camshaft 200, and partly including an axial oil passage formed in camshaft 200. Four branch passages 412-415 are formed in vane rotor 301 in such a manner as to substantially radially extend from the inner periphery of the cylindrical bore of vane rotor 301 (see FIG. 2). Four phase-advance chambers 311-341 are communicated with first flow-passage structure 411 via respective branch passages 412-415.

On the other hand, second hydraulic line 420 is provided between directional control valve 450 and each of phase-retard chambers 312-342. Second hydraulic line 420 is further provided with a second flow-passage structure 421 and a second branch passage structure including four branch passages 422, 423, 424, and 425. Second flow-passage structure 421 is constructed as a fluid-passage structure extending from the inside of the cylinder head via the inside of the cam bearing toward camshaft 200, and partly including an axial oil passage formed in camshaft 200. Four branch passages 422-425 are formed in vane rotor 301 in such a manner as to substantially radially extend from the inner periphery of the cylindrical bore of vane rotor 301 (see FIG. 2). Four phase-retard chambers 312-342 are communicated with second flow-passage structure 421 via respective branch passages 422-425.

Directional control valve 450 is constructed by a spring-offset solenoid-actuated directional control valve. Directional control valve 450 is comprised of a valve housing (a substantially cylindrical valve body) 470, an electromagnetic solenoid 480, and a sliding valve spool 490. Valve housing 470 is fitted to a valve retaining bore 451 formed in the cylinder head. Solenoid 480 is installed on the left-hand axial end of valve housing 470 (viewing FIG. 1). Valve spool 490 is a substantially cylindrical member that has large-diameter lands (described later) machined to axially slide in a very close-fitting bore of valve housing 470. The grooves between the lands provide the flow passages between ports (described hereunder).

Valve housing 470 has a supply port 471 formed substantially at a middle position of the axially-elongated valve housing 470, a first port 472 formed on the side of the positive x-axis direction with respect to supply port 471, and a second port 473 formed on the side of the negative x-axis direction with respect to supply port 471. Also, valve housing 470 has a first drain port 474 formed on the side of the negative x-axis direction with respect to first port 472, and a second drain port 475 formed on the side of the positive x-axis direction with respect to second port 473. Supply port 471 intercommunicates supply passage 430 and the internal space of valve housing 470. First port 472 intercommunicates first hydraulic line 410 and the internal space of valve housing 470, whereas second port 473 intercommunicates second hydraulic line 420 and the internal space of valve housing 470. Each of first and second drain ports 474-475 intercommunicates the internal space of valve housing 470 and drain passage 440.

Solenoid 480 is comprised of a solenoid casing 481, an electromagnetic coil 482 installed in the solenoid casing, a stationary core 483, and a movable plunger 484. Stationary core 483 is magnetized by energizing electromagnetic coil 482. When stationary core 483 is magnetized, movable plunger 484 is forced in the negative x-axis direction against the spring force of a return spring RS, thus creating a sliding motion of valve spool 490 in the negative x-axis direction. Electromagnetic coil 482 of solenoid 480 is connected via a wiring harness 485 to an electronic control unit (simply, a controller) CU.

Valve spool 490 is formed integral with four lands, that is, the first land 491, the second land 492 formed on the side of the negative x-axis direction with respect to first land 491, the third land 493 formed on the side of the positive x-axis direction with respect to first land 491, and the fourth land 494 formed on the side of the positive x-axis direction with respect to third land 493. The left-hand axial end of fourth land 494, facing in the positive x-axis direction, is in abutted-engagement with the right-hand axial end of movable plunger 484. Return spring RS is installed between the right-hand end face of second land 492 and a return spring retainer 476 formed at the right-hand axial end of valve housing 470, under preload. As set forth above, directional control valve 450 uses the sliding valve spool 490 to change the path of flow through the directional control valve. For a given position of valve spool 490, a unique flow path configuration exists within the valve. Concretely, depending on an axial position of valve spool 490, first land 491 functions to open or close first port 472, whereas third land 493 functions to open or close second port 473. More concretely, directional control valve 450 is designed to switch among at least three positions of the spool, namely a spring-offset position (a solenoid de-energized position) shown in FIG. 1, a block-off position (an intermediate position created due to the balancing opposing forces, that is, the return spring force and the electromagnetic force produced by the solenoid), and a fully solenoid-energized position. In the spring-offset position (with solenoid 480 de-energized), the maximum displacement of valve spool 490 in the positive x-axis direction is created by the spring force of return spring RS, and whereby fluid communication between supply port 471 and second port 473 is established, and fluid communication between first port 472 and first drain port 474 is established. In the block-off position, valve spool 490 is positioned at its intermediate axial position between the maximum displacement of valve spool 490 in the positive x-axis direction and the maximum displacement of valve spool 490 in the negative x-axis direction, and whereby fluid communication between each of first and second ports 472-473 and supply port 471 is blocked and fluid communication between each of first and second ports 472-473 and drain passage 440 is blocked. In the fully solenoid-energized position, the maximum displacement of valve spool 490 in the negative x-axis direction is created by the electromagnetic force of solenoid 480, and whereby fluid communication between supply port 471 and first port 472 is established, and fluid communication between second port 473 and second drain port 475 is established. Switching operation among the three positions of the valve spool of directional control valve 450 is executed responsively to a control command signal generated from the output interface circuitry of controller CU to the solenoid.

Controller CU generally comprises a microcomputer. Controller CU includes an input/output interface (I/O), memories (RAM, ROM), and a microprocessor or a central processing unit (CPU). The input/output interface (I/O) of the controller receives input information from various engine/vehicle sensors, namely a crank angle sensor, an airflow meter, a throttle opening sensor, an engine temperature sensor (an engine coolant temperature sensor), a camshaft angular position sensor, and the like. Within the controller, the central processing unit (CPU) allows the access by the I/O interface of input informational data signals from the engine/vehicle sensors. The processor of controller CU determines the current engine/vehicle operating condition, based on input information from the engine/vehicle sensors. The crank angle sensor is provided to detect an angular position (crankangle) of the crankshaft, and for detecting engine speed. The camshaft angular position sensor is provided for detecting an angular position of camshaft 200. Also, based on both of the sensor signals from the crank angle sensor and the camshaft angular position sensor, an angular phase of camshaft 200 relative to timing sprocket 100 is detected. The airflow meter is provided for measuring or detecting a quantity of air flowing through an intake pipe, and consequently for detecting or estimating the magnitude of engine load. The CPU of the controller is responsible for carrying the phase control program stored in memories. Computational results (arithmetic calculation results), that is, a calculated output signal (e.g., a pulsed control current) is relayed through the output interface circuitry of the controller to output stages, namely the solenoid 480 (exactly, the electrically energized solenoid coil 482) of electromagnetic directional control valve 450.

Also provided is a lock mechanism 500 disposed between maximum-width blade 340 of vane member 300 and rear cover 104 of phase-converter housing 102, for disabling rotary motion of vane member 300 relative to rear cover 104 (or timing sprocket 100) by locking and engaging vane member 300 with housing 102, and for enabling rotary motion of vane member 300 relative to rear cover 104 by unlocking (or disengaging) vane member 300 from housing 102. As can be seen from the cross section of FIG. 1, lock mechanism 500 is comprised of a lock piston 510, an engaging-hole structural member 520, a spring retainer 530, and a return spring (a coiled compression spring) 540. FIG. 14B shows the cross section, taken along the line J-J of FIG. 2.

A lock-piston sliding-motion permitting bore (simply, a lock-piston bore) 501 is formed in the inverted trapezoidal blade 340 of the maximum circumferential width, such that lock-piston bore 501 extends in the x-axis direction of camshaft 200. Lock-piston bore 501 is comprised of a small-diameter chamber 502 formed on the side of the negative x-axis direction and a large-diameter chamber 503 formed on the side of the positive x-axis direction. Lock piston 510 is formed into a substantially cylindrical shape and closed at one axial end (the right-hand side axial end, viewing in FIG. 1). Lock piston 510 is slidably installed in lock-piston bore 501. The right-hand axial end of lock piston 510 is formed as a tapered head portion 511, which is engaged with or disengaged from engaging-hole structural member 520 of rear cover 104. Lock piston 510 has a cylindrical sliding portion 512 formed integral with tapered head portion 511 and extending from tapered head portion 511 in the positive x-axis direction. The leftmost end of lock piston 510 is formed as an annular flanged portion 513.

The outside diameter of sliding portion 512 is dimensioned to be substantially equal to the inside diameter of small-diameter chamber 502 of lock-piston bore 501. Sliding portion 512 is accommodated in small-diameter chamber 502, such that sliding motion of sliding portion 512 relative to small-diameter chamber 502 is permitted. The outside diameter of annular flanged portion 513 is dimensioned to be greater than the outside diameter of sliding portion 512 and also dimensioned to be substantially equal to the inside diameter of large-diameter chamber 503 of lock-piston bore 501. Flanged portion 513 is accommodated in large-diameter chamber 503, such that sliding motion of flanged portion 513 relative to large-diameter chamber 503 is permitted. A stepped portion 504 is formed between small-diameter chamber 502 and large-diameter chamber 503 of maximum-width blade 340. A pressure-receiving chamber 550 is defined between the annular face of stepped portion 504, facing in the positive x-axis direction, and the annular face of flanged portion 513, facing in the negative x-axis direction.

Rear cover 104 is formed with an axially-bored retaining hole 505. Engaging-hole structural member 520 has a cup-shape in axial cross section, and press-fitted into the retaining hole 505 of rear cover 104. A lock-piston engaging hole 521, having a substantially trapezoidal shape in axial cross section, is defined in the cup-shaped engaging-hole structural member 520. As seen in FIG. 2, when vane member 300 is positioned in its maximum phase-retard position, that is, when the sidewall 346 of maximum-width blade 340 is kept in abutted-engagement with the sidewall 145 of partition wall portion 140 and thus the volumetric capacity of phase-advance chamber 341 becomes minimum, as viewed from the x-axis direction, the axis of lock piston 510 is aligned with the axis of engaging hole 521 of cup-shaped engaging-hole structural member 520 of rear cover 104. Under these conditions, when a sliding motion of lock piston 510 in the negative x-axis direction occurs, tapered head portion 511 of lock piston 510 is brought into engagement with engaging hole 521. Conversely when a sliding motion of lock piston 510 in the positive x-axis direction occurs, tapered head portion 511 of lock piston 510 is brought out of engagement with engaging hole 521.

Spring retainer 530 is fitted to the inner peripheral surface of large-diameter chamber 503. Return spring 540 is installed between spring retainer 530 and lock piston 510, under preload. Return spring 540 acts to permanently force lock piston 510 in the negative x-axis direction, that is, toward rear cover 104 (i.e., toward lock-piston engaging hole 521). With vane member 300 kept in its maximum phase-retard position (see FIG. 2), tapered head portion 511 of lock piston 510 is forced in the negative x-axis direction by the spring force of return spring 540, and thus tapered head portion 511 is brought into engagement with engaging hole 521. As a result of this, relative rotation of vane member 300 to rear cover 104, that is, relative rotation of camshaft 200 to timing sprocket 100, is locked or prevented.

As shown in FIG. 14B, a first oil groove 343*g* is formed in maximum-width blade 340, so as to intercommunicate phase-advance chamber 341 and small-diameter chamber 502. A second oil hole 344*h* is also formed in maximum-width blade 340, so as to intercommunicate phase-retard chamber 342 and pressure-receiving chamber 550. Tapered head portion 511 of lock piston 510 receives hydraulic pressure of working oil supplied from phase-advance chamber 341 via first oil groove 343*g* into lock-piston engaging hole 521, such that lock piston 510 is forced in the positive x-axis direction by the hydraulic pressure. Additionally, flanged portion 513 of lock piston 510 receives hydraulic pressure of working oil from phase-retard chamber 342 via second oil hole 344*h* into pressure-receiving chamber 550, such that lock piston 510 is forced in the positive x-axis direction by the hydraulic pressure. Hence, lock piston 510 can be forced in the positive x-axis direction by either the hydraulic pressure applied to tapered head portion 511 or the hydraulic pressure applied to flanged portion 513, against the spring force of return spring 540, so as to disengage lock piston 510 from lock-piston engaging hole 521.

As discussed above, return spring 540 functions as a locked-state holding mechanism. The spring force (i.e., the spring stiffness) of return spring 540 is designed or set such that lock piston 510 cannot be disengaged from lock-piston engaging hole 521 without a remarkable compressive deformation of return spring 540, even when air staying in phase-retard chamber 342 during an engine startup period is compressed by hydraulic pressure of working oil force-fed from pump VP to phase-retard chamber 342, and then the compressed air is introduced into pressure-receiving chamber 550 to force flanged portion 513 of lock piston 510 in the positive x-axis direction.

(Construction of Variable Displacement Vane Pump)

Figure 3:
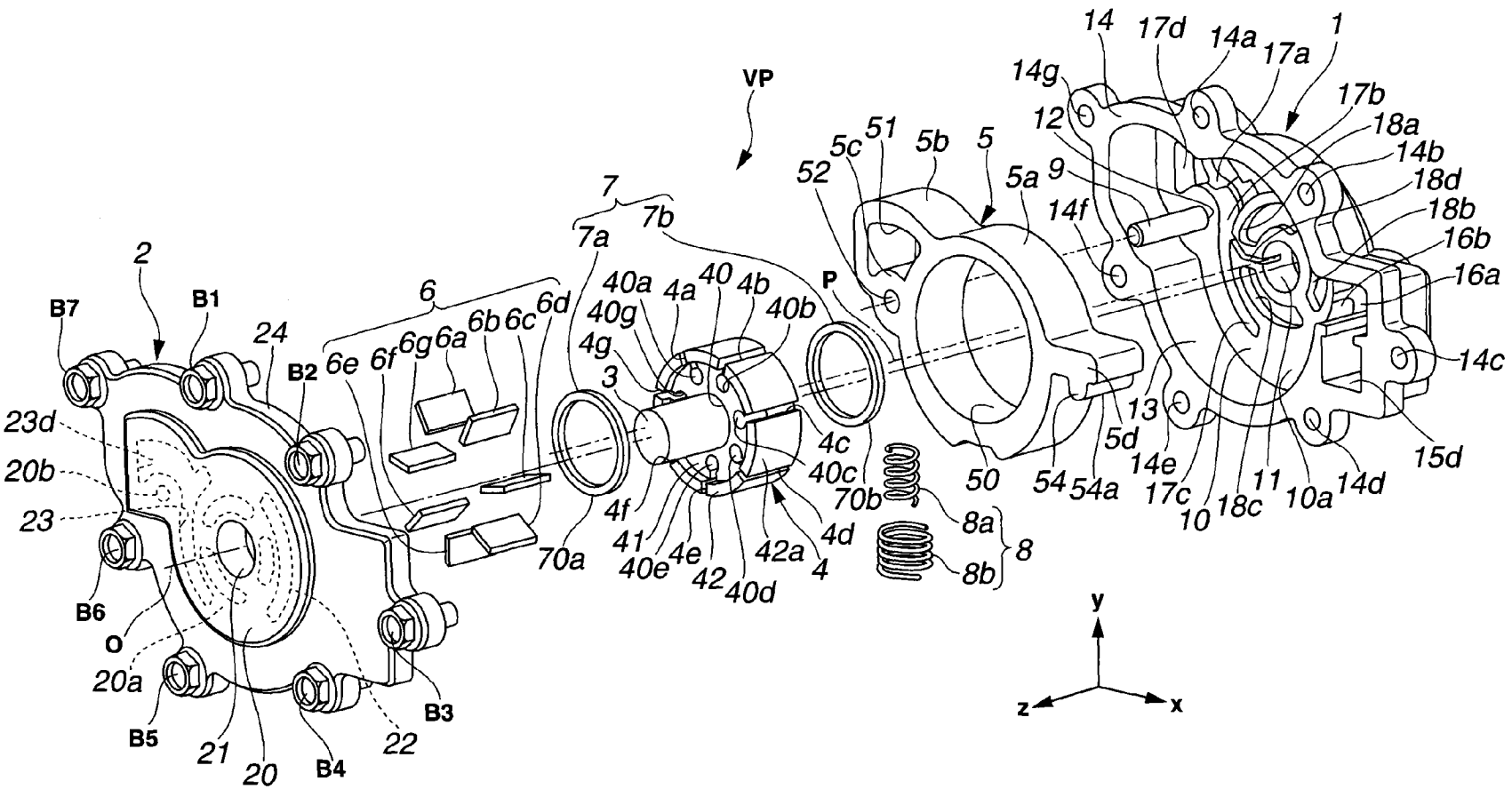
FIG. 3 is a disassembled view of the variable displacement vane pump of the first embodiment.

As seen from the disassembled view of pump VP of FIG. 3, pump VP is comprised of a pump housing 1, a pump cover 2, a drive shaft 3, a pump rotor 4, a cam ring 5, a plurality of vanes 6, a pair of vane rings 7 (i.e., vane rings 7*a*, 7*b*), a biasing member 8, and a pivot pin 9. For convenience's sake, assume that the direction of the axis "O" of drive shaft 3 is taken as z-axis, one axial direction of drive shaft 3 oriented from pump housing 1 to pump cover 2 is defined as a positive z-axis direction, and the opposite axial direction of drive shaft 3 oriented from pump cover 2 to pump housing 1 is defined as a negative z-axis direction.

Pump housing 1 is formed into a substantially cylindrical shape and closed at one axial end (the right-hand side axial end, viewing in FIG. 3). Under a condition where vane-pump component parts, such as rotor 4 and cam ring 5, are accommodated or installed in pump housing 1, the left-hand side opening end of pump housing 1 is hermetically closed by pump cover 2. Pump housing 1 has a basal portion 10 formed on the side of the negative z-axis direction, a peripheral wall 13 extending from the perimeter of basal portion 10 in the positive z-axis direction, and a flanged portion 14 formed on the side of the positive z-axis direction of peripheral wall 13. Basal portion 10, peripheral wall 13, and flanged portion 14 are formed integral with each other. Basal portion 10 is formed at a substantially central portion with a bearing bore (or a drive-shaft supporting bore) 11, by which drive shaft 3 is rotatably supported. Bearing bore 11 is formed as a through hole penetrating basal portion 10 in the z-axis direction. Additionally, basal portion 10 has a pin insertion hole 12 whose axis is parallel to the z-axis. Pivot pin 9 is inserted and fitted into pin insertion hole 12 from the positive z-axis direction. The perimeter of flanged portion 14 is formed with seven female screw-threaded portions 14*a*-14*g* into which the male screw-threaded portions of bolts B1-B7 are screwed.

As viewed from the z-axis direction, pump cover 2 has almost the same shape as pump housing 1. Pump cover 2 is comprised of a main-body portion 20, and a flanged portion 24 formed integral with the perimeter of main-body portion 20. Main-body portion 20 is formed at a substantially central portion with a bearing bore (or a drive-shaft supporting bore) 21, by which drive shaft 3 is rotatably supported, and which is formed as a through hole penetrating main-body portion 20 in the z-axis direction. Additionally, the bottom face (or the base) 20*a* of main-body portion 20 has a pin supporting portion 20*b* formed on the side of the negative z-axis direction, so as to support the axial end of pivot pin 9, facing in the positive z-axis direction. As described later, portions formed in bottom face 20*a* of main-body portion 20 of pump cover 2 and indicated by the broken line in FIG. 3, correspond to an inlet port 22 (described later), a discharge port 23 (described later), and oil storage portions (described later).

The perimeter of flanged portion 24 is formed with seven bolt holes, which are formed as through holes penetrating the perimeter of flanged portion 24 in the z-axis direction. Seven bolts B1-B7 are inserted into the respective bolt holes of flanged portion 24 of pump cover 2 and then the male screw-threaded portions of bolts B1-B7 are screwed into respective female screw-threaded portions 14*a*-14*g* of pump housing 1, such that pump cover 2 is fixedly connected to pump housing 1 by tightening seven bolts B1-B7. For the reasons discussed later, in the shown embodiment, pump housing 1 and pump cover 2 are integrally connected to each other with seven bolts B1-B7 without interleaving a seal member (an oil seal or a gasket usually used to enhance a fluid-tight performance of the vane pump) between flanged portion 14 of pump housing 1 and flanged portion 24 of pump cover 2.

Both ends of drive shaft 3 are inserted into respective bearing bores 11 and 21 of pump housing 1 and pump cover 2, such that drive shaft 3 is rotatably supported by means of bearing bores 11 and 21. Rotor 4 is fixed onto the outer periphery of drive shaft 3 for co-rotation with drive shaft 3. The axial end of drive shaft 3, facing in the negative z-axis direction, is connected to the engine crankshaft. That is, drive shaft 3 of pump VP is driven by torque transmitted from the engine crankshaft to drive shaft 3. As viewed from the positive z-axis direction, drive shaft 3 rotates counterclockwise.

Rotor 4 has a substantially cylindrical shape or a substantially disc shape. Assuming that rotor 4 is cut along the plane passing through the axis of rotor 4, the cross section becomes a substantially I-shaped cross section. That is, rotor 4 has a thin-walled inner peripheral portion 41 having a comparatively less thickness in the z-axis direction, and a thick-walled outer peripheral portion 42 having a comparatively greater thickness in the z-axis direction. The thin-walled inner peripheral portion 41 of rotor 4 is formed with a fitted central bore 40 (a through hole) penetrating the center of rotor 4 in the z-axis direction. Drive shaft 3 and rotor 4 are integrally connected to each other by press-fitting drive shaft 3 into the fitted central bore 40 of rotor 4. Rotor 4 is rotatably accommodated in pump housing 1. Rotor 4, together with drive shaft 3, is driven by the engine crankshaft. That is, rotor 4, together with drive shaft 3, rotates in synchronism with rotation of the crankshaft.

As best seen in FIG. 3, rotor 4 is formed with circumferentially equidistant-spaced, radially-extending seven slits 4*a*-4*g*. Seven slits 4*a*-4*g*, each having a predetermined circumferential width in the circumferential direction of rotor 4, are formed in rotor 4, in such a manner as to extend radially inwards from the outer peripheral surface 42*a* of thick-walled outer peripheral portion 42 toward the axis "O" of drive shaft 3 without reaching the fitted central bore 40. Radially-inward extending slits 4*a*-4*g* are formed at their innermost ends with respective back-pressure chambers 40*a*-40*g*, each having a substantially circular in lateral cross section.

Cam ring 5 is a movable member, which is installed in a manner so as to be slidable relative to each of pump cover 1 and pump housing 2, while accommodating therein rotor 4. Cam ring 5 is substantially cylindrical in shape. Cam ring 5 is formed of a cylindrical portion 5*a*, a sector portion 5*b*, a pivot portion 5*c*, and an arm portion 5*d*. These portions 5*a*-5*d* are formed integral with each other and made of sintered alloy materials, such as iron-based sintered alloy materials.

Cylindrical portion 5*a* accommodates therein rotor 4. As viewed from the z-axis direction, assume that the geometric center of an inner peripheral surface (a cylinder bore) 50 of cylindrical portion 5*a* is taken as a point "P". Sector portion 5*b* is laid out on the outer periphery of cylindrical portion 5*a* and formed integral with cylindrical portion 5*a*. Sector portion 5*b* has a substantially sector cross-section in the direction along the plane perpendicular to the z-axis. Sector portion 5*b* is formed therein with a working-oil communication hole 51.

In a similar manner to sector portion 5*b*, pivot portion 5*c* is also laid out on the outer periphery of cylindrical portion 5*a* and formed integral with cylindrical portion 5*a*. Pivot portion 5*c* has a small annular cross section in the direction along the plane perpendicular to the z-axis. Pivot portion 5*c* has a pivot bore 52 formed as a through hole extending in the z-axis direction. Cam ring 5 is accommodated in the internal space of pump housing 1, under a condition where pivot pin 9 is inserted and fitted into pivot bore 52. Cam ring 5 is rotatably supported by means of pivot portion 5*c* in such a manner as to be rotatable about the pivot pin 9. That is, pivot pin 9 serves as a pivot of cam ring 5, in other words, a fulcrum of oscillating motion of cam ring 5.

Arm portion 5*d* and pivot portion 5*c* are laid out to be substantially symmetrical to each other with respect to the geometric center "P". Arm portion 5*d* is also laid out on the outer periphery of cylindrical portion 5*a* and formed integral with cylindrical portion 5*a*. The width of cam ring 5 in the z-axis direction is the same for all of cylindrical portion 5*a*, sector portion 5*b*, pivot portion 5*c*, and arm portion 5*d*. The width of cam ring 5 in the z-axis direction is dimensioned to be substantially identical to the depth of pump housing 1, that is, the length of peripheral wall 13 of pump housing 1 in the z-axis direction.

The end face of cam ring 5, facing in the positive z-axis direction, and the end face of pump-cover main-body portion 20, facing in the negative z-axis direction, are opposed to each other with a very small clearance space. Thus, sliding motion of the end face of cam ring 5, facing in the positive z-axis direction, relative to the end face of pump-cover main-body portion 20, facing in the negative z-axis direction, is permitted. In a similar manner, the end face of cam ring 5, facing in the negative z-axis direction, and the bottom face 10*a* of pump-housing basal portion 10, facing in the positive z-axis direction, are opposed to each other with a very small clearance space. Thus, sliding motion of the end face of cam ring 5, facing in the negative z-axis direction, relative to the bottom face 10*a* of pump-housing basal portion 10, facing in the positive z-axis direction, is permitted. That is, pump-housing basal portion 10 and pump-cover main-body portion 20 are assembled or installed to serve as sidewalls opposing both sides of cam ring 5 in the opposite z-axis directions. Cam ring 5 is provided between the two opposed sidewalls of pump-housing basal portion 10 and pump-cover main-body portion 20, such that oscillating motion of cam ring 5 about the pivot (i.e., pivot pin 9) is permitted.

In the shown embodiment, the term "sliding motion" basically means that two members are in sliding-contact with each other, such that a relative displacement of one of the two members to the other is permitted. The term "sliding motion" also means that two members are in sliding-contact with each other via an oil film filling in the clearance space defined between them, such that a relative displacement of one of the two members to the other is permitted with the oil film for lubrication.

Cam ring 5 is configured so that the geometric center "P" of the cylinder bore of cam-ring cylindrical portion 5*a* can displace from the axis "O" of drive shaft 3 in the direction perpendicular to the axis "O" of drive shaft 3, while keeping a parallel layout of the geometric center "P" of the cylinder bore (inner peripheral surface 50) of cam-ring cylindrical portion 5*a* parallel to the axis "O" of drive shaft 3 in the z-axis direction. That is, cam ring 5 is configured so that the geometric center of "P" of cam ring 5 can oscillate eccentrically with respect to the axis "O" of drive shaft 3.

In the shown embodiment, the plurality of vanes 6 of pump VP are seven vanes 6*a*, 6*b*, 6*c*, 6*d*, 6*e*, 6*f*, and 6*g*. These vanes 6*a*-6*g* are the same in shape and formed into a rectangular shape. The width of each of vanes 6*a*-6*g* is dimensioned to be substantially identical to the length of rotor 4 in the z-axis direction. Vane 6*a* is fitted into the associated slit 4*a* of rotor 4, in such a manner as to be slidable (retractable and extendable) in the radial direction of rotor 4. In the same manner as vane 6*a*, the other vanes 6*b*-6*g* are slidably fitted into respective slits 4*b*-4*g*. The length of each of vanes 6*a*-6*g* in the radial direction of rotor 4 is dimensioned to be shorter than the overall depth of each of slits 4*a*-4*g*, including respective back-pressure chambers 40*a*-40*g*. Each of vanes 6*a*-6*g* is slidably fitted into respective slits 4*a*-4*g*, so as to be radially extendable from outer peripheral surface 42*a* of rotor 4 toward inner peripheral surface 50 of cylindrical portion 5*a*.

The vane-ring pair 7 is comprised of two ring-shaped members 7*a*, 7*b*, each having the same shape and has the same outside diameter dimensioned to be smaller than the outside diameter of inner peripheral portion 41 of rotor 4. Vane ring 7*a* is installed in one sidewall of inner peripheral portion 41 from the positive z-axis direction, so that sliding motion of vane ring 7*a* relative to the one sidewall of inner peripheral portion 41 is permitted. Vane ring 7*b* is installed in the opposite sidewall of inner peripheral portion 41, so that sliding motion of vane ring 7*b* relative to the opposite sidewall of inner peripheral portion 41 is permitted. Drive shaft 3 extends in the z-axis direction so as to pass through the internal space of each of vane rings 7*a*, 7*b*. The radially-inward end (the root) of each of vanes 6*a*-6*g* is in abutted-engagement with each of the outer peripheral surfaces of vane rings 7*a*-7*b*.

By means of the abutted portions of vane rings 7*a*-7*b*, each of vanes 6*a*-6*g* is supported with two points in the z-axis direction. The vane-ring pair 7*a*-7*b* has a function that pushes or forces each of vanes 6*a*-6*g* outwards in the radial direction of rotor 4. The tip (the top end) of each of the radially-outward forced vanes 6*a*-6*g* is in abutted-engagement with inner peripheral surface 50 of cylindrical portion 5*a*.

That is, when the center of each of vane rings 7*a*-7*b* is aligned with the geometric center "P" of cam ring 5, the distance between inner peripheral surface 50 of cylindrical portion 5*a* and each of outer peripheral surfaces 70*a*-70*b* of vane rings 7*a*-7*b* is dimensioned to be substantially identical to the length of each of vanes 6*a*-6*g* in the radial direction of rotor 4. Therefore, pump VP is configured such that, during rotation of rotor 4, the root of each of vanes 6*a*-6*g* is kept in sliding-contact with the outer peripheral surfaces 70*a*-70*b* of vane rings 7*a*-7*b*, while the tip of each of vanes 6*a*-6*g* is kept in sliding-contact with inner peripheral surface 50 of cam ring 5. In other words, during rotation of rotor 4, the center of each of vane rings 7*a*-7*b* is automatically positioned so as to align with the geometric center "P" of cam ring 5 by abutment of the root of each of vanes 6*a*-6*g* with the outer peripheral surfaces 70*a*-70*b* of vane rings 7*a*-7*b*.

Biasing member 8 is comprised of a small-diameter first coil spring 8*a* and a large-diameter second coil spring 8*b*. Biasing member 8 is accommodated in a spring chamber 15*d* defined in pump housing 1, under preload. Biasing member 8 forces arm portion 5*d* of cam ring 5 in one direction by a biasing force (a spring bias or a spring force), so as to produce a moment by which cam ring 5 can be rotated about pivot pin 9. Biasing member 8 is installed in pump-housing spring chamber 15*d* so as to permanently force cam ring 5 in the one direction (in the direction of action of spring bias) in which the eccentricity of cam ring 5 increases, in other words, the geometric center "P" of the cylinder bore of cam-ring cylindrical portion 5*a* displaces apart from the axis "O" of drive shaft 3 (i.e., the rotation center "O" of vane rotor 4).

(Construction of Pump Housing)

Figure 4:
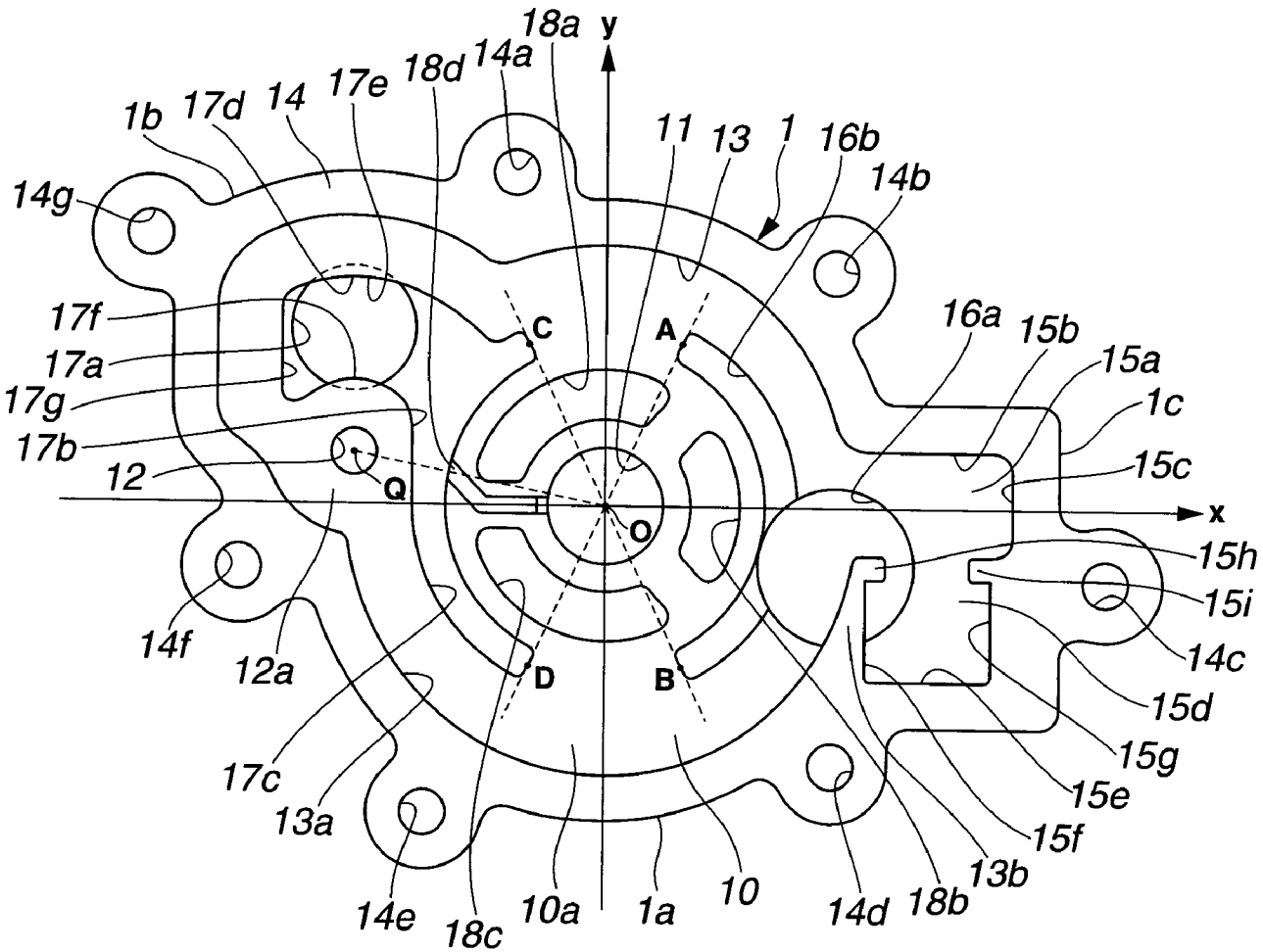
FIG. 4 is a front elevation view of a pump housing of the variable displacement vane pump of the first embodiment.

FIG. 4 shows the front elevation view of pump housing 1, as viewed from the positive z-axis direction of FIG. 3. In the elevation view of FIG. 4, assume that the center of bearing bore 11 of basal portion 10 of pump housing 1 (i.e., the axis of drive shaft 3) is taken as "origin O", a directed line Ox is taken as x-axis, and a directed line Oy is taken as y-axis to set an orthogonal coordinate system. In FIG. 4, the line parallel to the bottom face of the inner periphery of a second swelling portion 1*c* (i.e., the bottom face 15*e* of spring chamber 15*d*) and passing through the origin "O" (the axis of drive shaft 3 or the rotation center of rotor 4) is taken as the x-axis, whereas the line perpendicular to bottom face 15*e* and passing through the origin "O" is taken as the y-axis. The side of spring chamber 15*d* with respect to the origin "O" is defined as a positive x-axis direction. The side of a discharge hole 17*a* with respect to the origin "O" (or the x-axis) is defined as a positive y-axis direction.

Basal portion 10, peripheral wall 13, and flanged portion 14, constructing pump housing 1, are formed integral with each other, and made of aluminum alloy materials. During oscillating motion of cam ring 5, the end face of cam ring 5, facing in the negative z-axis direction, slides along the bottom face 10*a* of pump-housing basal portion 10, facing in the positive z-axis direction. Thus, the area of the bottom face 10*a* of pump-housing basal portion 10, corresponding to a given area of sliding motion of cam ring 5, is more accurately machined in flatness and surface roughness.

Pump housing 1 has a cylindrical portion 1*a*, and first and second swelling portions 1*b*-1*c*. As viewed from the z-axis direction, the inner peripheral surface 13*a* of peripheral wall 13 of cylindrical portion 1*a* is formed into a substantially circular shape whose center is the origin "O". The distance, measured from the origin "O" to inner peripheral surface 13*a* in the negative y-axis direction, is dimensioned to be slightly greater than the distance, measured from the origin "O" to inner peripheral surface 13*a* in the positive y-axis direction. Pump-housing cylindrical portion 1*a* is configured to accommodate therein cam-ring cylindrical portion 5*a*. First swelling portion 1*b* is formed to swell radially outwards from pump-housing cylindrical portion 1*a* in a combined direction of the negative x-axis direction and the positive y-axis direction. In other words, first swelling portion 1*b* is laid out within the second quadrant of the orthogonal coordinate system, which second quadrant is defined as $\{(x, y)|x<0, y>0\}$. Sector portion 5*b* and pivot portion 5*c* of cam ring 5 are both accommodated in first swelling portion 1*b*.

Second swelling portion 1*c* is formed to swell radially outwards from pump-housing cylindrical portion 1*a* in the positive x-axis direction. Second swelling portion 1*c* is formed as a hollow rectangular parallelopiped. Second swelling portion 1*c* has an arm-portion accommodating chamber 15*a* formed on the side of the positive y-axis direction of second swelling portion 1*c*, and spring chamber 15*d* formed on the side of the negative y-axis direction of second swelling portion 1*c*. Arm-portion accommodating chamber 15*a* accommodates therein arm portion 5*d* of cam ring 5, whereas spring chamber 15*d* accommodates therein biasing member 8.

As viewed from the z-axis direction, the inner peripheral surface of arm-portion accommodating chamber 15*a* is formed into a substantially rectangular shape. Arm-portion accommodating chamber 15*a* is configured to be surrounded by a seat surface 15*b* arranged parallel to the x-axis on the side of the positive y-axis direction of arm-portion accommodating chamber 15*a* and a wall surface 15*c* parallel to the y-axis on the side of the positive x-axis direction of arm-portion accommodating chamber 15*a*. Arm-portion accommodating chamber 15*a* is configured to open into spring chamber 15*d* in the negative y-axis direction. Seat surface 15*b* is formed at the position substantially symmetrical to the pin insertion hole 12 with respect to the origin "O". Concretely, seat surface 15*b* is formed substantially at the same level as the center of pin insertion hole 12 in the y-axis direction. In an initial setting state of cam ring 5 installed in pump housing 1, seat surface 15*b* functions as a seat on which arm portion 5*d* is seated. In order to suppress initial fluctuations in a pump discharge of pump VP, seat surface 15*b* is more accurately machined, fully taking into account the positional relationship with both pin insertion hole 12 and bearing bore 11.

As viewed from the z-axis direction, the inner peripheral surface of spring chamber 15*d* is formed into a substantially rectangular recessed shape. Spring chamber 15*d* is configured to be surrounded in three directions by two wall surfaces 15*f*-15*g*, both parallel to the y-axis, and bottom face 15*e* parallel to the x-axis. Spring chamber 15*d* is configured to open into arm-portion accommodating chamber 15*a* on the side of the positive y-axis direction of spring chamber 15*d*. Two shoulder portions (engaging portions) 15*h*-15*i*, extending in the z-axis direction and opposed to each other in the x-axis direction, are formed at the opening end of spring chamber 15*d*. Shoulder portion 15*h*, located on the side of the negative x-axis direction of spring chamber 15*d*, is formed to protrude by a predetermined length in the positive x-axis direction from the uppermost end (viewing FIG. 4) of a peripheral wall portion 13*b* by which wall surface 15*f* is defined. Shoulder portion 15*i*, located on the side of the positive x-axis direction of spring chamber 15*d*, is formed to protrude by a predetermined length in the negative x-axis direction from the rightmost end (viewing FIG. 4) of peripheral wall 13 by which wall surface 15*g* is defined.

Pump housing 1 has an inlet portion (namely, an inlet hole 16*a*, an inlet port 16*b*), a discharge portion (namely, a discharge hole 17*a*, a discharge port 17*b*), oil storage portions 18*a*-18*c*, which are collectively referred to as "oil storage portion 18", and a bearing lubrication oil groove 18*d*, all formed in pump-housing basal portion 10, in addition to bearing bore 11 and pin insertion hole 12.

Inlet hole 16*a* is formed as a cylindrical through opening, which penetrates basal portion 10 in the z-axis direction. Inlet hole 16*a* is located on the side of the positive x-axis direction of cylindrical portion 1*a* in such a manner as to be slightly offset from the directed line Ox in the negative y-axis direction. Inlet hole 16*a* is arranged to bestride the boundary between the rightmost end of cylindrical portion 1*a* and the leftmost end of second swelling portion 1*c*. As viewed from the z-axis direction, inlet hole 16*a* is configured to overlap with a part of peripheral wall portion 13*b* and shoulder portion 15*h*. Inlet hole 16*a* serves as a working-oil inlet passage when drawing working oil stored in oil pan 460 into the pump during operation of pump VP.

Inlet port 16*b* is a crescent-shaped groove formed in pump-housing basal portion 10 and having a predetermined depth and a predetermined width. Inlet port 16*b* is arranged on the right-hand half of bottom face 10*a* (on the side of the positive x-axis direction of cylindrical portion 1*a*). As viewed from the z-axis direction, inlet port 16*b* is formed in bottom face 10*a* as a circular arc with the center "O" (corresponding to the axis of drive shaft 3) and a predetermined distance (i.e., a predetermined radius) from the center "O". The circular-arc shaped inlet port 16*b* is arranged to be symmetrical with respect to the x-axis so as to extend circumferentially by approximately 120 degrees. Inlet port 16*b* is formed on the side of the negative x-axis direction of seat surface 15*b* (or arm-portion accommodating chamber 15*a*). Inlet port 16*b* communicates inlet hole 16*a*.

Discharge hole 17*a* is formed in basal portion 10 as a cylindrical opening, which extends in the z-axis direction. Discharge hole 17*a* is located within first swelling portion 1*b*. Discharge hole 17*a* serves as a working-oil discharge passage when discharging working oil from pump VP during operation of pump VP. Discharge hole 17*a* is connected to supply passage 430 (functioning as the main oil gallery of the engine), so as to communicate with moving and/or sliding engine parts and the VTC device.

Discharge port 17*b* is a groove formed in pump-housing basal portion 10 and having a predetermined depth. Discharge port 17*b* is comprised of a circular-arc shaped groove 17*c* arranged on the left-hand half of bottom face 10*a* (on the side of the negative x-axis direction of cylindrical portion 1*a*) and having a predetermined circumferential width, and a sector groove 17*d* formed in bottom face 10*a* of first swelling portion 1*b* in such a manner as to be continuous with circular-arc shaped groove 17*c*. As viewed from the z-axis direction, sector groove 17*d* is configured to overlap with discharge hole 17*a*. Discharge port 17*b* communicates discharge hole 17*a*. When viewed from the z-axis direction, discharge hole 17*a* is formed to open into only the sector groove 17*d*. Discharge hole 17*a* communicates with the interior space of pump housing 1 via discharge port 17*b* (sector groove 17*d*).

Circular-arc shaped groove 17*c* of discharge port 17*b* is arranged to be symmetrical to the crescent-shaped inlet port 16*b* with respect to the center "O", and having almost the same shape as inlet port 16*b*, and arranged on the side of the positive x-axis direction with respect to pin insertion hole 12. Sector portion 17*d* is configured to be surrounded in three directions by a side 17*g* parallel to the y-axis and located on the side of the negative x-axis direction of sector portion 17*d*, a large circular arc 17*e* whose center is the geometric center "Q" of pin insertion hole 12 and which is located on the side of the positive y-axis direction of sector portion 17*d*, and a small circular arc 17*e* whose center is the geometric center "Q" of pin insertion hole 12 and which is located on the side of the negative y-axis direction of sector portion 17*d* in such a manner as to be opposed to large circular arc 17*e*. Sector groove 17*d* is opened in the positive x-axis direction so as to communicate circular-arc shaped groove 17*c*.

A substantially cylindrical support portion 12*a* is formed on the side of the negative y-axis direction of first swelling portion 1*b*. Pin insertion hole 12 is formed in support portion 12*a*. The geometric center "Q" of pin insertion hole 12 is located to be slightly offset from the x-axis in the positive y-axis direction by a predetermined distance. The outer periphery of support portion 12*a*, facing in the positive y-axis direction, is contoured to define the previously-noted small circular arc 17*f*. The outer periphery of support portion 12*a*, facing in the positive x-axis direction, is contoured to define a left-hand curved portion of circular-arc shaped groove 17*c* (a circumferentially-curved outside edged portion formed on the side of the negative x-axis direction of circular-arc shaped groove 17*c*).

The circumferential end "A" of circular-arc shaped inlet port 16*b*, facing in the counterclockwise direction and the circumferential end "D" of circular-arc shaped groove 17*c* of discharge port 17*b*, facing in the counterclockwise direction are point-symmetrical with respect to the center "O". In a similar manner, the circumferential end "B" of circular-arc shaped inlet port 16*b*, facing in the clockwise direction and the circumferential end "C" of circular-arc shaped groove 17*c* of discharge port 17*b*, facing in the clockwise direction are point-symmetrical with respect to the center "O". Therefore, the angle ∠AOC is nearly equal to the angle ∠BOD, that is, ∠AOC≈∠BOD. As a result of the tuned positions of two ports 16*b* and 17*b*, these two angles ∠AOC and ∠BOD may not be analogous to each other. As previously discussed, the geometric center "Q" of pin insertion hole 12 is located to be slightly offset from the x-axis in the positive y-axis direction by a predetermined distance, and thus the angle ∠DOQ is dimensioned to be greater than the angle ∠COQ, i.e., ∠DOQ>∠COQ.

Oil storage portion 18 is a substantially crescent-shaped groove formed in pump-housing basal portion 10 and having a predetermined depth and a predetermined width. Oil storage portion 18 is comprised of three oil storage portions 18*a*-18*c*. Oil storage portions 18*a*-18*c* formed in bottom face 10*a* of cylindrical portion 1*a* and arranged on the outer peripheral side of bearing bore 11 and on the inner peripheral side of each of inlet port 16*b* and discharge port 17*b*. The center common to oil storage portions 18*a*-18*c* is the center (or the origin) "O". Three oil storage portions 18*a*-18*c* are arranged to be circumferentially equidistant-spaced from each other so as to surround the center "O", i.e., the circumference of bearing bore 11. Oil storage portions 18*a* and 18*c* are laid out to be symmetrical to each other with respect to the x-axis, so as to be partly opposed to discharge port 17*b*. Oil storage portion 18*b* is laid out to be opposed to inlet port 16*b*. With rotor 4 installed in pump housing 1, as viewed from the z-axis direction, oil storage portions 18*a*-18*c* are configured to overlap with inner peripheral portion 41 of rotor 4.

Oil storage portions 18*a*-18*c* temporarily store working oil discharged from discharge port 17*b*, and deliver working oil via bearing lubrication oil groove 18*d* to bearing bore 11, and also deliver working oil to the sidewalls of rotor 4, facing apart from each other in the z-axis direction and to the sidewalls of each of vanes 6, facing apart from each other in the z-axis direction. This contributes to the enhanced lubricating performance of pump VP.

Bearing lubrication oil groove 18*d* is an oil supply groove formed in pump-housing basal portion 10 and having a predetermined depth. Bearing lubrication oil groove 18*d* is formed in bottom face 10*a* of cylindrical portion 1*a* in a manner so as to extend substantially midway between two oil storage portions 18*a* and 18*c*. Bearing lubrication oil groove 18*d* intercommunicates discharge port 17*b* and bearing bore 11. Concretely, bearing lubrication oil groove 18*d* is formed into a substantially doglegged shape (as viewed from the z-axis direction) in order to prevent the radially-slidable vane 6, rotating about the axis "O" (the rotation center of rotor 4), from dropping into bearing lubrication oil groove 18*d* when the radially-extending portion of bearing lubrication oil groove 18*d* becomes aligned with the radially-slidable vane 6, rotating about the axis "O". Bearing lubrication oil groove 18*d* is comprised of an oblique oil passage extending from discharge port 17*b* and oriented in a combined direction of the positive x-axis direction and the negative y-axis direction, and a radial oil passage extending in the positive x-axis direction from the substantially midpoint of two oil storage portions 18*a* and 18*c*, which are symmetrical with respect to the x-axis, and reaching bearing bore 11. Bearing lubrication oil groove 18*d* functions to feed working oil from each of discharge port 17*b* and oil storage portions 18*a* and 18*c* to bearing bore 11, thus ensuring the lubricating performance of drive shaft 3.

In the same manner as pump housing 1, main-body portion 20 and flanged portion 24, both constructing pump cover 2, are formed integral with each other, and made of aluminum alloy materials. As indicated by the broken line in FIG. 3, pump cover 2 has inlet port 22, discharge port 23 (sector groove 23*d*), and oil storage portions, all formed in bottom face 20*a* of pump-cover main-body portion 20, and configured to be substantially conformable to the respective shapes (the respective sizes and positions) of inlet port 16*b*, discharge port 17*b* (sector groove 17*d*), and oil storage portions 18*a*-18*c*, formed in bottom face 10*a* of pump-housing basal portion 10. Bottom face 20*a*, in sliding-contact with the end face of cam ring 5, facing in the positive z-axis direction, is more accurately machined in flatness and surface roughness.

(Construction of Pump Chamber)

Figure 5:
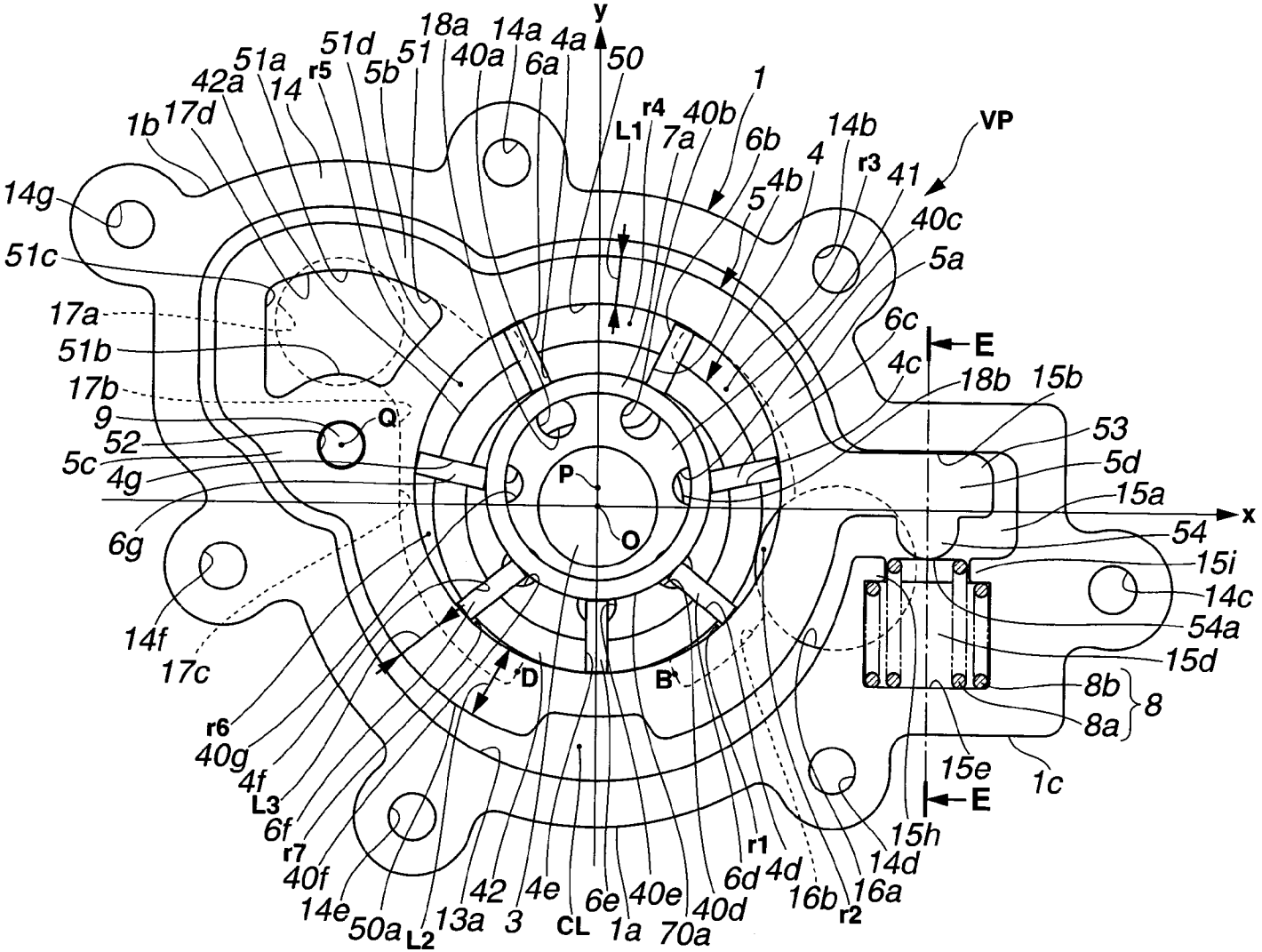
FIG. 5 is a front elevation view of the variable displacement vane pump of the first embodiment in an initial setting state.

FIG. 5 shows the front elevation view of pump VP whose pump cover is removed, as viewed from the positive z-axis direction. The positions of inlet hole 16*a*, inlet port 16*b*, discharge hole 17*a*, and discharge port 17*b* are indicated by the broken line in FIG. 5. FIG. 5 shows the initial setting state of cam ring 5, where the oscillated amount of cam ring 5 becomes zero, and thus the eccentricity of geometric center "P" of inner peripheral surface 50 of cam ring 5 with respect to the axis "O" of drive shaft 3 (or the rotation center of rotor 4), that is, the distance |OP| between the axis "O" and the geometric center "P", becomes maximum. The initial position (the spring-loaded position) of cam ring 5, held in the initial setting state, is hereinafter referred to as "initial setting position". The pump unit is constructed by pump housing 1, drive shaft 3, rotor 4, cam ring 5, inlet port 16*b*, discharge port 17*b*, and vanes 6*a*-6*g*. One pump working chamber is defined between two adjacent vanes 6. That is, seven pump chambers r1-r7 are defined as seven internal spaces partitioned in a fluid-tight fashion and surrounded by vanes 6*a*-6*g*, two opposed sidewalls (i.e., pump-cover bottom face 20*a* and pump-housing bottom face 10*a*), rotor outer peripheral surface 42*a*, cam-ring inner peripheral surface 50.

The geometric center "P" of cam-ring inner peripheral surface 50 is offset from the rotation center "O" of rotor 4 in the positive y-axis direction in the initial setting state of cam ring 5, shown in FIG. 5. Hence, pump chambers r1, r2, r3, and r4, defined on the side of the positive x-axis direction with respect to the center "O", are configured such that respective volumes of pump chambers r1, r2, r3, and r4 gradually increase, in that order, i.e., from the side of the negative y-axis direction to the side of the positive y-axis direction. In a similar manner, pump chambers r4, r5, r6, and r7, defined on the side of the negative x-axis direction with respect to the center "O", are configured such that respective volumes of pump chambers r4, r5, r6, and r7 gradually decrease, in that order, i.e., from the side of the positive y-axis direction to the side of the negative y-axis direction. As viewed from the positive z-axis direction in FIG. 5, drive shaft 3 rotates rotor 4 in the counterclockwise direction. In the initial setting state, due to counterclockwise rotation of rotor 4, the volume of each of pump chambers r1, r2, r3, and r4 tends to increase, while the volume of each of pump chambers r4, r5, r6, and r7 tends to decrease.

As viewed in the z-axis direction, the angle between the opposed faces of two adjacent vanes (6*a*-6*b*, 6*b*-6*c*, 6*c*-6*d*, 6*d*-6*e*, 6*e*-6*f*, 6*f*-6*g*) is dimensioned to be slightly less than the angle ∠AOC or the angle ∠BOD (see FIG. 4). In other words, the circumferential distance between the opposed faces of two adjacent vanes is dimensioned to be slightly less than the circumferential distance between circumferential end "A" of circular-arc shaped inlet port 16*b* and circumferential end "C" of circular-arc shaped groove 17*c* of discharge port 17*b* (or the circumferential distance between circumferential end "D" of circular-arc shaped groove 17*c* of discharge port 17*b* and circumferential end "B" of circular-arc shaped inlet port 16*b*). For instance, as can be appreciated from comparison of pump chamber r4 shown in FIG. 5 with the area defined between circumferential ends "A" and "C" shown in FIG. 4, each of pump chambers r1-r7 cannot overlap simultaneously with both of two opposed circumferential ends "A" and "C" (or both of two opposed circumferential ends "D" and "B"). Hence, there is no possibility that each of pump chambers r1-r7 is communicated simultaneously with both of inlet port 16*b* and discharge port 17*b*. Because of a very small offset between the axis "O" and the geometric center "P", each of pump chambers r1-r7 cannot be communicated simultaneously with both of inlet port 16*b* and discharge port 17*b*, regardless of the oscillated amount of cam ring 5, in other words, regardless of the maximum eccentricity (the initial setting position) or minimum eccentricity of cam ring 5.

Pump chambers r1, r2, and r3 (further including pump chamber r4 just before rotor 4 reaches the angular position shown in FIG. 5), defined on the side of the positive x-axis direction, are configured or defined to overlap with inlet port 16*b* as viewed from the z-axis direction, so as to communicate inlet port 16*b*. In other words, inlet port 16*b* is configured to formed in bottom face 10*a* of pump housing 1 and configured to open into pump chambers r1-r3 (or r1-r4) in such a manner as to extend over pump chambers r1-r3 (or r1-r4) within the area where the volumes of these pump chambers tend to gradually increase depending on rotary motion (counterclockwise rotation) of rotor 4. On the other hand, pump chambers r5, r6, and r7 (further including pump chamber r4 just after rotor 4 has reached the angular position shown in FIG. 5), defined on the side of the negative x-axis direction, are configured or defined to overlap with discharge port 17*b* as viewed from the z-axis direction, so as to communicate discharge port 17*b*. In other words, discharge port 17*b* is formed in pump-housing bottom face 10*a* and configured to open into pump chambers r5-r7 (or r4-r7) in such a manner as to extend over pump chambers r5-r7 (or r4-r7) within the area where the volumes of these pump chambers tend to gradually decrease depending on rotary motion (counterclockwise rotation) of rotor 4.

For the reasons discussed above, pump chambers r1-r3 (or r1-r4), defined on the side of the positive x-axis direction with respect to the rotation center "O" of rotor 4, are operating on the suction stroke (intake stroke), during counterclockwise rotation of rotor 4. On the other hand, pump chambers r5-r7 (or r4-r7), defined on the side of the negative x-axis direction with respect to the rotation center "O" of rotor 4, are operating on the discharge stroke, during counterclockwise rotation of rotor 4.

Working oil, discharged from discharge port 17*b*, is introduced into back-pressure chambers 40*a*-40*g* of rotor 4, thereby forcing each of vanes 6*a*-6*g* radially outwards. Additionally, during rotation of rotor 4, vanes 6*a*-6*g* themselves are forced radially outwards due to centrifugal force. Hence, during operation of the engine, the tip of each of vanes 6*a*-6*g* is brought into abutted-engagement (or sliding-contact) with inner peripheral surface 50 of cam ring 5. In the engine stopped state where there is no rotation of pump VP, vane rings 7*a*-7*b* support vanes 6*a*-6*g* so as to force them radially outwards. By virtue of the supporting action of vane rings 7*a*-7*b*, even during the early stages of engine starting, it is possible to rapidly ensure a fluid-tight performance of each of pump chambers r1-r7, thus enhancing a responsiveness of pump discharge pressure (a rapid discharge pressure rise). Additionally, by virtue of the supporting action of vane rings 7*a*-7*b*, it is possible to suppress vanes 6*a*-6*g* from being brought into collision-contact with cam-ring inner peripheral surface 50 owing to radially-outward movements of vanes 6*a*-6*g* out of respective slits 4*a*-4*g*, even when pump VP begins to rotate.

A proper clearance space CL is defined between an outer peripheral surface 50*a* of cam ring 5 and inner peripheral surface 13*a* of pump-housing peripheral wall 13, so as to permit oscillating motion of cam ring 5. Cam-ring outer peripheral surface 50*a* is kept out of contact with pump-housing inner peripheral surface 13*a*, except for arm portion 5*d*. For the reasons discussed later, notice that, in the variable displacement vane pump VP of the shown embodiment, any seal member is not installed in clearance space CL. Thus, clearance space CL is not partitioned with any seal member. Clearance space CL communicates with the oil pan via inlet hole 16*a*. Hence, a pressure in clearance space CL around the entire circumference of cam-ring outer peripheral surface 50*a* (i.e., a pressure applied to the outer periphery of cam ring 5) becomes atmospheric pressure. For this reason, during operation of pump VP, the pressure in clearance space CL becomes less than a discharge pressure (denoted by "Pd") of working oil discharged from discharge port 17*b*.

As set forth above, there is a less pressure difference between the pressure (i.e., atmospheric pressure) outside of pump housing 1 and the pressure in clearance space CL, and thus it is unnecessary to interleave a seal member (a gasket usually used to enhance a fluid-tight performance of pump VP) between pump-housing flanged portion 14 and pump-cover flanged portion 24. Additionally, the same pressure (atmospheric pressure) is applied around the entire circumference of cam-ring outer peripheral surface 50*a*. That is, the external pressure, acting on the outer periphery of cam ring 5 in the direction perpendicular to the axis "O" of drive shaft 3, becomes approximately uniform. Because of the approximately uniform outside pressure acting on the cam-ring outer periphery, there is no occurrence of oscillating motion of cam ring 5, resulting from the external pressure. Therefore, a force, which creates an oscillating motion (an angular displacement or a pivotal motion) of cam ring 5 about the pivot (pivot pin 9), can be stably applied to cam ring 5 via cam-ring inner peripheral surface 50.

(Construction of Cam Ring)

The axial width of cam ring 5 (i.e., the length of cam ring 5 in the z-axis direction) is the same around the entire circumference. The radial width of cam-ring cylindrical portion 5*a* partly differs. That is, the radial wall thickness of the lower half of cylindrical portion 5*a* (on the side of the negative y-axis direction with respect to geometric center "P" of cam-ring inner peripheral surface 50) is dimensioned to be greater than that of the upper half of cylindrical portion 5*a* (on the side of the positive y-axis direction with respect to geometric center "P"). Concretely, a radial width (a radial wall thickness) L2 of the lower half of cylindrical portion 5*a* (in particular, a part of the lower half of cylindrical portion 5*a* overlapping with inlet port 16*b* and discharge port 17*b* on the side of the negative y-axis direction with respect to geometric center "P" of cam-ring inner peripheral surface 50) is dimensioned to be greater than a radial width (a radial wall thickness) L1 of the upper half of cylindrical portion 5*a* (on the side of the positive y-axis direction with respect to geometric center "P").

That is, as viewed from the z-axis direction, a part of cylindrical portion 5*a*, overlapping with inlet port 16*b* and discharge port 17*b*, on the side of the negative y-axis direction with respect to geometric center "P", is formed to be comparatively thick-walled, but the radial width (the radial wall thickness) of the intermediate part of cam-ring cylindrical portion 5*a* of the lower half, interconnecting the inlet-port side thick-walled part and the discharge-port side thick-walled part, is dimensioned to be identical to the radial width L1 (<L2) of the upper half of cylindrical portion 5*a*. That is, the intermediate part is formed as a recessed portion sandwiched between these thick-walled parts. The angle between the line segment between and including center "O" and the clockwise end of the recessed intermediate part and the line segment between and including center "O" and the counterclockwise end of the recessed intermediate part is dimensioned to be less than the previously-described angle ∠BOD. In other words, as seen in FIG. 5, the thick-walled part of the side of inlet port 16*b* is configured to somewhat extend clockwise by a predetermined distance from the circumferential end "B" of inlet port 16*b*. In a similar manner, the thick-walled part of the side of discharge port 17*b* is configured to somewhat extend counterclockwise by a predetermined distance from the circumferential end "D" of discharge port 17*b*.

In the initial setting position of cam ring 5, shown in FIG. 5, a proper radial width (a proper radial distance) L3 between outer peripheral surface 50*a* of cam ring 5 and the circumferentially-extending outside edged portion of each of inlet port 16*b* and discharge port 17*b* can be ensured in a manner so as to be substantially equal to the radial width L1, around the entire circumference of cam ring 5. For instance, regarding the left-hand side (on the side of discharge port 17*b*) thick-walled portion and the right-hand side (on the side of inlet port 16*b*) thick-walled portion, a radial width (a radial distance) L3 between cam-ring outer peripheral surface 50*a* and the circumferentially-extending outside edged portion of each of inlet port 16*b* and discharge port 17*b* is dimensioned to be substantially equal to the radial width L1, i.e., L3≈L1. Also, regarding the previously-discussed recessed intermediate part of the cam-ring lower half, a distance from cam-ring outer peripheral surface 50*a* to the circumferentially-extending outside edged portion (or the circumferential end "B", "D") of each of inlet port 16*b* and discharge port 17*b* is dimensioned to be greater than or equal to the radial width L1.

Pivot portion 5*c* is arranged on the outer periphery of cylindrical portion 5*a* (on the side of the negative x-axis direction of cylindrical portion 5*a*) in such a manner as to be slightly offset from the x-axis in the positive y-axis direction. Pivot portion 5*c* has a small annular shape in lateral cross section and has pivot bore 52 formed at its center (identical to geometric center "Q" of pin insertion hole 12). The outer periphery of pivot portion 5*c*, facing in the positive y-axis direction, is contoured or formed as a small circular arc 51*b* whose center is the geometric center "Q" of pivot bore 52. As viewed from the z-axis direction, the small circular-arc shaped outer periphery of pivot portion 5*c* is contoured to be substantially conformable to the shape of the outer periphery of support portion 12*a* of pump housing 1, facing in the positive y-axis direction.

Sector portion 5*b* is arranged on the side of the positive y-axis direction of pivot portion 5*c*. Communication hole 51, formed to penetrate sector portion 5*b*, is contoured or configured to be substantially conformable to the shape of sector groove 17*d* of discharge port 17*b*. As viewed from the z-axis direction, the cross section of communication hole 51 is set to be greater than or equal to the cross section of discharge hole 17*a*. Communication hole 51 is configured to be surrounded in all directions by a large circular arc 51*a* whose center is the geometric center "Q" of pivot bore 52, a small circular arc 51*b* whose center is the geometric center "Q", a side 51*c* substantially parallel to the y-axis, and a circular arc 51*d* constructing a part of the outer peripheral surface of cam-ring cylindrical portion 5*a*. Large circular arc 51*a* is located on the side of the positive y-axis direction of communication hole 51, whereas small circular arc 51*b* is located on the side of the negative y-axis direction of communication hole 51 so as to be opposed to large circular arc 51*a*. The side 51*c* is located on the side of the negative x-axis direction of communication hole 51, whereas circular arc 51*d* is located on the side of the positive x-axis direction of communication hole 51.

As viewed from the z-axis direction, small circular arc 51*b* is configured to be conformable to small circular arc 17*f* of sector groove 17*d* of discharge port 17*b*. Large circular arc 51*a* is configured to be conformable to large circular arc 17*e* of discharge-port sector groove 17*d*. In the initial setting position of cam ring 5, the side 51*c* is configured to be conformable to the side 17*g* of sector groove 17*d*.

When cam ring 5 oscillates or displaces clockwise from the initial setting position of FIG. 5, sector portion 5*b* also rotates clockwise about pivot bore 52. At this time, large circular arc 51*a* of communication hole 51 relatively moves on large circular arc 17*e* of sector groove 17*d*, such that the locus of motion of large circular arc 51*a* traces large circular arc 17*e* as viewed from the z-axis direction. In a similar manner, small circular arc 51*b* of communication hole 51 relatively moves on small circular arc 17*f* of sector groove 17*d*, such that the locus of motion of small circular arc 51*b* traces small circular arc 17*f* as viewed from the z-axis direction. The side 51*c* of communication hole 51 moves apart from the side 17*g* of sector groove 17*d* and rotates clockwise about pivot bore 52. As viewed from the z-axis direction, the side 51*c* is configured to be kept in a slightly-counterclockwise-spaced, contact-free relationship with the circumference of discharge hole 17*a* or kept at the very limit of contact with the circumference of discharge hole 17*a*, even when the oscillated amount of cam ring 5 becomes maximum, that is, even with cam ring 5 just displaced to the minimum-eccentricity position shown in FIG. 11. In other words, the side 51*c* of communication hole 51 and discharge hole 17*a* cannot be overlapped with each other, regardless of the oscillated amount of cam ring 5, that is, regardless of the maximum eccentricity (see the initial setting position (the spring-offset position) of cam ring 5 shown in FIG. 5) or the minimum eccentricity (see the FIG. 11).

In an assembled state of cam ring 5 installed in pump housing 1, communication hole 51 of cam ring 5 serves to intercommunicate discharge port 17*b* (sector groove 17*d*) of pump housing 1 and discharge port 23 (sector groove 23*d*) of pump cover 2. During operation of pump VP, most of high-pressure working fluid (high-pressure working oil), which is supplied from pump chambers r5-r7 (or pump chambers r4-r7) to discharge port 23 of pump cover 2, is discharged from discharge hole 17*a* via communication hole 51.

Now, assume that only a pump-housing discharge port, such as discharge port 17*b*, is provided. In such a case, the fluid pressure in discharge port 17*b* acts on cam ring 5 in the positive z-axis direction. In such a case, the fluid pressure forces cam ring 5 toward pump cover 2, and thus the frictional force created between cam ring 5 and pump cover 2 becomes great. This means an undesirably large force for oscillating motion of cam ring 5, i.e., an undesirably large energy loss. To avoid this, a pump-cover discharge port, such as discharge port 23, is further provided in order for the fluid pressure in discharge port 23 to act on cam ring 5 in the negative z-axis direction, thereby enabling cam ring 5 to be forced apart from pump cover 2.

However, in the first embodiment, discharge hole 17*a* is laid out outside of cam-ring cylindrical portion 5*a* rather than inside of cam-ring inner peripheral surface 50 (i.e., the side of the defined pump chambers) and formed in bottom face 10*a* (sector groove 17*d*) of pump housing 1. On the other hand, there are no discharge holes formed in pump cover 2. Therefore, assuming that communication hole 51 is not formed in cam ring 5, there is an increased tendency for working oil to stay in discharge port 23 of pump cover 2, and thus there is a risk of contaminant and debris accumulated in pump-cover discharge port 23. Generally, the fluid pressure applied from the side of pump-cover discharge port 23 to cam ring 5, tends to be slightly greater than the fluid pressure applied from the side of pump-housing discharge port 17*b* to cam ring 5. Due to the applied fluid-pressure difference, cam ring 5 tends to be forced toward pump housing 1, and thus the frictional force created between cam ring 5 and pump housing 1 tends to become great. This means an undesirably large force required for oscillating motion of cam ring 5, i.e., an undesirably large energy loss.

In the first embodiment, pump housing 1 and pump cover 2 have respective discharge ports 17*b* and 23, and cam ring 5 has communication hole 51 through which discharge port 17*b* (sector groove 17*d*) of pump housing 1 and discharge port 23 (sector groove 23*d*) of pump cover 2 are communicated with each other. Hence, working oil in discharge port 23 (sector groove 23*d*) of pump cover 2 can flow via communication hole 51 into discharge port 17*b* (sector groove 17*d*) of pump housing 1, and then the working fluid introduced into discharge port 17*b* can be discharged from discharge hole 17*a*.

Therefore, in the case of the variable displacement vane pump unit of the first embodiment having the specific discharge-hole layout that discharge hole 17*a* is laid out outside of cam-ring cylindrical portion 5*a* rather than inside of cam-ring inner peripheral surface 50 and formed in bottom face 10*a* (sector groove 17*d*) of pump housing 1, it is possible to increase the number of working-oil passages communicating with discharge hole 17*a*, as compared to a typical vane pump unit that any cam-ring communication hole is not formed, thereby increasing a discharge of working oil from pump VP (i.e., a fluid flow rate per one revolution of vane-pump rotor 4), in other words, a pump discharging effect. Additionally, there is a less risk of contaminant and debris accumulated in pump-cover discharge port 23. The fluid pressure applied from the side of pump-housing discharge port 17*b* to cam ring 5 and the fluid pressure applied from the side of pump-cover discharge port 23 to cam ring 5 are almost balanced with each other, and thus it is possible to hold cam ring 5 substantially at an intermediate position between pump housing 1 and pump cover 2 in the z-axis direction. Hence, it is possible to reduce or minimize the magnitude of frictional force created between cam ring 5 and each of pump housing 1 and pump cover 2, thereby effectively reducing a force required for oscillating motion of cam ring 5.

In the shown embodiment, the fluid-flow passage area of communication hole 51 is dimensioned or set to be greater than or equal to that of discharge hole 17*a*, and thus it is possible to reduce the flow resistance to working-oil flow, caused by communication hole 51. Communication hole 51 cannot serve as a fluid-flow constriction orifice, and thus it is possible to increase the amount of working oil discharged through communication hole 51 as much as possible, thereby ensuring the increased pump discharging effect. Furthermore, it is possible to bring the fluid pressure applied from the side of pump-cover discharge port 23 to cam ring 5 closer to the fluid pressure applied from the side of pump-housing discharge port 17*b* to cam ring 5.

As set forth above, communication hole 51 of cam ring 5 is contoured or configured to be substantially conformable to both the shape of sector groove 17*d* of pump housing 1 and the shape of sector groove 23*d* of pump cover 2. Communication hole 51 is formed into a circular-arc shape (or a sector form) whose center is the geometric center "Q" of pivot bore 52 (i.e., the fulcrum "Q" of oscillating motion of cam ring 5). Hence, even when cam ring 5 is pivoting about the fulcrum "Q", there is a less change in the overlapping area between pump-housing sector groove 17*d* (pump-cover sector groove 23*d*) and communication hole 51, in other words, there is a less change in flow passage cross-sectional area of the working-oil flow passage oriented from pump-cover discharge port 23 (sector groove 23*d*) toward pump-housing discharge port 17*b*. In this manner, even when cam ring 5 is oscillating, pump-housing sector groove 17*d* and pump-cover sector groove 23*d* are permanently communicated with each other via communication hole 51, without any rapid change in the fluid-flow passage area of cam-ring communication hole 51. Accordingly, it is possible to stably provide the advantageous operation and effects as described previously.

Moreover, as set forth above, the side 51*c* of communication hole 51 is kept outside of discharge hole 17*a* or kept at the very limit of contact with the circumference of discharge hole 17*a* but not overlap with discharge hole 17*a*, during oscillating motion of cam ring 5. Thus, there is no change in the opening area of communication hole 51 opening into discharge hole 17*a*, that is, there is no change in fluid-flow passage cross-sectional area of the working-fluid flow passage oriented from pump-cover discharge port 23 (sector groove 23*d*) toward pump-housing discharge hole 17*a*. Hence, there is a less change in the fluid pressure applied from the side of pump-cover discharge port 23 to cam ring 5. Hence, it is possible to stably provide the advantageous operation and effects as described previously.

Cam-ring arm portion 5*d* is formed of a substantially rectangular support portion 53 overhanging from cam-ring cylindrical portion 5*a* in the positive x-axis direction and a protruding portion 54 having a substantially semicircular cross section and extending downwards from the underside of support portion 53, facing in the negative y-axis direction. In the initial setting state of cam ring 5, shown in FIG. 5, the upside of support portion 53, facing in the positive y-axis direction, is kept in wall-contact with seat surface 15*b* (of arm-portion accommodating chamber 15*a*) on which arm portion 5*d* of cam ring 5 is seated.

The surface 54*a* of protruding portion 54 is formed as a curved surface. As viewed from the z-axis direction, protruding portion 54 is formed into a semicircle in cross section. In the initial setting state shown in FIG. 5, the lowermost end of protruding portion 54, facing in the negative y-axis direction, is laid out substantially at the same level as shoulder portions 15*h*-15*i* of spring chamber 15*d*. As viewed in the x-axis direction, the center of the lowermost end (viewing FIG. 5) of protruding portion 54 is aligned with the neutral axis of spring chamber 15*d*. The maximum width of protruding portion 54, measured in the x-axis direction, is dimensioned to be less than the maximum width of the opening of spring chamber 15*d*, measured in the x-axis direction, in other words, the distance between the opposed shoulder portions 15*h*-15*i*.

(Construction of Biasing Member)

Figure 6:
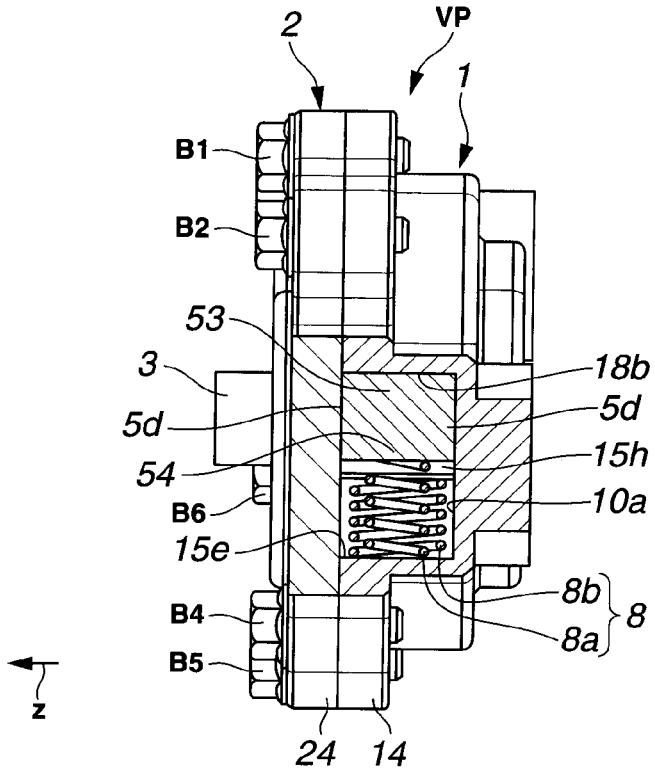
FIG. 6 is a cross section of the vane pump, taken along the line E-E of FIG. 5.

Biasing member 8 has a double spring structure, in which a first coil spring 8*a* is coaxially installed inside of a second coil spring 8*b*. FIG. 6 shows the cross section of pump VP whose pump cover is installed, taken along the line E-E of FIG. 5. First coil spring 8*a* is installed inside of second coil spring 8*b*, such that the coiled directions (or winding directions) of first and second coil springs 8*a*-8*b* are opposite to each other.

The coil outside diameter of first coil spring 8*a* is dimensioned to be less than the maximum width of the opening of spring chamber 15*d*, measured in the x-axis direction, in other words, the distance between the opposed shoulder portions 15*h*-15*i*, and also dimensioned to be substantially equal to the width of protruding portion 54, measured in the x-axis direction. The coil outside diameter of second coil spring 8*b* is dimensioned to be substantially equal to the width of spring chamber 15*d*, measured in the x-axis direction (see FIG. 5), and also dimensioned to be less than the length of protruding portion 54 (or the length of each of shoulder portions 15*h*-15*i* of spring chamber 15*d*), measured in the z-axis direction. The lower coil end of each of first and second coil springs 8*a*-8*b*, facing in the negative y-axis direction is seated on the bottom face 15*e* of spring chamber 15*d*. The diametrically-opposing coil-end portions (opposed to each other in the z-axis direction) of the upper coil end of first coil spring 8*a*, facing in the positive y-axis direction, are kept in abutted-engagement with the lowermost end of protruding portion 54, facing in the negative y-axis direction, without engagement between first coil spring 8*a* and shoulder portions 15*h*-15*i*. First coil spring 8*a* is installed in spring chamber 15*d* and disposed between pump housing 1 (i.e., spring-chamber bottom face 15*e*) and cam-ring arm portion 5*d* (i.e., protruding portion 54) under a preloaded condition where first coil spring 8*a* is preloaded by an initial set load W1.

On the other hand, the upper coil end of second coil spring 8*b*, facing in the positive y-axis direction, is engaged with shoulder portions 15*h*-15*i*. The diametrically-opposing coil-end portions (opposed to each other in the x-axis direction) of the upper coil end of second coil spring 8*b*, facing in the positive y-axis direction, are kept in abutted-engagement with the respective undersides of shoulder portions 15*h*-15*i*, facing in the negative y-axis direction. Second coil spring 8*b* is installed in spring chamber 15*d* and disposed between pump housing 1 (i.e., spring-chamber bottom face 15*e*) and the shoulder pair 15*h*-15*i* under a preloaded condition where second coil spring 8*b* is preloaded by an initial set load W3.

(Operation Carried Out By Layout of Fulcrum of Oscillating Motion of Cam Ring)

Hereinafter described is the operation, carried out by a specific layout of the fulcrum of oscillating motion of cam ring 5. As discussed above, the fulcrum of cam ring 5 is the geometric center "Q" of pin insertion hole 12 (in other words, the geometric center "Q" of pivot bore 52 or the geometric center "Q" of pivot pin 9). The fulcrum "Q" of cam ring 5 is laid out to be offset in the biasing direction of biasing member 8 (i.e., in the positive y-axis direction) within an opening range of discharge port 17*b*. That is, the fulcrum "Q" of cam ring 5 is laid out to be offset in the biasing direction of biasing member 8 (i.e., in the positive y-axis direction) with respect to a midpoint (a center position) of the opening range of discharge port 17*b*. In other words, pivot bore 52 formed in cam ring 5, is laid out or configured, such that an area of cam-ring inner peripheral surface 50, on which the fluid pressure in discharge port 17*b* acts during operation of pump VP and which is segmented as a second pressure-receiving area S2 (described later in detail in reference to the chart of FIG. 9) extending in the positive y-axis direction (in the biasing direction of biasing member 8) with respect to the fulcrum "Q" of oscillating motion of cam ring 5 is permanently (always) smaller than an area of cam-ring inner peripheral surface 50, on which the fluid pressure in discharge port 17*b* acts during operation of pump VP and which is segmented as a first pressure-receiving area S1 (described later in detail in reference to the chart of FIG. 9) extending in the negative y-axis direction (in the direction opposite to the biasing direction of biasing member 8) with respect to the fulcrum "Q". The details of the specific layout of the fulcrum "Q" of oscillating motion of cam ring 5 are described hereunder.

Figure 7:
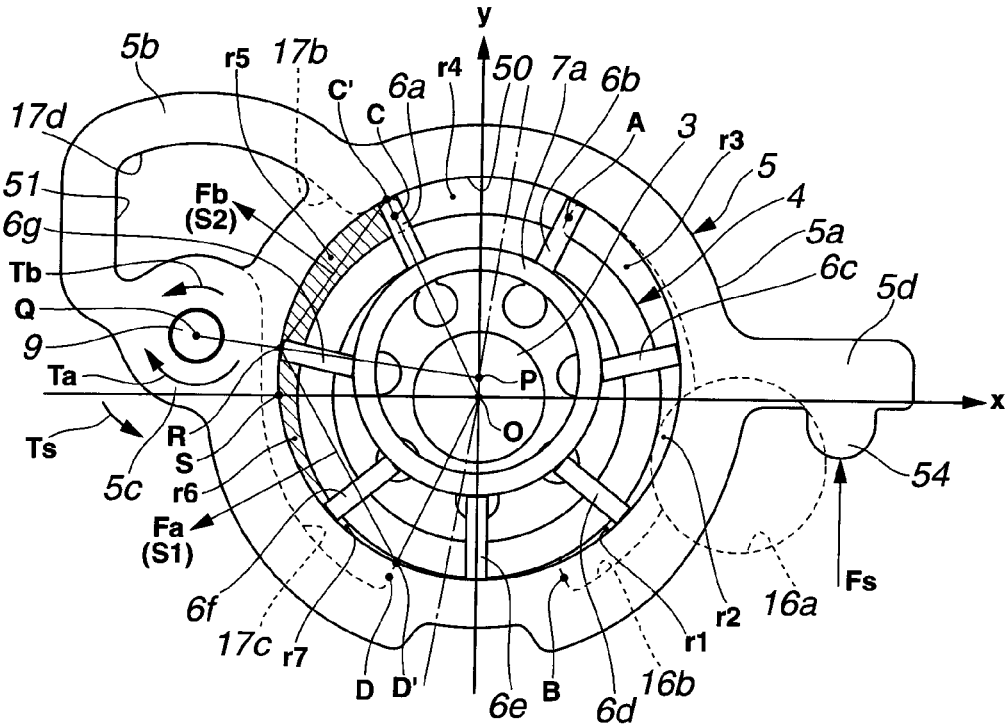
FIG. 7 is an explanatory view illustrating the initial setting position (the maximum-eccentricity angular position) of the cam ring of the variable displacement vane pump of the first embodiment.
Figure 8:
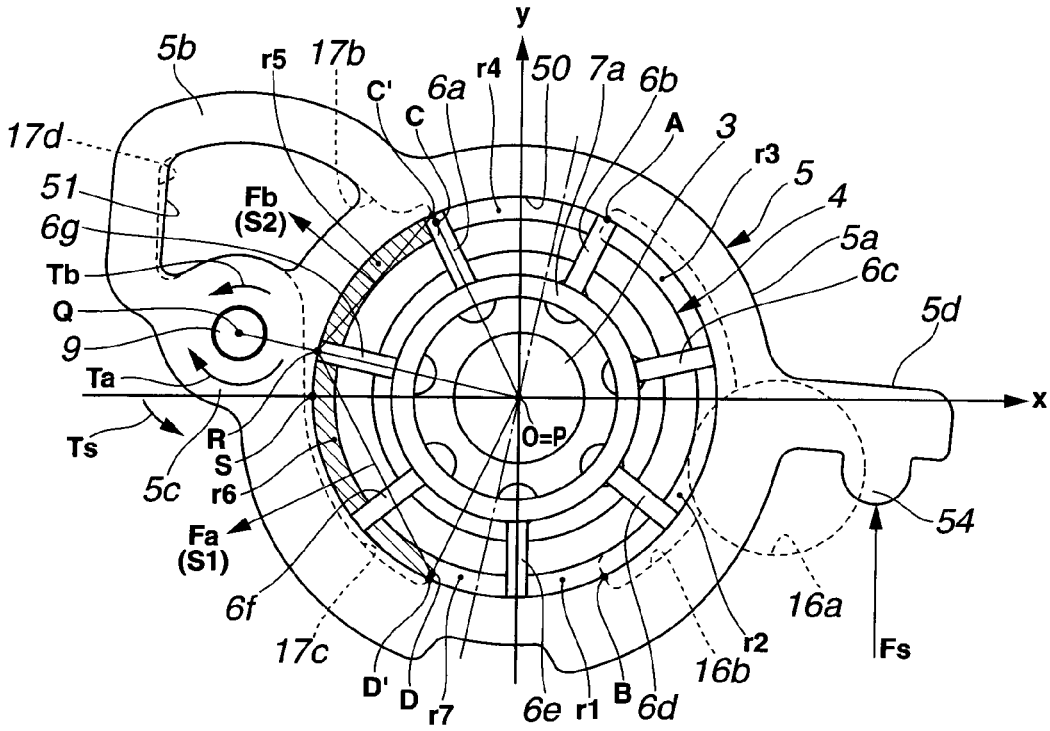
FIG. 8 is an explanatory view illustrating the minimum-eccentricity angular position of the cam ring of the variable displacement vane pump of the first embodiment.

FIGS. 7-8 are the partial views (component parts shown in FIG. 5 are partly omitted), for explaining two different angular positions of oscillating or rotating motion of cam ring 5 relative to pump housing 1. FIG. 7 shows the initial setting state (the maximum-eccentricity state) where the degree of oscillating or rotating motion of cam ring 5 relative to pump housing 1 is minimum, whereas FIG. 8 is the minimum-eccentricity state where the degree of oscillating or rotating motion of cam ring 5 relative to pump housing 1 is maximum.

As viewed from the z-axis direction, the point that the outside edged portion of circular-arc shaped groove 17*c* of discharge port 17*b* intersects (overlaps) with cam-ring inner peripheral surface 50 at the circumferential end "C" of discharge-port circular-arc shaped groove 17*c*, facing in the positive y-axis direction, is defined as a point "C'". The point that the outside edged portion of discharge-port circular-arc shaped groove 17*c* intersects (overlaps) with cam-ring inner peripheral surface 50 at the circumferential end "D" of discharge-port circular-arc shaped groove 17*c*, facing in the negative y-axis direction, is defined as a point "D'". Additionally, as viewed from the z-axis direction, the point that the straight line segment PQ, which links the fulcrum "Q" of oscillating motion of cam ring 5 and the geometric center "P" of cam-ring inner peripheral surface 50, intersects with cam-ring inner peripheral surface 50 on the side of discharge port 17*b*, is defined as an intersection point "R". As viewed from the z-axis direction, the circular-arc segment C'RD' of cam-ring inner peripheral surface 50 is laid out to overlap with discharge-port circular-arc shaped groove 17*c*.

As can be seen from the two explanatory views of FIGS. 7-8, the positional relationship between the fulcrum "Q" of oscillating motion of cam ring 5 and the position of formation of discharge port 17*b* is predetermined, such that the arc length of the circular-arc segment C'R (extending in the positive y-axis direction with respect to the fulcrum "Q") is less than the arc length of the circular-arc segment RD' (extending in the negative y-axis direction with respect to the fulcrum "Q"), regardless of the presence or absence of oscillating motion of cam ring 5. That is, assuming that the midpoint of the circular-arc segment C'RD' is defined as a point "S", the intersection point "R" is laid out to be offset from the midpoint "S" in the positive y-axis direction (that is, in the direction r7→r6→r5 in which respective volumes of pump chambers r7, r6, and r5 gradually increase, in that order), over the entire range of oscillating motion of cam ring 5. In other words, the intersection point "R" is laid out to be offset from the midpoint "S" in the maximum-eccentricity direction, that is, in the direction that the geometric center "P" of cam-ring inner peripheral surface 50 displaces from the axis "O" of drive shaft 3 (i.e., the rotation center "O" of vane rotor 4).

The fluid pressure (discharge pressure Pd of a high pressure level) in discharge port 17*b* acts on the circular-arc segment C'RD' of cam-ring inner peripheral surface 50 (the inner peripheral surface on which vanes 6*a*-6*g* slide), which segment C'RD' overlaps with discharge port 17*b*. As discussed above, in the variable displacement vane pump construction of the first embodiment, there is a difference between the second segmented pressure-receiving area (i.e., the circular-arc segment C'R of cam-ring inner peripheral surface 50) extending in the positive y-axis direction with respect to the intersection point "R" (serving as a boundary point or a reference point) and the first segmented pressure-receiving area (i.e., the circular-arc segment RD' of cam-ring inner peripheral surface 50) extending in the negative y-axis direction with respect to the intersection point "R". Due to the aforementioned difference between the first and second segmented pressure-receiving areas, created by the specific layout of the fulcrum "Q" of oscillating motion of cam ring 5, it is possible to produce a moment by which cam ring 5 can be rotated or oscillated about the fulcrum "Q" against the spring bias of biasing member 8.

In the explanatory views of FIGS. 7-8, a vector Fa denotes a force produced by discharge pressure Pd received by cam-ring inner peripheral surface 50, ranging from the intersection point "R" to the circumferential end "D" of discharge-port circular-arc shaped groove 17*c*. On the other hand, a vector Fb denotes a force produced by discharge pressure Pd received by cam-ring inner peripheral surface 50, ranging from the intersection point "R" to the circumferential end "C" of discharge-port circular-arc shaped groove 17*c*. As a result of force Fa, a clockwise moment Ta of that force Fa about the fulcrum "Q" of oscillating motion of cam ring 5 is produced. As a result of force Fb, a counterclockwise moment Tb of that force Fb about the fulcrum "Q" of oscillating motion of cam ring 5 is produced.

In both the maximum-eccentricity state (the initial setting state) shown in FIG. 7 and the minimum-eccentricity state (the zero-eccentricity state) shown in FIG. 8, the arc length of circular-arc segment RD' of cam-ring inner peripheral surface 50 is longer than that of circular-arc segment C'R. Hence, the force Fa becomes greater than the force Fb, and thus the magnitude of moment Ta becomes greater than that of moment "Tb", i.e., Ta>Tb. In other words, due to the difference between two forces Fa and Fb of different magnitude and opposite sense (i.e., the difference between two moments Ta and Tb of different magnitude and opposite rotation direction), the moment of force about the fulcrum "Q" of oscillating motion of cam ring 5 and having the magnitude (Ta−Tb) and clockwise rotation direction is produced totally, so as to reduce the eccentricity |OP| of geometric center "P" of cam-ring inner peripheral surface 50 with respect to the axis "O" of drive shaft 3 (or the rotation center of vane rotor 4).

Such a moment Ta−Tb, resulting from discharge pressure Pd acting on cam-ring inner peripheral surface 50, is created by the offset layout of the intersection point "R" with respect to the midpoint "S". That is, the moment Ta−Tb is created by the specific cam-ring oscillating-motion fulcrum layout that the intersection point "R" is laid out to be offset from the midpoint "S" in the direction (i.e., in the positive y-axis direction) that the eccentricity |OP| of geometric center "P" with respect to the axis "O" increases. In other words, the moment Ta−Tb is created by the specific cam-ring oscillating-motion fulcrum layout that the fulcrum "Q" of oscillating motion of cam ring 5 is offset from the midpoint "S" in the biasing direction (i.e., in the positive y-axis direction) of biasing member 8.

The position of midpoint "S" of the circular-arc segment C'RD' is determined by the layout of cam ring 5 relative to discharge port 17*b*. In the shown embodiment, the radial width of discharge port 17*b* (circular-arc shaped groove 17*c*), the inside diameter of cam-ring inner peripheral surface 50, and the layout of cam ring 5 relative to discharge port 17*b* (circular-arc shaped groove 17*c*) are set, dimensioned, and configured, such that, as viewed from the z-axis direction, there is a less change of the overlapping area that cam-ring inner peripheral surface 50 overlaps with both discharge port 17*b* (circular-arc shaped groove 17*c*) and inlet port 16*b*, during oscillating motion of cam ring 5.

In other words, cam-ring inner peripheral surface 50 is laid out or configured so as to be able to oscillate within the designated area that the overlapping of cam-ring inner peripheral surface 50 with both the circumferential ends "C" and "D" of discharge-port circular-arc shaped groove 17*c* is permitted during oscillating motion of cam ring 5. That is, during oscillating motion of cam ring 5, the point "C'" merely moves on the circumferential end "C", while the point "D'" merely moves on the circumferential end "D". During oscillating motion of cam ring 5, there is a less change in the position of each of points "C'" and "D'", and thus there is a less change in the position of the midpoint "S" of circular-arc segment C'RD'. In other words, a change in the position of midpoint "S", occurring during oscillating motion of cam ring 5, is a negligibly small change by which the length of circular-arc segment SR is unaffected.

Therefore, the position of the midpoint "S" on cam-ring inner peripheral surface 50 can be approximated to the position of the circumferential midpoint of discharge port 17*b* (circular-arc shaped groove 17*c*). That is to say, it will be understood that the fulcrum "Q" of oscillating motion of cam ring 5 is laid out to be offset in the biasing direction of biasing member 8 with respect to the midpoint of discharge port 17*b* (circular-arc shaped groove 17*c*), thereby creating the previously-discussed moment Ta−Tb.

On the assumption that vanes 6*a*-6*g* are positioned at their positions as shown in FIGS. 7-8, the aforementioned moment Ta−Tb, created by the fluid pressure (discharge pressure Pd) received by a specific portion (circular-arc segment C'RD') of cam-ring inner peripheral surface 50 that overlaps with the opening range of discharge port 17*b* (circular-arc shaped groove 17*c*), has been explained previously. This is because the actual difference between the first and second segmented pressure-receiving areas can be sufficiently approximated to the difference between the arc lengths of circular-arc segments C'R and RD' of cam-ring inner peripheral surface 50. However, actually, regarding pump chamber r7, discharge pressure Pd in discharge port 17*b* is also applied to a slight area of pump chamber r7, ranging from a portion of cam-ring inner peripheral surface 50 (with which the tip of vane 6*e* abuts) to the point "D'". Furthermore, assuming that vane rotor 4 slightly rotates counterclockwise from the angular position of vane rotor 4 as shown in FIGS. 7-8, and pump chamber r4 is communicated with discharge port 17*b*, discharge pressure Pd in discharge port 17*b* is also applied to a slight area of pump chamber r4, ranging from a portion of cam-ring inner peripheral surface 50 (with which the tip of vane 6*b* abuts) to the point "C'".

Figure 9:
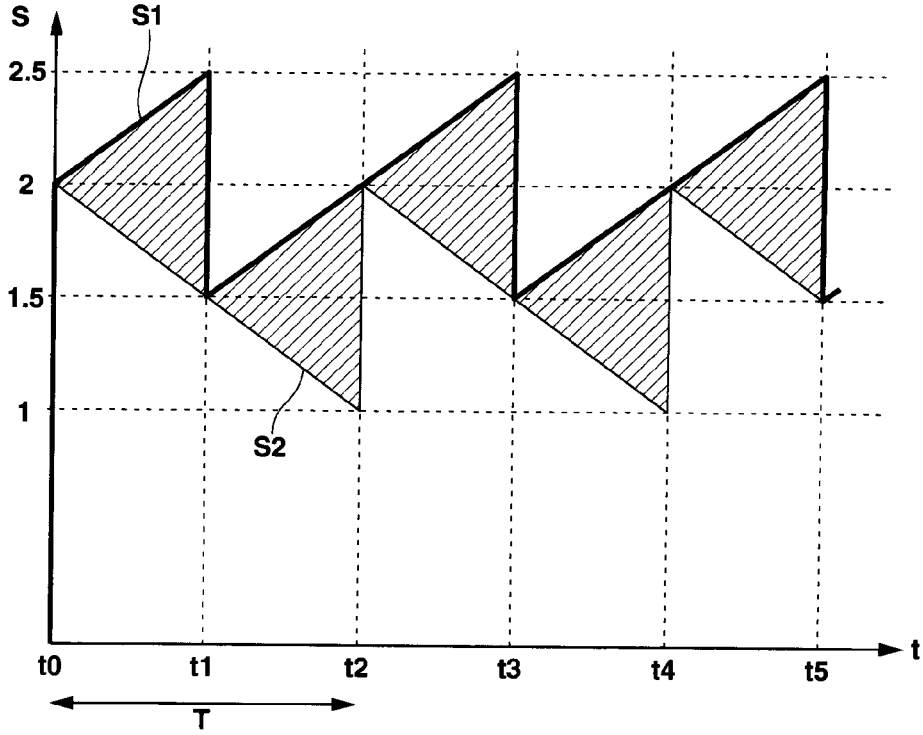
FIG. 9 is a time chart (a characteristic diagram) illustrating a change in each of a first pressure-receiving area S1 and a second pressure-receiving area S2 of the cam-ring inner peripheral surface of the variable displacement vane pump of the first embodiment.

Referring to FIG. 9, there is shown a time chart illustrating both a variation in first pressure-receiving area S1 extending in the negative y-axis direction with respect to the intersection point "R" and a variation in second pressure-receiving area S2 extending in the positive y-axis direction with respect to the intersection point "R", during operation of pump VP. For convenience's sake, assume that each of first and second pressure-receiving areas S1−S2 is represented simply by the number of pump chambers, which can be communicated with discharge port 17*b* and through which discharge pressure Pd can be applied to cam-ring inner peripheral surface 50. The force Fa is represented by the equality Fa=(S1×Pd), whereas the force Fb is represented by the equality Fb=(S2×Pd). Thus, on the assumption that discharge pressure Pd is uniform, the ratio Fa/Fb of two forces Fa and Fb (in other words, the ratio Ta/Tb of two moments Ta and Tb), is equal to the ratio S1/S2 between first and second pressure-receiving areas S1−S2.

At the time t0, vanes 6*a*-6*g* are positioned at the positions shown in FIGS. 7-8. Pump chambers, receiving discharge pressure Pd on the side of the negative y-axis direction with respect to the intersection point "R", are two pump chambers r6, r7, and thus S1=2. As vane rotor 4 rotates counterclockwise from the time t0, regarding pump chamber r7, the distance between a portion of cam-ring inner peripheral surface 50 (with which the tip of vane 6*e* abuts) and the point "D'" tends to gradually increase. Immediately before the time t1 when vane 6*e* reaches the circumferential end "B" of inlet port 16*b*, pump chambers, receiving discharge pressure Pd on the side of the negative y-axis direction with respect to the intersection point "R", are half of pump chamber r5, and two pump chambers r6, r7, and thus first pressure-receiving area S1 becomes the maximum (=2.5), that is, S1=2.5. As soon as vane 6*e* reaches the circumferential end "B" of inlet port 16*b* at the time t1, fluid communication between pump chamber r7 and discharge port 17*b* becomes blocked, and as a result the number of pumps, receiving discharge pressure Pd, is decremented by "1", that is, S1=1.5. With vane rotor 4 rotating counterclockwise, just after the time t1, regarding pump chamber r6, the distance between a portion of cam-ring inner peripheral surface 50 (with which the tip of vane 6*f* abuts) and the point "D'" tends to gradually increase, and thus first pressure-receiving area S1 also tends to increase. At the time t2 when vane 6*f* reaches the midpoint between the circumferential end "D" of discharge port 17*b* and the circumferential end "B" of inlet port 16*b*, the number of pump chambers, receiving discharge pressure Pd on the side of the negative y-axis direction with respect to the intersection point "R", becomes "2" in a similar manner to the time t0, that is, S1=2. After the time t2, the number of pump chambers, receiving discharge pressure Pd on the side of the negative y-axis direction with respect to the intersection point "R", can be repeatedly varied at the same cycle as the time interval between t0 and t2, in other words, at a given cycle T (=t2−t0). The given cycle T is determined depending on the distance between two adjacent vanes (6*a*-6*b*, 6*b*-6*c*, 6*c*-6*d*, 6*d*-6*e*, 6*e*-6*f*, 6*f*-6*g*), and the revolution speed of pump VP. Actually, the given period T corresponds to a time duration required in order for vane rotor 4 to counterclockwise rotate by an angle corresponding to one pump chamber.

On the other hand, pump chambers, receiving discharge pressure Pd on the side of the positive y-axis direction with respect to the intersection point "R", are only one pump chamber r5 at the time t0, and thus S2=1. When vane rotor 4 slightly rotates counterclockwise from the angular position shown in FIGS. 7-8, fluid communication between pump chamber r4 and discharge port 17*b* is established. Thus, with a slight elapsed time from the time t0, pump chambers, receiving discharge pressure Pd on the side of the positive y-axis direction with respect to the intersection point "R", become two pump chambers r4, r5, and thus S2=2.

Thereafter, as vane rotor 4 rotates counterclockwise, regarding pump chamber r4, the distance between a portion of cam-ring inner peripheral surface 50 (with which the tip of vane 6*b* abuts) and the point "C'" tends to gradually decrease, and thus second pressure-receiving area S2 also tends to decrease. At the time t1 when vane 6*b* reaches the midpoint between the circumferential end "A" of inlet port 16*b* and the circumferential end "C" of discharge port 17*b*, the previously-noted distance between the abutted portion of cam-ring inner peripheral surface 50 with the tip of vane 6*b* and the point "C'" becomes half of that obtained at the time t0. At this time (i.e., at the time t1), pump chambers, receiving discharge pressure Pd on the side of the positive y-axis direction with respect to the intersection point "R", are half of pump chamber r5, and pump chamber r4, and thus second pressure-receiving area S2 totally becomes "1.5", that is, S2=1.5. After the time t1, as vane rotor 4 rotates counterclockwise, regarding pump chamber r4, the distance between the portion of cam-ring inner peripheral surface 50 (with which the tip of vane 6*b* abuts) and the point "C'" tends to further decrease, and then becomes "O" at the time t2 when vane 6*b* reaches the circumferential end "C" of discharge port 17*b*. At this time (i.e., at the time t2), the number of pump chambers, receiving discharge pressure Pd on the side of the positive y-axis direction with respect to the intersection point "R", becomes "1" in a similar manner to the time t0, that is, S2=1. After the time t2, the number of pump chambers, receiving discharge pressure Pd on the side of the positive y-axis direction with respect to the intersection point "R", can be repeatedly varied at the same cycle as the time interval between t0 and t2, in other words, at a given cycle T (=t2−t0).

For the reasons discussed above, as can be appreciated from the time chart of FIG. 9, the relationship between the magnitudes of first and second segmented pressure-receiving areas S1−S2, defined by the inequality (S1−S2)>0, can be achieved always (at each point of time) during operation of pump VP. As seen from the right-hand diagonal shading area of FIG. 9, the integral {∫(S1−S2)dt} of the difference (S1−S2) of first and second segmented pressure-receiving areas S1 and S2 for the given cycle T can be kept at a value greater than "O", that is, {∫(S1−S2)dt}>0, during operation of pump VP. Actually, there are slight fluctuations in the difference (S1−S2) of first and second segmented pressure-receiving areas S1 and S2 at respective points of time during operation of pump VP. However, such fluctuations are equalized for the given period T. On the average, the fluctuations are negligible. Thus, the relationship between the magnitudes of first and second segmented pressure-receiving areas S1 and S2 can be regarded as to be given by the inequality S1>S2 for the given period T during operation of pump VP. For the reasons discussed above, on the average, the relationship between the magnitude of the force Fa resulting from the fluid pressure acting on cam-ring inner peripheral surface 50 corresponding to first segmented pressure-receiving area S1 extending in the negative y-axis direction with respect to the intersection point "R" and the magnitude of the force Fb resulting from the fluid pressure acting on cam-ring inner peripheral surface 50 corresponding to second segmented pressure-receiving area S2 extending in the positive y-axis direction with respect to the intersection point "R" can be regarded as to be given by the inequality Fa>Fb, during operation of pump VP. The positive moment (the clockwise moment) Ta−Tb(>0) about the fulcrum "Q", resulting from these forces Fa and Fb, can be continuously produced during operation of pump VP. That is, by virtue of the fluid pressure acting on cam-ring inner peripheral surface 50 and the offset layout of the fulcrum "Q" of oscillating motion of cam ring 5, it is possible to always produce the torque (i.e., the clockwise moment Ta−Tb), which causes an oscillating or rotating motion of cam ring 5 in the direction that the eccentricity |OP| of geometric center "P" of cam-ring inner peripheral surface 50 with respect to the axis "O" of drive shaft 3 (or the rotation center of rotor 4) reduces, during operation of pump VP.

It will be appreciated that a different type of variable displacement vane pump enables application of a torque (i.e., a clockwise moment Ta−Tb), which causes an oscillating or rotating motion of cam ring 5 in the direction that the eccentricity |OP| of geometric center "P" of cam-ring inner peripheral surface 50 with respect to the axis "O" reduces, during operation of pump VP, if, on the average, the integral {∫(S1−S2)dt} of the difference (S1−S2) of first and second pressure-receiving areas S1 and S2 for a given cycle T can be kept at a value greater than "O", that is, {∫(S1−S2)dt}>0, even when pump VP has a different design that a time-varied characteristic of first pressure-receiving area S1 becomes temporarily below that of second pressure-receiving area S2 within a specific time zone.

In other words, as far as first and second pressure-receiving areas S1 and S2 satisfy the relationship defined by the inequality $\{\int(S1-S2)dt\}>0$, even when pump VP has a different cam-ring fulcrum design/configuration that the fulcrum "Q" of oscillating motion of cam ring 5 is laid out at the intermediate position of discharge port 17*b* (circular-arc shaped groove 17*c*) and thus there is no offset between the intersection point "R" and the midpoint "S" at a certain angular position of cam ring 5 oscillating, it is possible to apply the torque (i.e., the clockwise moment Ta−Tb), which causes an oscillating or rotating motion of cam ring 5 in the direction that the eccentricity |OP| of geometric center "P" of cam-ring inner peripheral surface 50 with respect to the axis "O" reduces, during operation of pump VP.

(Operation of Biasing Member)

As set out above, biasing member 8 is installed in pump housing 1 at the position substantially symmetrical to the fulcrum "Q" of oscillating motion of cam ring 5 with respect to the axis "O" of drive shaft 3. Biasing member 8 forces cam ring 5 in the direction (in the counterclockwise direction, viewing FIG. 5) that the volume difference between the volume of the largest pump chamber (pump chamber r4 in FIG. 5) of pump chambers r1-r7 and the volume of the smallest pump chamber (pump chambers r1, r7 in FIG. 5) increases, in other words, in the direction that the rate of change of the volume of each of pump chambers r1-r7 increases.

Figure 10:
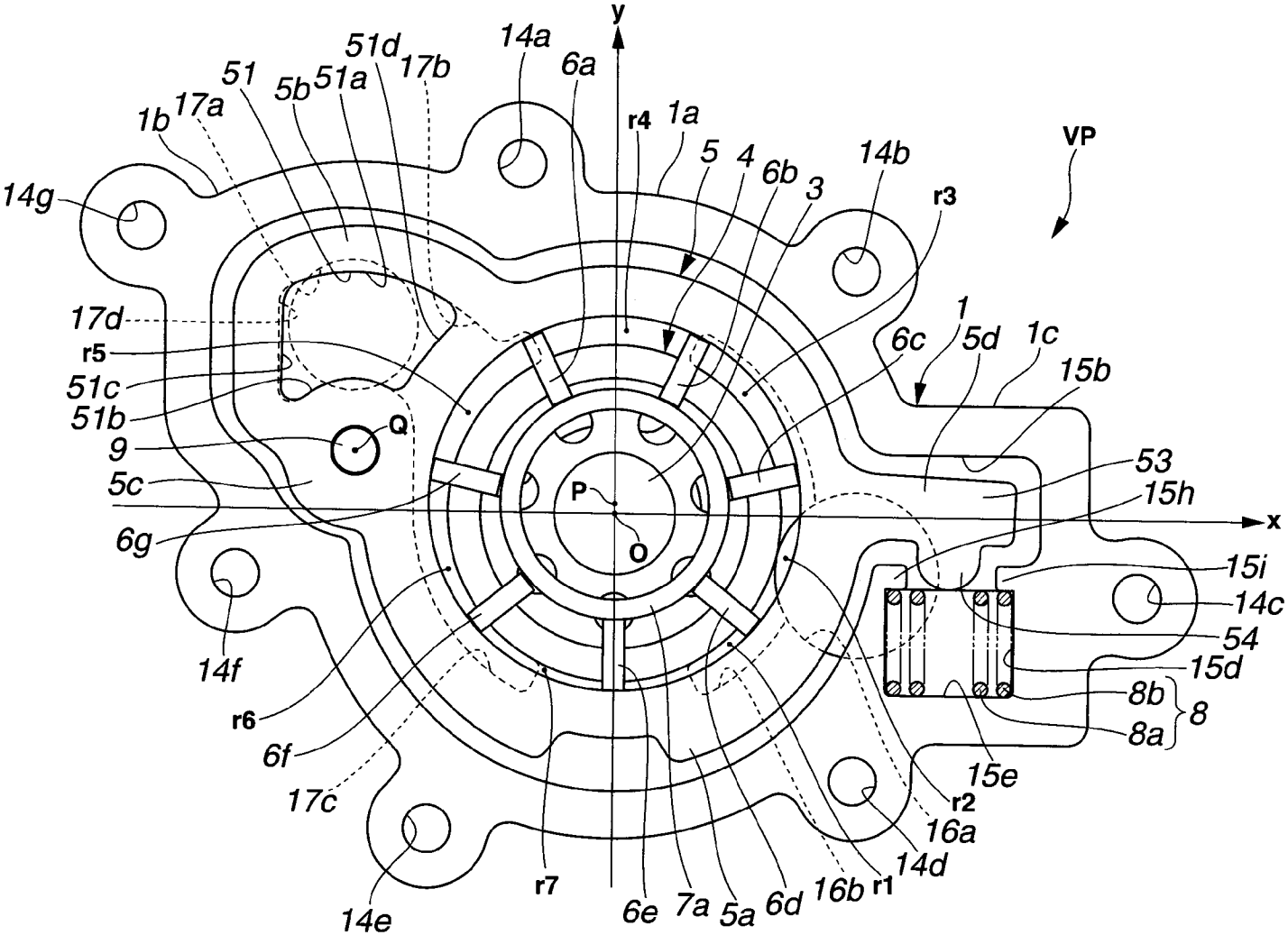
FIG. 10 is a front elevation view of the variable displacement vane pump of the first embodiment in an intermediate-eccentricity holding state where the cam-ring eccentricity is held at a substantially intermediate value between the maximum and minimum eccentricities.
Figure 11:
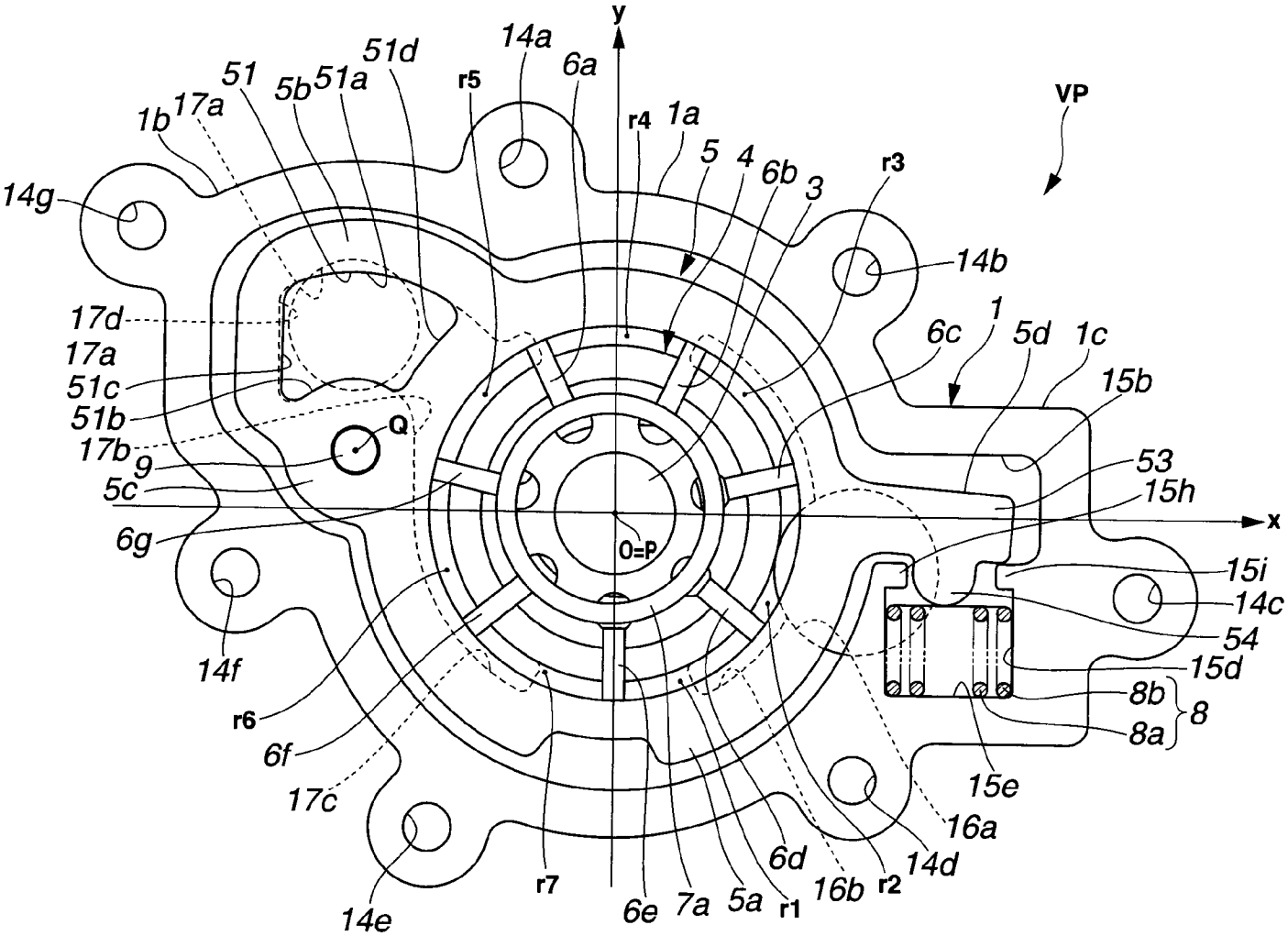
FIG. 11 is a front elevation view of the variable displacement vane pump of the first embodiment in the minimum-eccentricity state.

In FIGS. 7-8, a vector Fs denotes a force acting on cam ring 5 and produced by a biasing force (e.g., a spring force) of biasing member 8. In the first embodiment, concretely, force Fs corresponds to a force vector acting on cam-ring arm portion 5*d* in the positive y-axis direction. Force Fs produces a moment Ts by which cam ring 5 can be rotated about the fulcrum "Q" of oscillating motion in the counterclockwise direction that the eccentricity |OP| of geometric center "P" of cam-ring inner peripheral surface 50 with respect to the axis "O" of drive shaft 3 (or rotor 4) increases. The direction of oscillating motion and the oscillated or rotated position of cam ring 5 are determined depending on the relationship between the magnitude of moment Ts, produced by the spring bias of biasing member 8, and the magnitude of moment Ta−Tb, resulting from the fluid pressure (discharge pressure Pd) acting on cam-ring inner peripheral surface 50. The operation of biasing member 8 is hereunder described in reference to the front elevation views of FIGS. 10-11 as well as the front elevation view of FIG. 5. As previously discussed, FIG. 5 shows the initial setting state (the maximum-eccentricity state) of cam ring 5, where the amount of oscillating motion of cam ring 5 becomes zero and thus the eccentricity |OP| of geometric center "P" of cam-ring inner peripheral surface 50 with respect to the axis "O" of drive shaft 3 becomes maximum. In contrast, FIG. 11 shows the minimum-eccentricity state of cam ring 5, where the oscillated amount of cam ring 5 becomes maximum and thus the eccentricity |OP| of geometric center "P" of cam-ring inner peripheral surface 50 with respect to the axis "O" of drive shaft 3 becomes minimum (zero), that is, the axis "O" and the geometric center "P" accord with each other. On the other hand, FIG. 10 shows the intermediate-eccentricity holding state of cam ring 5, where the eccentricity |OP| of geometric center "P" of cam-ring inner peripheral surface 50 with respect to the axis "O" of drive shaft 3 becomes a substantially intermediate value between the maximum and minimum eccentricities, and a clockwise moment (described later), resulting from discharge pressure Pd acting on cam-ring inner peripheral surface 50, is balanced to a counterclockwise moment (described later), resulting from a summed spring load of first and second coil springs 8*a*-8*b*, both constructing biasing member 8.

When the revolution speed of pump VP is low, cam ring 5 is kept in the initial setting state of FIG. 5. That is, the fluid pressure (discharge pressure Pd) in discharge port 17*b* is still low at low revolution speeds of pump VP, the hydraulic pressure (i.e., the force difference Fa−Fb of unbalanced forces Fa, Fb), acting on cam-ring inner peripheral surface 50 in the direction that the eccentricity |OP| of geometric center "P" with respect to the axis "O" reduces, is still small. Thus, regarding the moments about the fulcrum "Q" of oscillating motion of cam ring 5, the counterclockwise moment Ts about the fulcrum "Q", produced by the biasing force of biasing member 8, becomes greater than the clockwise moment Ta−Tb, resulting from the fluid pressure (discharge pressure Pd) acting on cam-ring inner peripheral surface 50. Accordingly, cam ring 5 is kept in the maximum-eccentricity state (the initial setting position of FIG. 5).

As the pump revolution speed increases and thus discharge pressure Pd from discharge port 17*b* builds up, the hydraulic pressure (i.e., the force difference Fa−Fb of unbalanced forces Fa, Fb), which pressure causes oscillating motion of cam ring 5 about the fulcrum "Q" against the biasing force (e.g., the spring force) of biasing member 8 in the direction (i.e., in the clockwise direction) that reduces the eccentricity |OP| of geometric center "P" with respect to the axis "O", gradually increases. When discharge pressure Pd reaches a predetermined pressure value, the clockwise moment Ta−Tb, resulting from discharge pressure Pd acting on cam-ring inner peripheral surface 50, becomes identical to a counterclockwise moment Ts1 about the fulcrum "Q", produced by only the spring force of first coil spring 8*a* of two coil springs 8*a*-8*b*, constructing biasing member 8. When discharge pressure Pd exceeds the predetermined pressure value, the clockwise moment Ta−Tb, resulting from discharge pressure Pd, becomes greater than the counterclockwise moment Ts1, produced by only the spring force of first coil spring 8*a*. Thus, cam ring 5 begins to oscillate or rotate clockwise from the maximum-eccentricity position (the initial setting position of FIG. 5). As a result, cam-ring arm portion 5*d* moves in the negative y-axis direction apart from its seat surface 15*b*, while compressing first coil spring 8*a*.

By clockwise oscillating or rotating motion of cam ring 5, protruding portion 54 of cam-ring arm portion 5*d* displaces from the opening end of spring chamber 15*d*, facing in the positive y-axis direction, toward the inside of spring chamber 15*d*, while compressing first coil spring 8*a*. At this time, as seen in FIG. 10, the lowermost end of protruding portion 54, facing in the negative y-axis direction, is brought into abutted-engagement with the upper coil end of second coil spring 8*b*, which second coil spring is retained in spring chamber 15*d* with abutted-engagement of its upper coil end with the undersides of shoulder portions 15*h*-15*i*. At this time, the eccentricity of cam ring 5 (i.e., the distance |OP| between the axis "O" and the geometric center "P") becomes a substantially intermediate value between the maximum eccentricity (see FIG. 5) and the minimum eccentricity (see FIG. 11). Such an intermediate-eccentricity state of cam ring 5 is simply referred to as "holding state". The position of cam ring 5, which is kept in its holding state, is hereinafter referred to as "holding position". The rate of change of the volume of each of pump chambers r1-r7 in the holding state (see FIG. 10) is lower than that in the initial setting state (see FIG. 5), and higher than that in the minimum-eccentricity state (see FIG. 11).

When discharge pressure Pd is within a predetermined pressure range, the clockwise moment Ta−Tb, resulting from discharge pressure Pd, becomes greater than the counterclockwise moment Ts1, resulting from the spring force of first coil spring 8*a*, and less than a total counterclockwise moment Ts, which total counterclockwise moment is expressed as the sum (Ts1+Ts2) of the moment Ts1, resulting from the spring force of first coil spring 8*a*, and the moment Ts2, resulting from the spring force of second coil spring 8*b*, that is, Ts1<(Ta−Tb)<Ts(=Ts1+Ts2). At this time, the oscillated position of cam ring 5 relative pump housing 1 remains unchanged and thus cam ring 5 can be kept at the holding position shown in FIG. 10. As soon as discharge pressure Pd exceeds the above-mentioned predetermined pressure range, the clockwise moment Ta−Tb, resulting from discharge pressure Pd, becomes greater than the total counterclockwise moment Ts(=Ts1+Ts2). As a result, cam ring 5 begins to further oscillate clockwise from the holding position. Thus, protruding portion 54 of cam-ring arm portion 5*d* further displaces in the negative y-axis direction from the opening end of spring chamber 15*d* toward the inside of spring chamber 15*d*, while compressing second coil spring 8*b* as well as first coil spring 8*a*.

When discharge pressure Pd reaches a predetermined high pressure value, first and second coil springs 8*a*-8*b* are further compressed a given stroke (see FIG. 11), and thus the outermost end of the underside of support portion 53 (the top end of support portion 53 on the side of a combined direction of the positive x-axis direction and the negative y-axis direction of cam-ring arm portion 5*d*) is brought into abutted-engagement with the upside of shoulder portion 15*i* facing in the positive y-axis direction. Under these conditions, the shoulder portion 15*i* serves as a stopper for restricting or preventing a further clockwise rotation of cam ring 5 about the fulcrum "Q". At this time, as seen in FIG. 11, the geometric center "P" accords with the axis "O", with the result that the eccentricity of cam ring 5 (i.e., the distance |OP| between the axis "O" and the geometric center "P") becomes zero. In the minimum-eccentricity state (the zero-eccentricity state), the volume difference between the volume of the largest pump chamber (pump chamber r4 in FIG. 11) of pump chambers r1-r7 and the volume of the smallest pump chamber (pump chambers r1, r7 in FIG. 11) becomes minimum (almost zero). In the shown embodiment, in the minimum-eccentricity state, the eccentricity |OP| of cam ring 5 becomes zero. It will be understood that the minimum-eccentricity state is not limited to such a zero-eccentricity state, but that, in the minimum-eccentricity state, a predetermined slight offset between the geometric center "P" and the axis "O" may exist.

Figure 12:
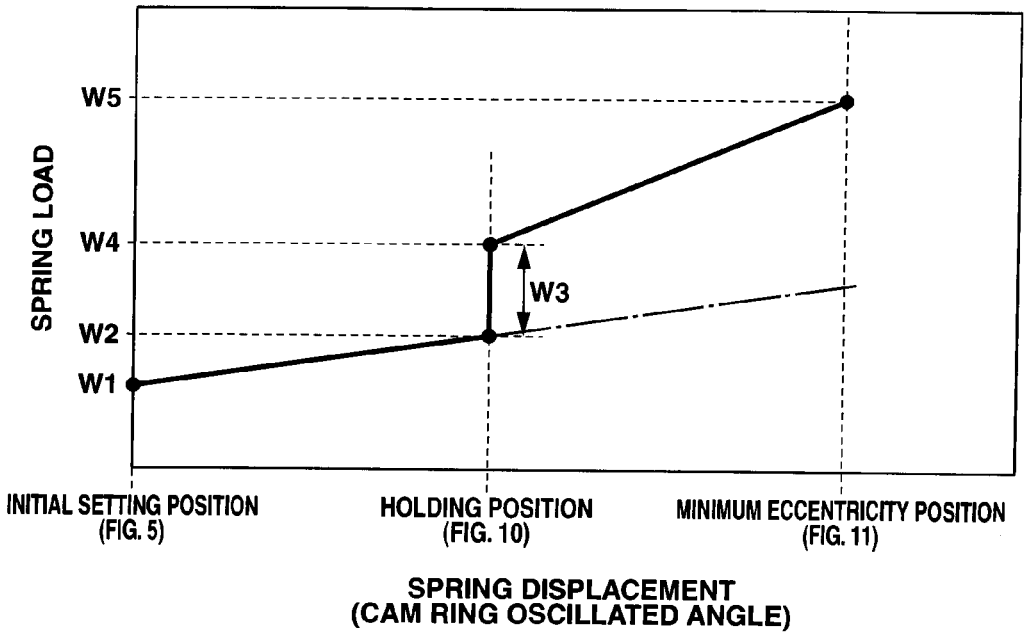
FIG. 12 is a characteristic diagram showing the relationship between a displacement of a biasing member (i.e., a cam-ring oscillated angle) and a spring load in the variable displacement vane pump of the first embodiment.

Referring now to FIG. 12, there is shown the relationship between a displacement of biasing member 8 (first and second coil springs 8*a*-8*b*) and a load W, in the case of pump VP of the first embodiment. Concretely, the displacement of biasing member 8 means a compressed stroke (a compressive deformation) of the double spring (constructed by first and second coil springs 8*a*-8*b*), corresponding to an oscillated amount (or an oscillated angle) of cam ring 5 displaced or oscillated clockwise from the initial setting position. The load W means a spring load corresponding to a summed value of the spring load produced by first coil spring 8*a* and the spring load produced by second coil spring 8*b*, i.e., the total spring bias of first and second coil springs 8*a*-8*b*. In other words, spring load W is regarded as to be equivalent to the previously-noted total counterclockwise moment Ts, expressed as the sum (Ts1+Ts2) of the moment Ts1, resulting from the spring force of first coil spring 8*a*, and the moment Ts2, resulting from the spring force of second coil spring 8*b*.

In the initial setting position (see FIG. 5) of cam ring 5, the spring load becomes the initial set load W1 of first coil spring 8*a*. While cam ring 5 displaces from the initial setting position (see FIG. 5) toward the holding position (see FIG. 10), only the first coil spring 8*a* is compressed and deformed. Hence, during this clockwise displacement of cam ring 5 between the initial setting position and the holding position, the spring load is in proportion to the displacement of first coil spring 8*a* from the initial setting position. Thus, the spring load tends to increase at a gradient corresponding to the spring constant (the spring stiffness or the spring rate) of first coil spring 8*a*. Immediately before cam ring 5 reaches the holding position (see FIG. 10), the spring load becomes a load W2 (>W1), corresponding to the displacement of first coil spring 8*a* at that time. Therefore, with cam ring 5 displaced at an angular position between the initial setting position (FIG. 5) and the holding position (FIG. 10), the moment Ts, resulting from biasing member 8, becomes identical to the counterclockwise moment Ts1 about the fulcrum "Q", produced by only the spring load of first coil spring 8*a*.

As soon as cam ring 5 further rotates clockwise and reaches the holding position, second coil spring 8*b* as well as first coil spring 8*a* begins to compress and deform. Hence, immediately when the oscillated angle of cam ring 5 increases a very small angle from the holding position, the spring load rapidly discontinuously increases up to a load W4 with a less change in the spring displacement. The load W4 is equal to the summed value (W2+W3) of the load W2 and an initial set load W3 of second coil spring 8*b*.

With cam ring 5 displaced at an angular position between the holding position (FIG. 10) and the minimum-eccentricity position (FIG. 11), first and second coil springs 8*a*-8*b* are both compressed and deformed. The spring load becomes the summed value of the spring load produced by first coil spring 8*a* and the spring load produced by second coil spring 8*b*. Thus, the spring load tends to increase at a gradient corresponding to the summed value of the spring constant of first coil spring 8*a* and the spring constant of second coil spring 8*b*, in proportion to the displacement of first and second coil springs 8*a*-8*b* from the holding position. When cam ring 5 reaches the minimum-eccentricity position (see FIG. 11), the spring load becomes a load W5 (>W4), corresponding to the displacements of first and second coil springs 8*a*-8*b* at that time. Therefore, with cam ring 5 displaced at an angular position between the holding position (FIG. 10) and the minimum-eccentricity position (FIG. 11), the moment Ts, resulting from biasing member 8, becomes identical to the sum (Ts1+Ts2) of the moment Ts1, produced by the spring load of first coil spring 8*a* and the moment Ts2, produced by the spring load of second coil spring 8*b*.

As discussed above, the spring displacement versus load characteristic of biasing member 8 is designed as a nonlinear characteristic, in which, the load (that is, the biasing force) increases discontinuously, as the oscillated amount (the oscillated angle) of cam ring 5 increases. That is, biasing member 8 has a discontinuous spring characteristic that the spring load increases rapidly discontinuously at the holding position over the entire range of spring load, ranging from the initial setting position via the holding position to the minimum-eccentricity position. The spring constant of biasing member 8 becomes identical to the spring constant of first coil spring 8*a* within a first range of oscillating motion of cam ring 5, ranging from the initial setting position to the holding position. The spring constant of biasing member 8 becomes identical to the summed value of the spring constant of first coil spring 8*a* and the spring constant of second coil spring 8*b* within a second range of oscillating motion of cam ring 5, ranging from the holding position to the minimum-eccentricity position. The spring constant of biasing member 8, i.e., the load (the biasing force) per unit spring displacement tends to rapidly discontinuously increase.

The previously-discussed nonlinear characteristic is obtained by the double spring structure, which is comprised of first coil spring 8*a*, which permanently biases cam ring 5 counterclockwise regardless of the oscillated amount of cam ring 5, and second coil spring 8*b*, which applies its biasing force (spring force) to cam ring 5 only when the oscillated amount of cam ring 5 exceeds a predetermined amount. That is, biasing member 8 is configured, so that cam ring 5 is forced by means of only one spring (i.e., first coil spring 8*a*) when the oscillated amount of cam ring 5 is small, and that cam ring 5 is forced by means of a plurality of springs (i.e., first and second coil springs 8*a*-8*b*) when the oscillated amount of cam ring 5 is large.

Figure 13:
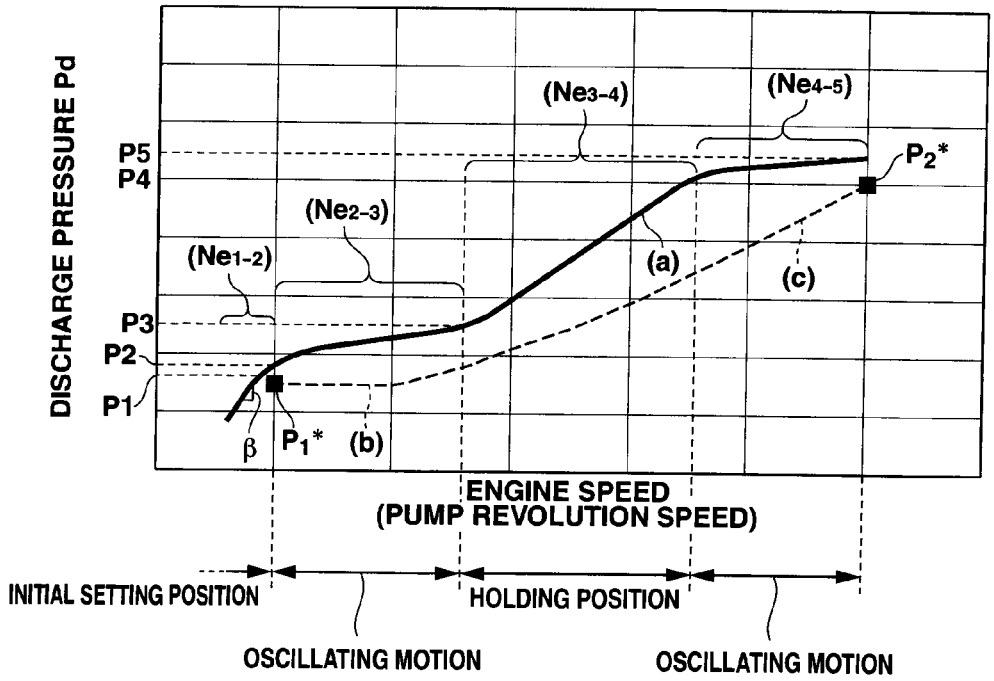
FIG. 13 is an engine-speed versus pump-discharge-pressure characteristic diagram.

Referring now to FIG. 13, there are shown the engine-speed versus pump-discharge-pressure characteristic curves. The characteristic curve, indicated by the solid line (a) in FIG. 13, shows the relationship between the engine speed (i.e., the revolution speed of pump VP) and discharge pressure Pd, in the variable displacement vane pump VP of the first embodiment. On the other hand, the characteristic curve, indicated by the broken lines (b)-(c) in FIG. 13, shows a typical engine-speed versus discharge pressure characteristic, generally utilized by usual engines.

Hydraulic pressure, required for the engine, is determined mainly by hydraulic pressure required for lubrication of bearings of the engine crankshaft. Thus, as can be seen from the broken line (c) of FIG. 13, discharge pressure Pd tends to increase, as the engine speed increases. Generally, in the case of hydraulically-operated VTC-equipped engines, pump discharge pressure is also used as a working-fluid-pressure source for the VTC system. In order to enhance the operation responsiveness of the VTC system, a predetermined pressure level of discharge pressure Pd (see a pressure level $P_1$* indicated on the broken line (b) in FIG. 13) is required from the point of time when the engine speed is still low. As discussed previously, the usual VTC-equipped engine has the engine-speed versus discharge pressure characteristic, obtained by combining the broken lines (b)-(c) with each other.

In contrast, in the first embodiment, by virtue of the previously-noted nonlinear characteristic of biasing member 8, pump VP exhibits the engine-speed versus discharge pressure characteristic indicated by the solid line (a) in FIG. 13. The relationship between discharge pressure Pd and engine speed (pump revolution speed) is hereunder described in detail each and every speed range, namely, a first speed range $Ne_{1-2}$, a second speed range $Ne_{2-3}$, a third speed range $Ne_{3-4}$, and a fourth speed range $Ne_{4-5}$.

In the first speed range $Ne_{1-2}$ just after engine starting, in which engine speed is still low, the counterclockwise moment Ts1, resulting from the initial set load W1 of biasing member 8 (first coil spring 8*a*) becomes greater than the clockwise moment Ta−Tb, resulting from discharge pressure Pd of pump VP, and thus cam ring 5 is kept at the initial setting position shown in FIG. 5. With cam ring 5 kept at its initial setting position, the eccentricity |OP| of geometric center "P" with respect to the axis "O" becomes maximum, the pump discharge capacity becomes maximum, and thus pump VP has a high discharge pressure rise characteristic that discharge pressure Pd can be risen rapidly in accordance with an engine speed rise (see a steep discharge pressure rise in the first speed range $Ne_{1-2}$ in FIG. 13).

As soon as discharge pressure Pd becomes greater than or equal to a pressure level P2, the clockwise moment Ta−Tb, resulting from discharge pressure Pd, becomes greater than the counterclockwise moment Ts1, resulting from the initial set load W1 of biasing member 8 (first coil spring 8*a*), and thus cam ring 5 begins to oscillate in the direction that the eccentricity |OP| of geometric center "P" with respect to the axis "O" reduces. In the second speed range $Ne_{2-3}$, discharge pressure Pd rises from the pressure level P2 up to a pressure level P3, in accordance with an engine speed rise. During the period in which discharge pressure Pd is rising from the pressure level P2 up to the pressure level P3, assuming that the clockwise moment Ta−Tb, resulting from discharge pressure Pd, continuously exceeds the moment Ts1, resulting from the load (ranging from W1 to W2) of biasing member 8 (first coil spring 8*a*) compressed, cam ring 5 can be continuously oscillated in the previously-noted direction that the eccentricity |OP| reduces. During such a clockwise oscillating motion of cam ring 5 in the second speed range $Ne_{2-3}$, a discharge pressure buildup, resulting from an engine speed rise, is canceled by a discharge pressure reduction, resulting from a decrease in the pump discharge capacity. For the reasons discussed above, the gradient of a discharge pressure rise with respect to an engine speed rise, produced in the second speed range $Ne_{2-3}$, tends to be less than that produced in the first speed range $Ne_{1-2}$. Thus, in the second speed range $Ne_{2-3}$, pump VP has a slow discharge pressure rise characteristic that discharge pressure Pd can be risen slowly in accordance with an engine speed rise (see a slow discharge pressure rise in the second speed range $Ne_{2-3}$ in FIG. 13).

When discharge pressure Pd reaches a pressure level P3, the clockwise moment Ta−Tb, resulting from discharge pressure Pd, becomes identical to the moment Ts1, resulting from the load W2 of biasing member 8 (first coil spring 8*a*). In the third speed range $Ne_{3-4}$, discharge pressure Pd rises from the pressure level P3 up to a pressure level P4, in accordance with an engine speed rise. During the period in which discharge pressure Pd is rising from the pressure level P3 up to the pressure level P4, the clockwise moment Ta−Tb, resulting from discharge pressure Pd, is balanced to the counterclockwise moment Ts, resulting from the summed spring load (ranging from W2 to W4) of first and second coil springs 8*a*-8*b*. Thus, cam ring 5 remains kept at its holding position, with no further oscillating motion (with no further clockwise rotation). The rate of change of the volume of each of pump chambers r1-r7, obtained in the holding position of cam ring 5, is lower than that obtained in the initial setting position. Hence, the pump discharge capacity, obtained in the third speed range $Ne_{3-4}$, is less than that obtained in the first speed range $Ne_{1-2}$. Regarding the pump discharge capacity, the third speed range $Ne_{3-4}$, differs from the second speed range $Ne_{2-3}$. That is, the pump discharge capacity tends to decrease in the second speed range $Ne_{2-3}$, whereas the pump discharge capacity remains unchanged and becomes a fixed value in the third speed range $Ne_{3-4}$. For the reasons discussed above, the gradient of a discharge pressure rise with respect to an engine speed rise, produced in the third speed range $Ne_{3-4}$, tends to be less than that produced in the first speed range $Ne_{1-2}$, and greater than that produced in the second speed range $Ne_{2-3}$. That is, in the third speed range $Ne_{3-4}$, pump VP has a moderate discharge pressure rise characteristic that discharge pressure Pd can be risen moderately in accordance with an engine speed rise (see a moderate discharge pressure rise in the third speed range $Ne_{3-4}$ in FIG. 13).

When, due to a further discharge pressure rise, discharge pressure Pd becomes greater than or equal to the predetermined pressure level P4, the clockwise moment Ta−Tb, resulting from discharge pressure Pd, becomes greater than the counterclockwise moment Ts, resulting from the spring load W4 (the summed spring load of first and second coil springs 8*a*-8*b*). Cam ring 5 begins to oscillate again in the direction that the eccentricity |OP| of geometric center "P" with respect to the axis "O" reduces. Thus, in the fourth speed range $Ne_{4-5}$, discharge pressure Pd rises from the pressure level P4 up to a pressure level P5, in accordance with a further engine speed rise. During the period in which discharge pressure Pd is rising from the pressure level P4 up to the pressure level P5, assuming that the clockwise moment Ta−Tb, resulting from discharge pressure Pd, continuously exceeds the moment Ts, resulting from the load (ranging from W4 to W5) of biasing member 8 (first and second coil springs 8*a*-8*b*) compressed, cam ring 5 can be continuously oscillated in the previously-noted direction that the eccentricity |OP| reduces. Hence, in a similar manner to the second speed range $Ne_{2-3}$, the gradient of a discharge pressure rise with respect to an engine speed rise, produced in the fourth speed range $Ne_{4-5}$, tends to be less than those produced in the first and third speed ranges $Ne_{1-2}$ and $Ne_{3-4}$. Thus, in the fourth speed range $Ne_{4-5}$, pump VP has a slow discharge pressure rise characteristic that discharge pressure Pd can be risen slowly in accordance with an engine speed rise (see a slow discharge pressure rise in the fourth speed range $Ne_{4-5}$ in FIG. 13).

The shape of the specific engine-speed versus discharge pressure characteristic curve (indicated by the solid line (a) in FIG. 13) of pump VP of the first embodiment, in which the high discharge pressure rise characteristic of first speed range $Ne_{1-2}$, the slow discharge pressure rise characteristic of second speed range $Ne_{2-3}$, the moderate discharge pressure rise characteristic of third speed range $Ne_{3-4}$, and the slow discharge pressure rise characteristic of fourth speed range $Ne_{4-5}$ are combined with each other, is, as a whole, analogous to the shape of the engine-speed versus discharge pressure characteristic curve, obtained by combining the broken lines (b)-(c) with each other and generally required for usual VTC-equipped engines.

(Operation of VTC)

Figure 14A:
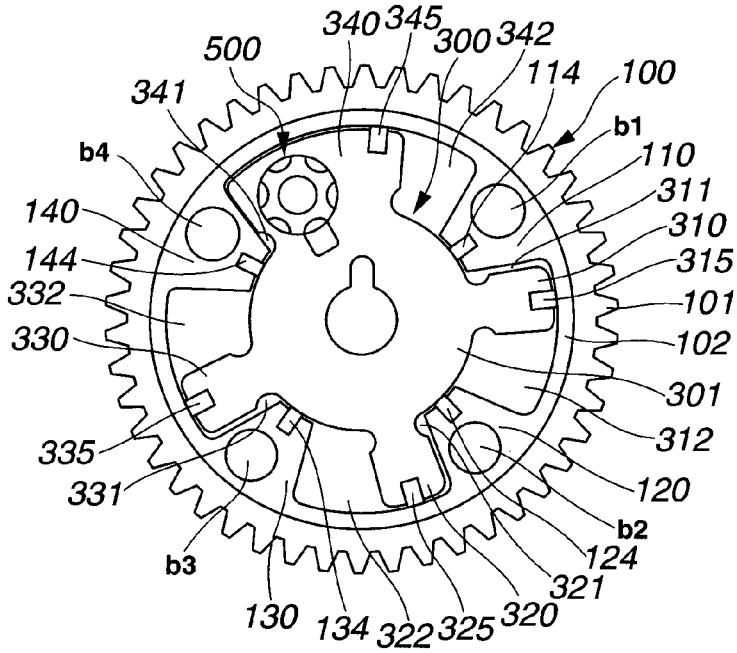
FIGS. 14A-14C are explanatory views illustrating the relationship among the angular position of a vane member, the position of a retractable lock piston, and the axial position of an axially-slidable valve spool, in the VTC system, to which the variable displacement vane pump of the first embodiment is applied, in an engine stopped state.
Figure 14B:
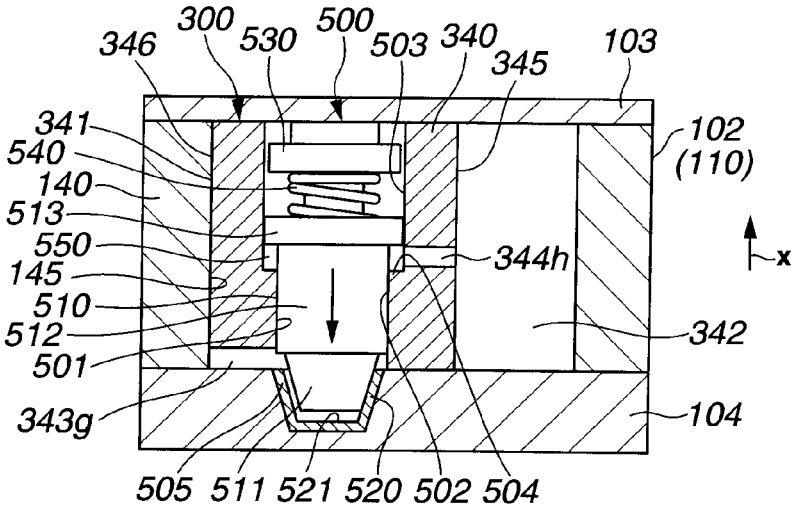
Figure 14C:
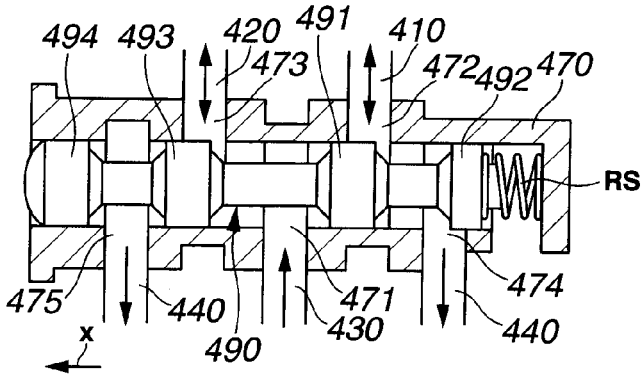
Figure 15A:
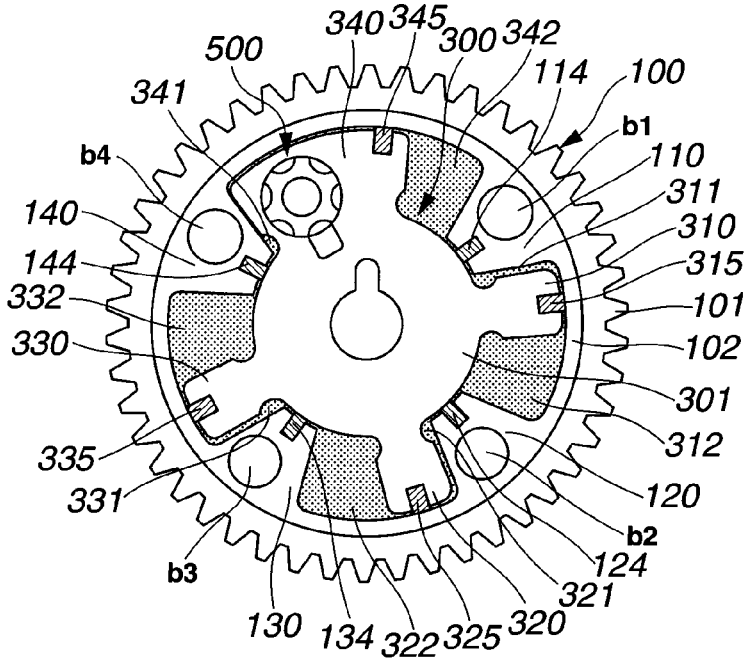
FIGS. 15A-15C are explanatory views illustrating the relationship among the angular position of the vane member, the position of the retractable lock piston, and the axial position of the valve spool, in the VTC system, to which the variable displacement vane pump of the first embodiment is applied, during an engine startup period.
Figure 15B:
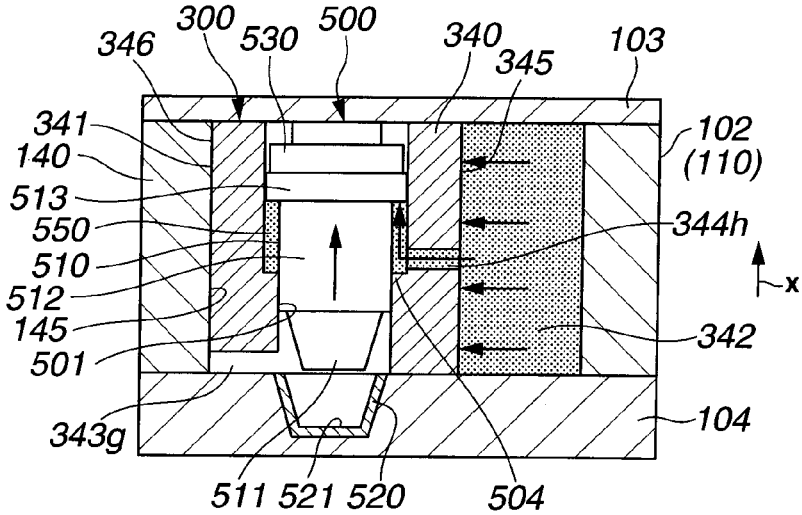
Figure 15C:
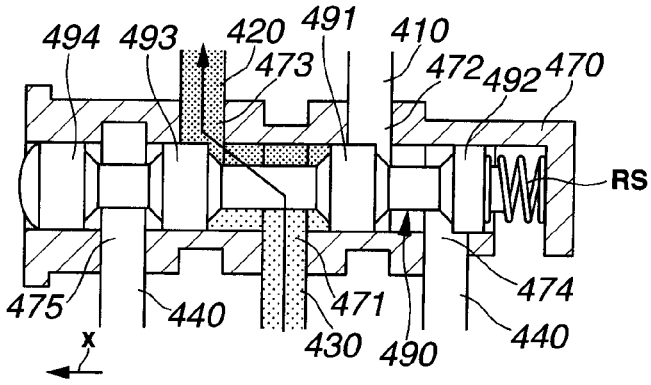
Figure 16A:
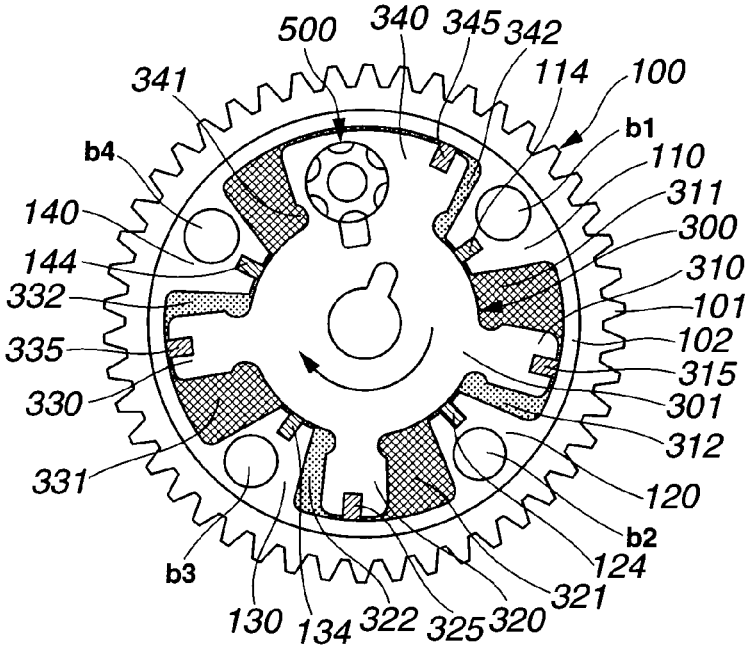
FIGS. 16A-16C are explanatory views illustrating the relationship among the angular position of the vane member, the position of the retractable lock piston, and the axial position of the valve spool, in the VTC system, to which the variable displacement vane pump of the first embodiment is applied, at middle engine-speed operation.
Figure 16B:
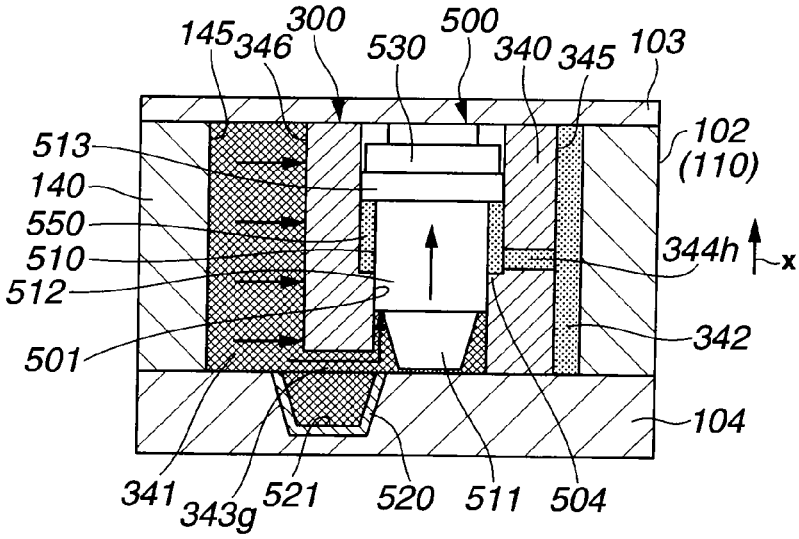
Figure 16C:
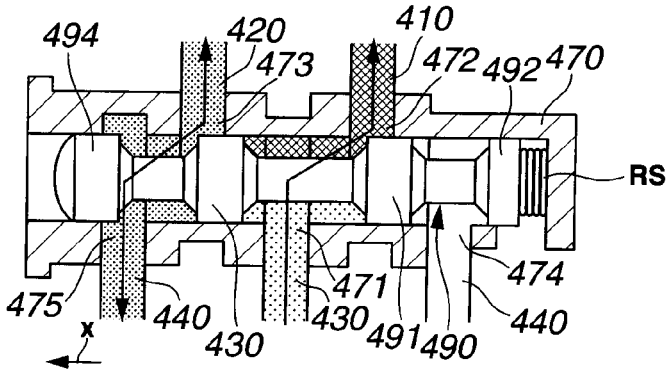

The operation of the VTC system employing pump VP having the specific engine-speed versus discharge pressure characteristic, as indicated by the solid line (a) in FIG. 13, is hereunder described in detail in reference to FIGS. 14A-14C, 15A-15C, and 16A-16C. In a similar manner to FIG. 2, FIGS. 14A-16C, FIGS. 14A, 15A, and 16A show the front elevation views, schematically illustrating angular positions of vane member 300. FIGS. 14B, 15B, and 16B show the cross sections, taken along the line J-J of FIG. 2, and schematically illustrating positions of retractable lock piston 510. In a similar manner to FIG. 1, FIGS. 14C, 15C, and 16C show the cross sections of directional control valve 450, cut along the x-axis direction, and schematically illustrating axial positions of valve spool 490. FIGS. 14A-14C show the relationship among the angular position of vane member 300, the position of retractable lock piston 510, and the axial position of valve spool 490, in an engine stopped state. FIGS. 15A-15C show the relationship among the angular position of vane member 300, the position of retractable lock piston 510, and the axial position of valve spool 490, during an engine startup period. FIGS. 16A-16C show the relationship among the angular position of vane member 300, the position of retractable lock piston 510, and the axial position of valve spool 490, at middle engine-speed operation. As previously described, the phase converter (the variable valve actuation mechanism) is comprised of vane member 300, phase-converter housing 102, variable-volume phase-advance chambers 311, 321, 331, and 341, variable-volume phase-retard chambers 312, 322, 332, and 342, and hydraulic pressure supply-and-exhaust mechanism 400.

In the engine stopped state, pump VP does not yet come into operation, and also there is no output of exciting current from controller CU to electromagnetic coil 482 of solenoid 480 of directional control valve 450. Thus, as seen in FIG. 14C, valve spool 490 is forced in the positive x-axis direction by the spring force of return spring RS, and held at the maximum leftward axial position (the spring-loaded position). Hence, there is no supply of working-fluid pressure to each of phase-advance chambers 311-341 and there is no supply of working-fluid pressure to each of phase-retard chambers 312-342.

On the other hand, as seen in FIG. 14A, vane member 300 rotates relative to timing sprocket 100 (or phase-converter housing 102) in the counterclockwise direction opposite to the timing-sprocket rotation direction (see the direction of rotation of timing sprocket 100 indicated by the arrow in FIG. 2) by alternating torque, occurring at camshaft 200 just after the engine has stopped. As a result of this, vane member 300 can be positioned at its maximum phase-retard position in advance. At this time, as seen in FIG. 14B, tapered head portion 511 of lock piston 510 is brought into engagement with engaging hole 521 of cup-shaped engaging-hole structural member 520 of rear cover 104 by the spring force of return spring 540 of lock mechanism 500, and thus free rotation of vane member 300 relative to phase-converter housing 102 is prevented.

Next, when beginning to crank the engine by turning an ignition key (not shown) ON, there is no output of control current from controller CU to electromagnetic coil 482 for a brief moment (several seconds) from the beginning of cranking. Thus, as seen in FIG. 15C, valve spool 490 still remains kept at the maximum leftward axial position (the spring-loaded position) by the spring force of return spring RS. With valve spool 490, held at its maximum leftward position, fluid communication between supply port 471 and second port 473 is established, and fluid communication between second port 473 and second drain port 475 is blocked, and fluid communication between first port 472 and first drain port 474 is established.

Thus, as indicated by the arrow in FIG. 15C, the fluid pressure (discharge pressure Pd) of working fluid discharged from pump VP flows from supply passage 430 through supply port 471 into valve housing 470, and then flows via second port 473 into second hydraulic line 420. Thereafter, the working-fluid pressure is further delivered via branch passages 422-425 into each of phase-retard chambers 312-342 (see FIG. 15A). The pressure in each of phase-retard chambers 312-342 rises, as discharge pressure Pd of pump VP builds up.

As seen in FIG. 15B, due to the previously-discussed pressure rise in phase-retard chamber 342, the risen hydraulic pressure in phase-retard chamber 342 is delivered via second oil hole 344*h* into pressure-receiving chamber 550, and acts on the pressure-receiving surface of flanged portion 513 of lock piston 510. When discharge pressure Pd of pump VP exceeds a predetermined pressure value, the hydraulic pressure acting on the pressure-receiving surface of flanged portion 513 becomes greater than the spring force of return spring 540, and as a result lock piston 510 begins to move in the positive x-axis direction. When discharge pressure Pd becomes greater than or equal to a pressure level P1, tapered head portion 511 is completely forced out of engaging hole 521 of cup-shaped engaging-hole structural member 520 of rear cover 104. In this manner, the locked state of lock mechanism 500 of vane member 300 (i.e., the locked state of the valve timing) becomes released, thereby permitting free rotation of vane member 300 so as to enable a phase change by means of the VTC system.

The previously-noted pressure level P1, at which lock mechanism 500 of the VTC device becomes unlocked, can be realized in the first speed range $Ne_{1-2}$ shown in FIG. 13. The pressure level P1 is lower than the pressure level P2 at which cam ring 5 begins to oscillate clockwise against the spring force of first coil spring 8*a*. The discharge pressure Pd, corresponding to pressure level P1, can be realized two or three seconds later after the ignition key has been turned ON. At the point of time when lock mechanism 500 of the VTC device becomes unlocked, cam ring 5 of pump VP remains kept in the initial setting position before beginning to compress first coil spring 8*a* by protruding portion 54 of cam-ring arm portion 5*d*, and thus the pump discharge capacity becomes maximum. Hence, at the time when lock mechanism 500 of the VTC device becomes unlocked, pump VP has a high discharge pressure rise characteristic that discharge pressure Pd can be risen rapidly in accordance with an engine speed rise (see a steep discharge pressure rise in the first speed range $Ne_{1-2}$ in FIG. 13).

When discharge pressure Pd is greater than or equal to the pressure level P1 and less than the pressure level P2 even after lock mechanism 500 of the VTC device has been unlocked, in a similar to the engine stopped state, vane member 300 is still maintained at the maximum phase-retard position under a comparatively low hydraulic pressure supplied into each of phase-retard chambers 312-342, even after the engine has been cranked and started (see FIGS. 15A-15B), thereby enhancing the engine startability. At this time, air staying in each of phase-retard chambers 312-342 is compressed by the hydraulic pressure, and then the compressed air, together with the hydraulic pressure, acts to force vane member 300 toward the maximum phase-retard side.

When the engine operating range reaches a middle speed range (e.g., the second speed range $Ne_{2-3}$ shown in FIG. 13) after cranking, discharge pressure Pd becomes greater than the pressure level P2. At this time, controller CU outputs a control command signal (an exciting current) to electromagnetic coil 482 of solenoid 480 of directional control valve 450. Hence, valve spool 490 moves from the maximum leftward axial position (the spring-loaded position shown in FIG. 15C) in the negative x-axis direction, and then positioned in the maximum rightward axial position shown in FIG. 16C. With valve spool 490, held at its maximum rightward position, fluid communication between supply port 471 and first port 472 is established, and fluid communication between second port 473 and second drain port 475 is established, and fluid communication between first port 472 and first drain port 474 is blocked.

Thus, as indicated by the arrows in FIG. 16C, discharge pressure Pd of pump VP flows from supply passage 430 through supply port 471 into valve housing 470, and then flows via first port 472 into first flow-passage structure 411 of first hydraulic line 410. Thereafter, discharge pressure Pd is further delivered via branch passages 412-415 into each of phase-advance chambers 311-341 (see FIG. 16A). Hence, the pressure in each of phase-advance chambers 311-341 becomes high, while the pressure in each of phase-retard chambers 312-342 becomes low, since the working oil in each of phase-retard chambers 312-342 is drained through second hydraulic line 420 and second drain port 475 into oil pan 460.

As seen in FIG. 16B, although the hydraulic pressure in pressure-receiving chamber 550 tends to drop, due to the previously-discussed pressure rise in phase-advance chamber 341, the risen hydraulic pressure in phase-advance chamber 341 is delivered via first oil groove 343*g* into tapered head portion 511. Thus, lock piston 510 receives the hydraulic pressure acting in the positive x-axis direction, and whereby the unlocked state, where lock piston 510 is forced out of engaging hole 521 against the spring force of return spring 540, is maintained.

When the hydraulic pressure in each of phase-advance chambers 311-341 is rising up due to discharge pressure Pd developing above the pressure level P2, as shown in FIG. 16A, vane member 300 rotates relative to timing sprocket 100 (or phase-converter housing 102) from the angular position shown in FIG. 15A in the same direction (i.e., in the clockwise direction) as the timing-sprocket rotation direction (see the direction of rotation of timing sprocket 100 indicated by the arrow in FIG. 2). As a result, the angular phase of camshaft 200 relative to the crankshaft can be rapidly varied to the phase-advance side, and thus a valve overlapping period during which the intake and exhaust valves are both open, becomes slightly great.

In contrast, when, in the second speed range $Ne_{2-3}$, the hydraulic pressure in each of phase-advance chambers 311-341 drops due to some kind of factors, such as an engine speed drop, the angular phase of camshaft 200 relative to the crankshaft can be rapidly returned to the phase-retard side, and thus the valve overlapping period becomes decreased. At this time, discharge pressure Pd remains kept at a pressure level higher than the pressure level P2, lock mechanism 500 remains kept at the unlocked state.

As discussed above, in the middle engine speed range, that is, in the second speed range $Ne_{2-3}$, discharge pressure Pd is greater than or equal to the pressure level P2 and less than the pressure level P3, cam ring 5 can oscillate or rotate, while being forced counterclockwise by only one spring, namely, only the spring force of first coil spring 8*a*. Hence, in the middle engine speed range, pump VP has a slow discharge pressure rise characteristic that discharge pressure Pd can be risen slowly in accordance with an engine speed rise (see a slow discharge pressure rise in the second speed range $Ne_{2-3}$ in FIG. 13). The discharge pressure level P2, at which cam ring 5 begins to oscillate clockwise against only the spring force of first coil spring 8*a*, is slightly higher than the pressure level $P_1$*, indicated on the broken line (b) in FIG. 13 and required for the enhanced operation responsiveness of the VTC system in a low engine speed range. Thus, in the second speed range $Ne_{2-3}$, free rotation of vane member 300 relative to timing sprocket 100 (phase-converter housing 102) can be permitted, while maintaining the unlocked state of lock mechanism 500. In other words, even in a biasing state where cam ring 5 is forced counterclockwise by means of only one spring (first coil spring 8*a*), a hydraulic pressure, needed to operate the VTC device, can be always produced during operation of pump VP.

When the operating range of the engine exceeds the middle speed range (e.g., the second speed range $Ne_{2-3}$ shown in FIG. 13), and enters the third speed range $Ne_{3-4}$, discharge pressure Pd becomes greater than or equal to the pressure level P3. The output of the control command signal (exciting current) from controller CU to electromagnetic coil 482 of solenoid 480 is maintained, and thus high hydraulic pressure can be continuously supplied into each of phase-advance chambers 311-341. Hence, vane member 300 further rotates relative to timing sprocket 100 in the clockwise direction, and thus the angular phase of camshaft 200 relative to the crankshaft further varies to the phase-advance side. Finally, vane member 300 is held at the maximum phase-advance position at which the volumetric capacity of each of phase-advance chambers 311-341 becomes a maximum, and thus the valve overlapping period becomes a maximum.

In the third speed range $Ne_{3-4}$, discharge pressure Pd is greater than or equal to the pressure level P3 and less than the pressure level P4, cam ring 5 is kept at the holding position. Hence, pump VP has a moderate discharge pressure rise characteristic that discharge pressure Pd can be risen moderately in accordance with an engine speed rise (see a moderate discharge pressure rise in the third speed range $Ne_{3-4}$ in FIG. 13), in other words, a discharge pressure rise characteristic that discharge pressure Pd can be risen moderately at a slightly greater gradient of a discharge pressure rise with respect to an engine speed rise as compared to that of an engine-speed versus discharge pressure characteristic (see the characteristic curve, indicated by the broken line (c) in FIG. 13), required for lubrication of moving and/or sliding engine parts, such as engine crankshaft bearings.

When the engine operating range reaches a high speed range (e.g., the fourth speed range $Ne_{4-5}$ shown in FIG. 13), discharge pressure Pd becomes greater than the pressure level P4. In the high speed range, cam ring 5 can oscillate or rotate, while being forced counterclockwise by two springs, namely, the summed spring force of first and second coil springs 8*a*-8*b*. Hence, in a similar manner to the second speed range $Ne_{2-3}$ (the middle speed range), in the fourth speed range $Ne_{4-5}$ (in the high speed range), pump VP has a slow discharge pressure rise characteristic that discharge pressure Pd can be risen slowly in accordance with an engine speed rise (see a slow discharge pressure rise in the fourth speed range $Ne_{4-5}$ in FIG. 13). A pressure level P5 of discharge pressure Pd, produced when the engine speed becomes maximum, becomes slightly higher than a pressure level $P_2$*, indicated on the broken line (c) in FIG. 13 and required for lubrication of moving and/or sliding engine parts at the maximum engine speed.

Comparative Example

The operation and effects of the first embodiment are hereunder explained, while comparing with the comparative example. The comparative example has a variable displacement vane pump construction differing from pump VP of the first embodiment. For the same applicable condition, that is, on the assumption that the variable displacement vane pump of the comparative example is applied to the same VTC system to which pump VP of the first embodiment is applied, the engine-speed versus discharge pressure characteristic (see the characteristic curve (d) indicated by the solid line in FIG. 17), obtained by the comparative example, differs from the characteristic curve (see the characteristic curve (a) indicated by the solid line in FIG. 13), obtained by the first embodiment. In more detail, the vane pump of the comparative example differs from pump VP of the first embodiment, only in the following respects.

That is, the vane pump of the comparative example has a control oil chamber defined between the inner periphery of a vane-pump housing and the outer periphery of a cam ring and partitioned by means of a seal member. Concretely, the seal member is provided at the position substantially symmetrical to the fulcrum (a pivot pin) of oscillating motion of the cam ring with respect to the axis of a vane rotor. The internal space, which is defined between the cam-ring outer peripheral surface and the pump-housing inner peripheral surface, is partitioned into two spaces by means of both the seal member and the fulcrum (the pivot pin). These two spaces are partitioned from each other in a fluid-tight fashion.

One space of the two partitioned spaces serves as a control oil chamber. Also provided is a hydraulic pressure control mechanism (including working-fluid flow control valves and the like) formed integral with the pump housing as a pump unit or provided separately from the pump, for controlling the hydraulic pressure in the control oil chamber. The pump housing is formed with a plurality of hydraulic ports, connected to the hydraulic pressure control mechanism, so as to supply and exhaust working oil (hydraulic pressure) to and from the control oil chamber. By the pressure, resulting from the hydraulic pressure delivered into the control oil chamber, and acting on a specific area (one partitioned space) of the cam-ring outer peripheral surface, corresponding to the circumferentially extending control oil chamber, the cam ring can oscillate about its fulcrum, so as to vary the pump discharge capacity. A biasing member (such as a spring) is provided in the other partitioned space, for forcing the cam ring in one direction (toward a spring-loaded position) against the pressure, resulting from the hydraulic pressure delivered into the control oil chamber defined on the cam-ring outer periphery, and acting on the specific area (the one partitioned space). In the case of the vane pump of the comparative example, regarding the pressure-receiving area of the cam-ring inner peripheral surface on which discharge pressure from the discharge port acts and which is divided into two segmented pressure-receiving areas with respect to the fulcrum of oscillating motion of the cam ring, these two segmented areas accord with each other or do not accord with each other, depending on oscillating motion of the cam ring. This is because the comparative example is based on a prerequisite that oscillating motion of the cam ring can be controlled by a control hydraulic pressure acting on the cam-ring outer peripheral surface. Notice that the comparative example never takes into account a control of oscillating motion of the cam ring by the hydraulic pressure acting on the cam-ring inner peripheral surface.

First, the comparative example requires the control oil chamber defined on the cam-ring outer periphery, and thus the comparative example has the difficulty of reducing the number of component parts constructing the vane pump. Concretely the previously-discussed seal member must be installed to define the control oil chamber. Additionally, the machining accuracy of each of pump component parts, to which the seal member is fitted, must be enhanced. This leads to the problem of increased vane pump manufacturing costs. Furthermore, the comparative example requires the previously-discussed plural hydraulic ports and hydraulic pressure control mechanism, for controlling or adjusting the hydraulic pressure in the control oil chamber. The comparative example has the difficulty of compactly designing the vane pump. In addition to the above, the comparative example requires the precise setting (fine adjustment) of an interference fit between mating parts after assembling the pump unit. Such a seal member is very hard to install or assemble accurately. For the reasons discussed above, the comparative example has several drawbacks, that is, increased oil leakages and contamination due to increased fittings, increased system installation time and costs, and increased service time.

As discussed above, in the case of the comparative example, hydraulic pressure in the control oil chamber acts between the cam-ring outer peripheral surface and the pump-housing inner peripheral surface. Thus, it is necessary to prevent undesirable oil leakage from the interior space of the pump housing to the exterior space. From the viewpoint of reduced leakage, the thickness of the flanged portion of the pump housing has to be increased and a gasket has to be used to enhance a fluid-tight performance of the vane pump. It is difficult to compactly design the pump, and also it is difficult to reduce the pump system costs.

In contrast to the above, in the case of pump VP of the first embodiment, the moment of force about the fulcrum "Q" of oscillating motion of cam ring 5 results from the discharge pressure acting on cam-ring inner peripheral surface 50, so as to adjust or control the eccentricity |OP| of geometric center "P" of cam-ring inner peripheral surface 50 with respect to the axis "O" of drive shaft 3 (or vane rotor 4). Hence, this eliminates the need for the control oil chamber arranged on the cam-ring outer periphery. Therefore, it is possible to reduce the number of seal members, such as oil seals and gaskets, thus realizing reduced number of pump component parts. Additionally, it is possible to solve the problem of the higher machining accuracy of each of pump component parts, to which the seal member is fitted, thus further reducing pump manufacturing costs. Furthermore, it is possible to eliminate the necessity of the plural hydraulic ports and hydraulic pressure control mechanism, required for controlling the hydraulic pressure in the control oil chamber. This contributes to the compact vane pump system and smaller space requirements of overall pump system. Additionally, the installation process of the seal member, defining the control oil chamber between the cam-ring outer periphery and the pump-housing inner periphery, is unnecessary. This contributes to the lower system installation time and costs, and lower service time.

In addition to the above, in the first embodiment, any control hydraulic pressure cannot be supplied into clearance space CL, defined between an outer peripheral surface 50*a* of cam ring 5 and inner peripheral surface 13*a* of pump-housing peripheral wall 13, and hence the pressure in clearance space CL can be held at a low pressure level (approximately, an atmospheric pressure level). Thus, it is unnecessary to increase the thickness of flanged portion 14 of pump housing 1, and also it is possible to eliminate the necessity of a gasket used to enhance a fluid-tight performance of the vane pump. This contributes to the compactly-designed pump VP, smaller space requirements of overall pump system, and lower pump system costs.

Moreover, according to the vane pump system configuration of the first embodiment, cam ring 5 is pivoted by means of pivot pin 9 (serving as the fulcrum "Q" of oscillating motion of cam ring 5). Hence, biasing member 8 can be laid out or installed at an arbitrary circumferential position around the entire circumference of cam ring 5, at which cam ring 5 can be forced in the direction that the eccentricity |OP| of geometric center "P" of cam-ring inner peripheral surface 50 with respect to the axis "O" of drive shaft 3 (or vane rotor 4) increases. This contributes to the increased layout flexibility of biasing member 8. Therefore, it is possible to optimize the layout of biasing member 8 relative to inlet hole 16*a* and inlet port 16*b*, thus effectively enhancing the pump efficiency in particular on the inlet side (described later in reference to the second to fourth embodiments).

The force, which produces oscillating motion of cam ring 5, is determined depending on discharge pressure Pd acting on cam-ring inner peripheral surface 50 and the position of the fulcrum "Q" of oscillating motion of cam ring 5. Hence, as the position of the fulcrum "Q" of oscillating motion of cam ring 5 approaches closer to the middle position at which the clockwise moment Ta about the fulcrum "Q" and the counterclockwise moment Tb about the fulcrum "Q" are balanced to each other, the cam-ring oscillating force, resulting from discharge pressure Pd acting on cam-ring inner peripheral surface 50, can be set to a smaller value. As a result, it is possible to set the spring force, produced by biasing member 8 against the cam-ring oscillating force resulting from discharge pressure Pd, to a smaller value. This contributes to the downsized biasing member 8, smaller installation space requirement of biasing member 8 (downsized spring chamber 15), and increased layout flexibility of biasing member 8, thus realizing the compact vane pump system and smaller space requirements of overall pump system.

Secondly, the comparative example does not employ a biasing member of a nonlinear characteristic. Therefore, in the comparative example, it is difficult to reconcile the enhanced operation responsiveness of the VTC system and a reduction in engine power loss, which loss is caused by the vane pump employing a biasing member of a linear characteristic. Generally, the vane pump can output a predetermined pressure level of discharge pressure Pd from a low pump revolution speed range (a low engine speed range). As can be seen from the first transition of the engine-speed versus discharge pressure characteristic curve (d) indicated by the solid line in FIG. 17, in the comparative example, the eccentricity |OP| of the geometric center of the cam-ring inner peripheral surface with respect to the axis of the vane rotor is set, so that the gradient of a discharge pressure rise with respect to an engine speed rise becomes a predetermined gradient "α" at the initial setting state, while utilizing the previously-discussed general discharge pressure characteristic. By virtue of such a steep gradient "α", the vane pump system of the comparative example ensures or achieves the pressure level $P_1$*, required for operating the VTC system from an engine low speed range.

Figure 17:
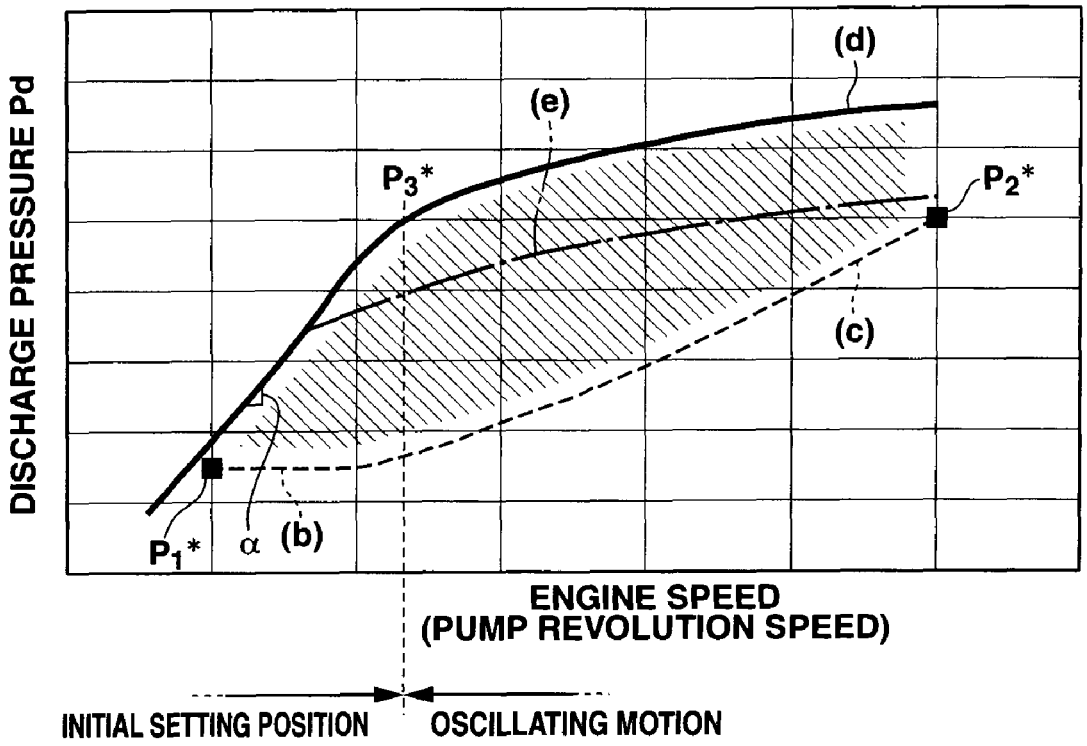
FIG. 17 is an engine-speed versus pump-discharge-pressure characteristic diagram in a variable displacement vane pump of a comparative example.

Assuming that the steep gradient "α" remains unchanged, the difference (the deviation) between the minimum required hydraulic pressure (see the characteristic curve, indicated by the broken lines (b)-(c) in FIG. 17) and discharge pressure Pd (see the characteristic curve (d) indicated by the solid line in FIG. 17) tends to increase, as the engine speed increases. To avoid this, when discharge pressure Pd rises up to a pressure level $P_3$*, indicated on the solid line (d) in FIG. 17 and identical to the maximum required pressure level $P_2$* indicated on the broken line (c) in FIG. 13 and required for lubrication of moving and/or sliding engine parts, oscillating motion of the cam ring is carried out, so as to reduce the pump discharge capacity. In this manner, the pump system of the comparative example can suppress discharge pressure Pd from unnecessarily rising, thereby suppressing an increase in engine power loss. However, in the case of the comparative example, the pump discharge pressure characteristic indicated by the solid line (d) in FIG. 17 remarkably deviates from the actually-required pump discharge pressure characteristic indicated by the broken lines (b)-(c) in FIG. 17. Hence, as can be seen from the left-hand diagonal shading area between the characteristic curve (d) and the characteristic curve (b)-(c) in FIG. 17, in the pump system of the comparative example, there is a great engine power loss (a great energy waste) corresponding to the shading area.

To reduce the power loss, suppose that the pump discharge pressure characteristic is changed from the characteristic indicated by the solid line (d) in FIG. 17 to a characteristic (e) indicated by the one-dotted line in FIG. 17. In such a case, oscillating motion of the cam ring is carried out at an earlier timing, as soon as discharge pressure Pd rises up to a lower pressure level (see the intersection point between the characteristic curve indicated by the solid line (d) and the characteristic curve (e) indicated by the one-dotted line in FIG. 17) as compared to the pressure level $P_3$* indicated on the solid line (d) in FIG. 17. This contributes to a reduction in power loss. However, there is a limit to the reduced power loss.

In contrast, pump VP of the first embodiment employs biasing member 8 of the nonlinear characteristic as previously described. The discharge pressure characteristic of pump VP (see the engine-speed versus discharge pressure characteristic curve indicated by the solid line (a) in FIG. 13) can be approximated to the minimum required hydraulic pressure characteristic curve indicated by the broken lines (b)-(c) in FIGS. 13 and 17, as much as possible. Hence, according to the vane pump system of the first embodiment, it is possible to effectively reduce the power loss (the energy waste), caused by an unnecessary discharge pressure rise, while ensuring the enhanced operation responsiveness of the VTC system.

On the one hand, the vane pump system having a discharge pressure characteristic of a higher gradient of a discharge pressure rise with respect to an engine speed rise in a low engine speed range, is superior in the enhanced operation responsiveness of the VTC system. This is because such a pump system can quickly supply working-oil pressure to the VTC system even during an engine startup period. On the other hand, the vane pump system having an excessively high gradient of a discharge pressure rise with respect to an engine speed rise in a low engine speed range, is inferior in reduced power loss (reduced energy waste), in particular in a high engine speed range.

As discussed previously, the vane pump system of the first embodiment employs biasing member 8 of the nonlinear characteristic, and therefore the discharge pressure characteristic of pump VP (see the characteristic curve (a) in FIG. 13) can be approximated to the minimum required hydraulic pressure characteristic curve (see the characteristic curve (b)-(c) in FIGS. 13 and 17), as much as possible. For the reasons discussed above, even when the gradient of a discharge pressure rise with respect to an engine speed rise is set to a great gradient "β" in a low engine speed range (in the first speed range $Ne_{1-2}$), there is a less risk increasing the power loss. Hence, in pump VP of the first embodiment, it is possible to more remarkably shorten the time interval from the engine starting point to the time when the supply of working-oil pressure to the VTC system begins to occur, by setting the gradient of a discharge pressure rise with respect to an engine speed rise to the gradient "β" greater than the gradient "α" of the discharge pressure characteristic (d) of the pump of the comparative example in the low speed range. As a matter of course, this contributes to the remarkably enhanced operation responsiveness of the VTC system. That is, by virtue of a better initial discharge pressure buildup in the first speed range $Ne_{1-2}$, just after starting the engine, lock mechanism 500 of the VTC device can be quickly shifted to its unlocked state, and additionally the angular phase of camshaft 200 relative to the crankshaft can be quickly varied to the phase-retard side.

As set forth above, the first embodiment enables a more compact and light-weight variable displacement vane pump construction, thereby allowing excellent mountability, and also ensuring a superior pump efficiency, while simplifying the overall pump system.

Effects of First Embodiment

Hereunder enumerated in detail are the effects of pump VP of the first embodiment.

(1) Variable displacement vane pump VP of the first embodiment includes rotor 4 driven by an internal combustion engine, cam ring 5 configured to accommodate therein rotor 4 and further configured to oscillate about a fulcrum "Q" of oscillating motion along two axially opposed sidewalls (i.e., bottom face 10*a* of basal portion 10 of pump housing 1 and bottom face 20*a* of main-body portion 20 of pump cover 2) facing both sides of cam ring 5 respectively, a plurality of vanes 6*a*-6*g*, each of which is fitted into rotor 4 to slide from rotor 4 toward inner peripheral surface 50 of cam ring 5 and set to be kept in abutted-engagement with cam-ring inner peripheral surface 50, the vanes being configured to define a plurality of working chambers (pump chambers r1-r7) in cooperation with outer peripheral surface 42*a* of rotor 4, inner peripheral surface 50 of cam ring 5, and the two axially opposed sidewalls, biasing member 8 configured to force cam ring 5 in a direction that the geometric center "P" of cam-ring inner peripheral surface 50 and the rotation center "O" of rotor 4 are spaced apart from each other, and an inlet portion (inlet port 16*b*, inlet hole 16*a*) and a discharge portion (discharge port 17*b*, discharge hole 17*a*) both formed in at least one of the two axially opposed sidewalls, the inlet portion being configured to open into a first group of working chambers (pump chambers r1, r2, r3, r4) of the plurality of working chambers so as to extend over the first group of working chambers (pump chambers r1, r2, r3, r4) within an area where volumes of the first group of working chambers increase (during rotary motion of rotor 4), and the discharge portion being configured to open into a second group of working chambers (pump chambers r4, r5, r6, r7) of the plurality of working chambers so as to extend over the second group of working chambers (pump chambers r4, r5, r6, r7) within an area where volumes of the second group of working chambers decrease (during rotary motion of rotor 4). A force, by which cam ring 5 can be oscillated against biasing member 8 in accordance with a buildup of a pressure in the discharge portion, acts on cam-ring inner peripheral surface 50.

Thus, it is unnecessary to provide a control oil chamber and a seal member on the side of the outer periphery of cam ring 5, thereby realizing reduced number of pump component parts.

(2) Concretely, the fulcrum "Q" of oscillating motion of cam ring 5 is laid out to be offset in a biasing direction of biasing member 8 within an opening range of the discharge portion (discharge port 17*b*).

Thus, during operation of pump VP, an area of cam-ring inner peripheral surface 50, on which the pressure in the discharge portion acts and which is segmented as a second pressure-receiving area S2 extending in the biasing direction of biasing member 8 with respect to the fulcrum "Q" (serving as a boundary) becomes permanently smaller than an area of cam-ring inner peripheral surface 50, on which the pressure in the discharge portion acts and which is segmented as a first pressure-receiving area S1 extending in a direction opposite to the biasing direction of biasing member 8 with respect to the fulcrum "Q". Hence, pump VP of the first embodiment permits the force, by which cam ring 5 can be oscillated against biasing member 8 in accordance with a buildup of the pressure in the discharge portion, to be applied to cam ring 5 from the side of cam-ring inner peripheral surface 50.

(3) More concretely, assuming that a point that a straight line segment PQ, which links the fulcrum "Q" and the geometric center "P" of cam-ring inner peripheral surface 50, intersects with cam-ring inner peripheral surface 50 within the opening range of the discharge portion (discharge port 17*b*), is defined as an intersection point "R", the intersection point "R" is laid out to be offset toward the circumferential end "C" of beginning-of-discharge-port with respect to a center position (a midpoint between two circumferential ends "C" and "D" of discharge-port circular-arc shaped groove 17*c*) of the opening range of the discharge portion (discharge port 17*b*). Biasing member 8 is provided to force cam ring 5 so as to rotate cam ring 5 about the fulcrum "Q" in a direction of the offset of intersection point "R", which is offset from the center position.

That is to say, irrespective of whether cam ring 5 is oscillating, there is a less change in the overlapping area that cam-ring inner peripheral surface 50 overlaps with the discharge portion (discharge port 17*b*), in other words, there is a less change in the pressure-receiving area of cam-ring inner peripheral surface 50 that receives discharge pressure Pd. Thus, the position of a midpoint "S" of the above-mentioned pressure-receiving area (circular-arc segment C'RD') can be approximated to the intermediate position between the circumferential end "C" of beginning-of-discharge-port and the circumferential end "D" of end-of-discharge-port (of discharge-port circular-arc shaped groove 17*c*). Therefore, when the intersection point "R" is laid out to be offset from the intermediate position, (i) a force Fb produced by discharge pressure Pd received by second pressure-receiving area S2 extending in the biasing direction of biasing member 8 with respect to the fulcrum "Q" and (ii) a force Fa produced by discharge pressure Pd received by first pressure-receiving area S1 extending in the direction opposite to the biasing direction with respect to the fulcrum "Q" are put out of balance. Due to the unbalanced forces Fa and Fb, a moment Ta−Tb of force about the fulcrum "Q" is produced. On the other hand, biasing member 8 is configured to produce a moment Ts about the fulcrum "Q" against the moment Ta−Tb, by forcing cam ring 5 in the direction of the offset of the intersection point "R".

In the first embodiment, the fulcrum "Q" is laid out on the side of the discharge portion (discharge port 17*b*). In lieu thereof, the fulcrum "Q" may be laid out on the side of the inlet portion (inlet port 16*b*). For instance, suppose that the locations of the discharge portion and the inlet portion are replaced with each other without changing the position of the fulcrum "Q" as shown in FIG. 5, and the pump is rotated in a reverse-rotational direction. If the position of the intersection point "R" is set as previously discussed even in such a layout of fulcrum "Q" on the inlet-port side, this pump system can provide the same operation and effects as the first embodiment. In a similar to the first embodiment, in the case of the layout of fulcrum "Q" on the inlet-port side, the fulcrum "Q" of oscillating motion of cam ring 5 is also laid out to be offset toward the circumferential end "C" of beginning-of-discharge-port with respect to the center position of the opening range of the discharge portion (discharge port 17*b*).

In the case of the layout of fulcrum "Q" on the inlet-port side as previously discussed, the distance between the discharge portion and fulcrum "Q" lengthens. For the same discharge pressure, this fulcrum layout has a merit that, as compared to the first embodiment, a greater moment Ta−Tb can be produced. In contrast, in the first embodiment, the fulcrum "Q" of oscillating motion of cam ring 5 is laid out on the discharge-port side, and thus the distance between the discharge portion and fulcrum "Q" shortens. Hence, the fulcrum layout of the first embodiment has a merit that a produced moment Ta−Tb can be finely adjusted, thus facilitating the suitable setting of the fulcrum "Q" of oscillating motion of cam ring 5 and biasing member 8, and ensuring stable oscillating action of cam ring 5.

(4) The fulcrum "Q" of oscillating motion of cam ring 5 is laid out such that the integral $\int S2dt$ of second segmented pressure-receiving area S2 of cam-ring inner peripheral surface 50, extending in the biasing direction of biasing member 8 with respect to the fulcrum "Q", for a given cycle T, is less than the integral $\int S1dt$ of first segmented pressure-receiving area S1 of cam-ring inner peripheral surface 50, extending in the direction opposite to the biasing direction of biasing member 8 with respect to the fulcrum "Q", for the given cycle T, that is, $\int S2dt<\int S1dt\}$.

That is to say, on the average, the relationship between the magnitudes of first and second segmented pressure-receiving areas S1 and S2 can be given by the inequality S1>S2 for the given period T. Hence, during operation of pump VP, on the average, the relationship between the magnitude of the force Fa resulting from the fluid pressure acting on first segmented pressure-receiving area S1 of cam-ring inner peripheral surface 50 and the magnitude of the force Fb resulting from the fluid pressure acting on second segmented pressure-receiving area S2 of cam-ring inner peripheral surface 50 can be given by the inequality defined by Fa>Fb during operation of pump VP. Therefore, it is possible to continuously produce a moment-of-force Ta−Tb (>0), which causes an oscillating or rotating motion of cam ring 5 in the direction that the eccentricity |OP| of geometric center "P" of cam-ring inner peripheral surface 50 with respect to the axis "O" of drive shaft 3 (or the rotation center of rotor 4) reduces, during operation of pump VP.

(5) Pump VP is configured such that a pressure, acting on outer peripheral surface 50*a* of cam ring 5, is lower than the pressure in the discharge portion. Hence, it is unnecessary to tightly seal the inside and outside of pump housing 1. This contributes to the compact vane pump system and lower pump system costs.

(6) Concretely, atmospheric pressure is applied on outer peripheral surface 50*a* of cam ring 5. Hence, the pressure difference between the inside pressure and the outside pressure of pump housing 1 can be set to approximately zero. Thus, it is possible to further enhance the effect of the above-mentioned item (5).

(7) An approximately uniform pressure is applied around an entire circumference of cam-ring outer peripheral surface 50*a*. Hence, pump VP of the first embodiment permits the force, by which cam ring 5 can be oscillated against biasing member 8, to be applied to cam ring 5 from only the side of cam-ring inner peripheral surface 50, thereby ensuring a stable operating characteristic of pump VP (a stable oscillating characteristic of cam ring 5).

(8) The discharge portion includes grooves (circular-arc shaped groove 17*c*, sector groove 17*d*, sector groove 23*d*) formed in the two axially opposed sidewalls (i.e., bottom face 10*a* of basal portion 10 of pump housing 1 and bottom face 20*a* of main-body portion 20 of pump cover 2). Cam ring 5 has communication hole 51, which is formed in the cam ring so as to axially penetrate cam ring 5 and through which the discharge portions (sector groove 17*d* of the pump-housing side discharge port 17*b*, and sector groove 23*d* of the pump-cover side discharge port 23) formed in the respective sidewalls are communicated with each other. Working fluid is discharged through a grooved portion (sector groove 17*d*) of at least one of the discharge portions, configured to be substantially conformable to a shape of communication hole 51 of cam ring 5, via discharge hole 17*a* to an exterior space.

Therefore, the number of oil passages delivering working fluid to discharge hole 17*a* can be increased, thus effectively increasing a discharge of pump VP, and enhancing a discharging ability of pump VP. Additionally, there is a less risk of contaminant and debris accumulated in pump VP. Fluid pressures applied on both sides of cam ring 5 from the discharge portions formed in the respective sidewalls are almost balanced to each other. Hence, a frictional force created between cam ring 5 and one (pump housing 1) of the sidewalls and a frictional force created between cam ring 5 and the other sidewall (pump cover 2) can be both reduced or minimized, thus effectively reducing a force required for oscillating motion of cam ring 5. Therefore, it is possible to remarkably stabilize the pump operating characteristic, while enhancing the durability of pump component parts.

(9) A fluid-flow passage cross-sectional area of communication hole 51 is dimensioned to be greater than or equal to that of discharge hole 17*a*. Hence, it is possible to reduce the flow resistance to working-oil flow, caused by communication hole 51. Thus, it is possible to further enhance the effects of the above-mentioned item (8).

(10) Communication hole 51 is formed into a circular-arc shape (or a sector form) whose center is the fulcrum "Q" of oscillating motion of cam ring 5. Thus, there is no risk that fluid communication between the discharge portions (sector groove 17*d* of discharge port 17*b* and sector groove 23*d* of discharge port 23) of the sidewalls via communication hole 51 is blocked, even in the presence of oscillating motion of cam ring 5. Additionally, even when cam ring 5 is oscillating, there is a less change in the overlapping area (the fluid-flow passage cross-sectional area) between communication hole 51 and each of the discharge ports (sector groove 17*d* of discharge port 17*b* and sector groove 23*d* of discharge port 23). Thus, it is possible to stably provide the operation and effects of the above-mentioned item (8).

(11) Communication hole 51 is configured to displace without any change in an opening area of communication hole 51 opening into discharge hole 17*a*, during oscillating motion of cam ring 5. That is, during oscillating motion of cam ring 5, there is no change in fluid-flow passage cross-sectional area of a working-fluid flow passage oriented from discharge port 23 (sector groove 23*d*) of pump cover 2 toward discharge hole 17*a* pump housing 1. Hence, there is a less change in the fluid pressure applied from the side of pump-cover discharge port 23 to cam ring 5. Thus, it is possible to stably provide the operation and effects of the above-mentioned item (8).

(12) A radial wall thickness L2 of a part of cam ring 5, overlapping with the inlet portion and the discharge portion, is dimensioned to be greater than a radial wall thickness L1 of the other part of cam ring 5. That is, during operation of pump VP, the fluid pressure in the inlet portion tends to become negative, and thus the fluid pressure in the inlet portion tends to become lower than the pressure acting on outer peripheral surface 50*a* of cam ring 5 (or the pressure in clearance space CL). On the other hand, the fluid pressure in the discharge portion tends to become higher than the pressure acting on outer peripheral surface 50*a* of cam ring 5 (or the pressure in clearance space CL). An internal space, defined between cam ring 5 and each of the sidewalls in the axial direction of pump VP, is a very small clearance space. Hence, this design that the part of cam ring 5, overlapping with the inlet portion and the discharge portion, is configured as a comparatively thick-walled part contains lapped metal-to-metal sealing surfaces, which form a virtually leak-proof seal. By the provision of the thick-walled part of cam ring 5, it is possible to prevent leakage of working fluid (working oil) from the discharge portion toward the outer periphery of cam ring 5, and leakage of working fluid from the outer periphery of cam ring 5 toward the inlet portion, thereby enhancing the sealing performance of both of the inlet portion and the discharge portion, and consequently enhancing the pump efficiency.

Concretely, a radial width (a radial wall thickness) L2 of cam-ring cylindrical portion 5*a*, overlapping with the beginning-of-drawing-in-action region (see a part of cam-ring cylindrical portion 5*a* near pump chambers r1, r2 in FIG. 5) of the inlet portion (inlet port 16*b*) and the end-of-discharging-action region (see a part of cam-ring cylindrical portion 5*a* near pump chambers r6, r7 in FIG. 5) of the discharge portion (discharge port 17*b*), is dimensioned to be longer than a radial width (a radial wall thickness) L1 of the other part of cam ring 5.

Therefore, even in the initial setting state where the eccentricity |OP| of geometric center "P" of cam-ring inner peripheral surface 50 with respect to the rotation center "O" of vane rotor 4 becomes maximum, the enhanced sealing performance of each of the inlet portion and the discharge portion can be ensured sufficiently. That is, when the fluid pressure (discharge pressure Pd) in the discharge portion is still insufficient at low engine speeds (at low revolution speeds of pump VP), cam ring 5 becomes kept in the initial setting position and thus the rate of change of the volume of each of pump chambers r1-r7 becomes highest. Hence, the fluid pressure in the beginning-of-drawing-in-action region of the inlet portion (inlet port 16*b*) becomes low, while the fluid pressure in the end-of-discharging-action region of the discharge portion (discharge port 17*b*) becomes high. For the reasons discussed above, it is necessary to enhance the sealing performance between the inner and outer peripheries of cam ring 5, in particular, at the beginning-of-drawing-in-action region of the inlet portion (inlet port 16*b*) and at the end-of-discharging-action region of the discharge portion (discharge port 17*b*). In the first embodiment, by the provision of the thick-walled part of cam ring 5, even in the initial setting state (in an engine low speed range), a proper radial distance L3 between cam-ring outer peripheral surface 50*a* and the circumferentially-extending outside edged portion of each of inlet port 16*b* and discharge port 17*b* can be ensured in such a manner as to be substantially equal to the radial distance L1. This contributes to the enhanced sealing performance.

In contrast, the radial width (the radial wall thickness) L1 of cam-ring cylindrical portion 5*a*, overlapping with the end-of-drawing-in-action region (see a part of cam-ring cylindrical portion 5*a* near pump chambers r3, r3 in FIG. 5) of the inlet portion (inlet port 16*b*) and the beginning-of-discharging-action region (see a part of cam-ring cylindrical portion 5*a* near pump chamber r4 in FIG. 5) of the discharge portion (discharge port 17*b*), is dimensioned to be shorter than the radial width (the radial wall thickness) L2.

The provision of the thin-walled part contributes to light-weight of cam-ring 5. That is, when the fluid pressure (discharge pressure Pd) in the discharge portion develops sufficiently at high engine speeds (at high revolution speeds of pump VP), cam ring 5 tends to oscillate or rotate in the direction that the eccentricity |OP| of cam ring 5 reduces. Hence, regarding the thin-walled part of cam ring 5, the radial distance between cam-ring outer peripheral surface 50*a* and the circumferentially-extending outside edged portion of each of inlet port 16*b* and discharge port 17*b* becomes smaller than the radial distance L1. On the other hand, the rate of change of the volume of each of pump chambers r1-r7, obtained in the high engine speed range, becomes low. Hence, the pressure difference between inlet pressure in inlet port 16*b* and discharge pressure Pd in discharge port 17*b* becomes less, and thus there is a less risk of working-fluid leakage. That is, it is unnecessary to enhance the sealing performance between the inner and outer peripheries of cam ring 5, in particular, at the end-of-drawing-in-action region of the inlet portion (inlet port 16*b*) and at the beginning-of-discharging-action region of the discharge portion (discharge port 17*b*). Accordingly, cam ring 5 can be formed or configured to have a comparatively thin-walled light-weight part at the end-of-drawing-in-action region of the inlet portion (inlet port 16*b*) and at the beginning-of-discharging-action region of the discharge portion (discharge port 17*b*).

(13) The sidewalls (pump housing 1 as well as pump cover 2) are made of an aluminum alloy material, whereas cam ring 5 is made of an iron-based material. Because of the sidewalls, between which cam ring 5 is installed and which are made of an aluminum alloy material, cam ring 5, having a required mechanical strength and a desired shape (a desired geometry) and dimensions, can be accurately machined. The sidewalls made of an aluminum alloy material also realize lightening of pump VP. For instance, when cam ring 5 is made of an iron-based sintered alloy material, cam ring 5, having a required mechanical strength and a desired shape (a desired geometry) and dimensions, can be accurately inexpensively machined.

(14) Cam ring 5 has a through hole (pivot bore 52) into which a pin (pivot pin 9), serving as the fulcrum "Q" of oscillating motion of cam ring 5, is inserted. For example, one way to provide the fulcrum "Q" of oscillating motion of cam ring 5 without forming the through hole (pivot bore 52) is to pivotably support a pivot pin 9 by a pair of pin-support grooves formed in both of the inner periphery of pump housing 1 and the outer periphery of cam ring 5, such that both axial ends of pivot pin 9 are received by the respective pin-support grooves. However, in the case of such a pivot-pin supporting structure, during oscillating motion of cam ring 5, there is a possibility that cam ring 5 falls out of pivot pin 9 or there is a possibility that pivot pin 9 falls out of the pin-support groove pair, by the force of impact. In contrast, in the first embodiment, pivot hole 52 is formed in cam ring 5 as a through hole, and pivot pin 9 is fitted into pivot hole 52. Hence, pivot pin 9 can be supported by pivot hole 52 around the entire circumference of pivot pin 9. Thus, cam ring 5 can be more certainly supported on the fulcrum "Q" of oscillating motion.

(15) Working fluid, which is discharged from the discharge portion, is lubricating oil, which lubricating oil is supplied to moving and/or sliding engine parts of the internal combustion engine, the working fluid is also used as a power source for a variable valve actuation system (a variable valve timing control (VTC) system configured to vary a valve characteristic of the internal combustion engine. That is, the engine employs the hydraulically-operated variable valve actuation system (the hydraulically-operated VTC system). Pump VP is configured to supply discharge pressure Pd to the VTC system as well as the moving and/or sliding engine parts. The vane type of pump VP can output a predetermined pressure level of discharge pressure Pd from a low pump revolution speed range (a low engine speed range). Hence, it is possible to enhance the operation responsiveness of the variable valve actuation system even in the low engine speed range. Furthermore, the pump discharge capacity of pump VP is variable. Thus, it is possible to reduce a power loss (an energy waste) by reducing the pump discharge capacity in the high engine speed range.

(16) Biasing member 8 is comprised of a first biasing member (first coil spring 8*a*) that permanently forces cam ring 5, and a second biasing member (second coil spring 8*b*) that exerts a biasing force on cam ring 5 only when cam ring 5 oscillates a predetermined distance, which is greater than or equal to a predetermined angular displacement. When cam ring 5, oscillating in the direction that the eccentricity |OP| reduces, reaches a specified oscillated position (the holding position) at which the biasing force, produced by the second biasing member (second coil spring 8*b*) is further added to a biasing force of the first biasing member (first coil spring 8*a*), a rapid rise in the biasing force of biasing member 8 occurs. In this specified oscillated position (the holding position), even in the presence of a rise in the oscillating force (moment Ta−Tb), resulting from discharge pressure Pd applied on cam-ring inner peripheral surface 50, the oscillating-force rise can be canceled by the biasing force of biasing member 8. In more detail, the clockwise moment Ta−Tb, resulting from discharge pressure Pd, is balanced to the counterclockwise moment Ts, resulting from the summed biasing force of the first and second biasing members. Hence, oscillating motion of cam ring 5 can be suppressed. That is, at the specified oscillated position (the holding position), even when a rise in discharge pressure Pd occurs due to a pump revolution speed rise, oscillating motion of cam ring 5 can be suppressed. Thus, cam ring 5 can be held at the specified oscillated position (the holding position), until the oscillating force, resulting from discharge pressure Pd, exceeds the summed biasing force of the first and second biasing members (first and second coil springs 8*a*-8*b*) due to a further rise in discharge pressure Pd. Therefore, in such an engine speed range $Ne_{3-4}$, a change (a decrease) in the pump discharge capacity can be suppressed. As discussed above, the development of oscillating motion of cam ring 5 and the suppression of oscillating motion of cam ring 5 can be finely precisely controlled depending on the pump revolution speed (discharge pressure Pd). Accordingly, it is possible to realize or achieve a plurality of different pump discharge capacities (a plurality of discharge pressure characteristics), suited to respective pump revolution speed ranges (respective engine speed ranges $Ne_{1-2}$, $Ne_{2-3}$, $Ne_{3-4}$, $Ne_{4-5}$).

(17) Concretely, biasing member 8 is constructed by a plurality of springs (first and second coil springs 8*a*-8*b*), and cam ring 5 is forced only by one of the plurality of springs when an oscillated amount of cam ring 5 is less than or equal to a predetermined threshold value, and cam ring 5 is forced by the plurality of springs (first and second coil springs 8*a*-8*b*) when the oscillated amount of cam ring 5 exceeds the predetermined threshold value. Thus, it is possible to certainly provide the operation and effects of the above-mentioned item (16).

Additionally, biasing member 8 is configured such that a biasing force (a spring constant) per unit oscillated amount increases, as an oscillated amount of cam ring 5 increases.

In the first embodiment, to provide a nonlinear characteristic of biasing member 8, two different resilient or elastic members (first and second coil springs 8*a*-8*b*) are used. Three or more resilient members (two or more elastic members) may be used. Furthermore, in the first embodiment, a coil spring is used as biasing member 8. Another type of spring, such as a torsion spring or a coned disc spring, may be used as biasing member 8. In the shown embodiment, the coiled compression spring made up of an elastic metal, such as steel, wound into a coil, is used. Instead of using such a metal spring, a rubber spring may be used. Additionally, biasing member 8 is not limited to a compression spring. An extension spring may be used. Moreover, in the shown embodiment, to provide a nonlinear characteristic (a nonlinear spring rate), a plurality of coil springs (first and second coil springs 8*a*-8*b*) are combined. In lieu thereof, a single coiled spring having a variable pitch and wire diameter may be used. For example, a tapered outside diameter and pitch coil spring may be used. The tapered outside diameter and pitch coil spring will provide a more compact spring design. Alternatively, a variable pitch spring (such as a tapered pitch spring) may be used. The variable pitch spring is superior in reduced or suppressed costs, as compared to a double spring structure.

(18) Working fluid, which is discharged from the discharge portion, is supplied to a variable valve timing control (VTC) system of the internal combustion engine. The VTC system is configured to hold an engine valve timing at a locked state during a startup period of the engine, and further configured to release the locked state of the valve timing by a pressure of the working fluid discharged from the discharge portion after the engine has been started up, so as to permit the valve timing to be varied to a desired valve timing. A pressure level P1 of the working-fluid pressure, at which the locked state of the valve timing is released, is set to be lower than a pressure level P2 of the working-fluid pressure, at which cam ring 5 begins to operate against a biasing force of biasing member 8. That is, it is possible to effectively reduce a power loss (an energy waste) by bringing the pump discharge characteristic closer to the minimum required hydraulic characteristic curve, utilizing the nonlinear characteristic of biasing member 8. When releasing the locked state after the engine has been started up, it is possible to enable the locked state to be released under a preferable state where the pump discharge capacity becomes maximum immediately before cam ring 5 begins to operate (or oscillate) from its initial position. This contributes to the improved operation responsiveness of the VTC system.

(19) The VTC system is configured to operate by the pressure of the working fluid, discharged from the discharge portion, and further configured to be able to operate in a state where cam ring 5 is forced only by one (first coil spring 8*a*) of the plurality of springs. Thus, it is possible to effectively reduce a power loss (an energy waste) by bringing the pump discharge characteristic closer to the minimum required hydraulic characteristic curve, utilizing the nonlinear characteristic of biasing member 8. When operating the VTC system by discharge pressure Pd from the discharge portion, it is possible to always produce hydraulic pressure required to operate the VTC system, even in the specific state where only one spring (first coil spring 8*a*) forces cam ring 5. This contributes to the improved operation responsiveness of the VTC system.

Second Embodiment

Construction of Vane Pump of Second Embodiment

Referring now to FIGS. 18-23, there is shown the variable displacement vane pump VP of the second embodiment. The construction of pump VP of the second embodiment is similar to that of the first embodiment, except that the installation position of biasing member 8, used to force cam ring 5 toward its initial position, is changed to the third quadrant of the orthogonal coordinate system. That is, except for the installation position of biasing member 8, the vane-pump construction of the second embodiment shown in FIGS. 18-23, is similar to the vane-pump construction of the first embodiment shown in respective FIGS. 3-6 and 10-11. Thus, the same reference signs used to designate elements in pump VP of the first embodiment shown in FIGS. 3-6 and 10-11 will be applied to the corresponding elements used in the second embodiment shown in FIGS. 18-23, for the purpose of comparison of the first and second embodiments. The different layout of biasing member 8 will be hereinafter described in detail with reference to the accompanying drawings, while detailed description of the other pump construction will be omitted because the above description thereon seems to be self-explanatory.

Figure 18:
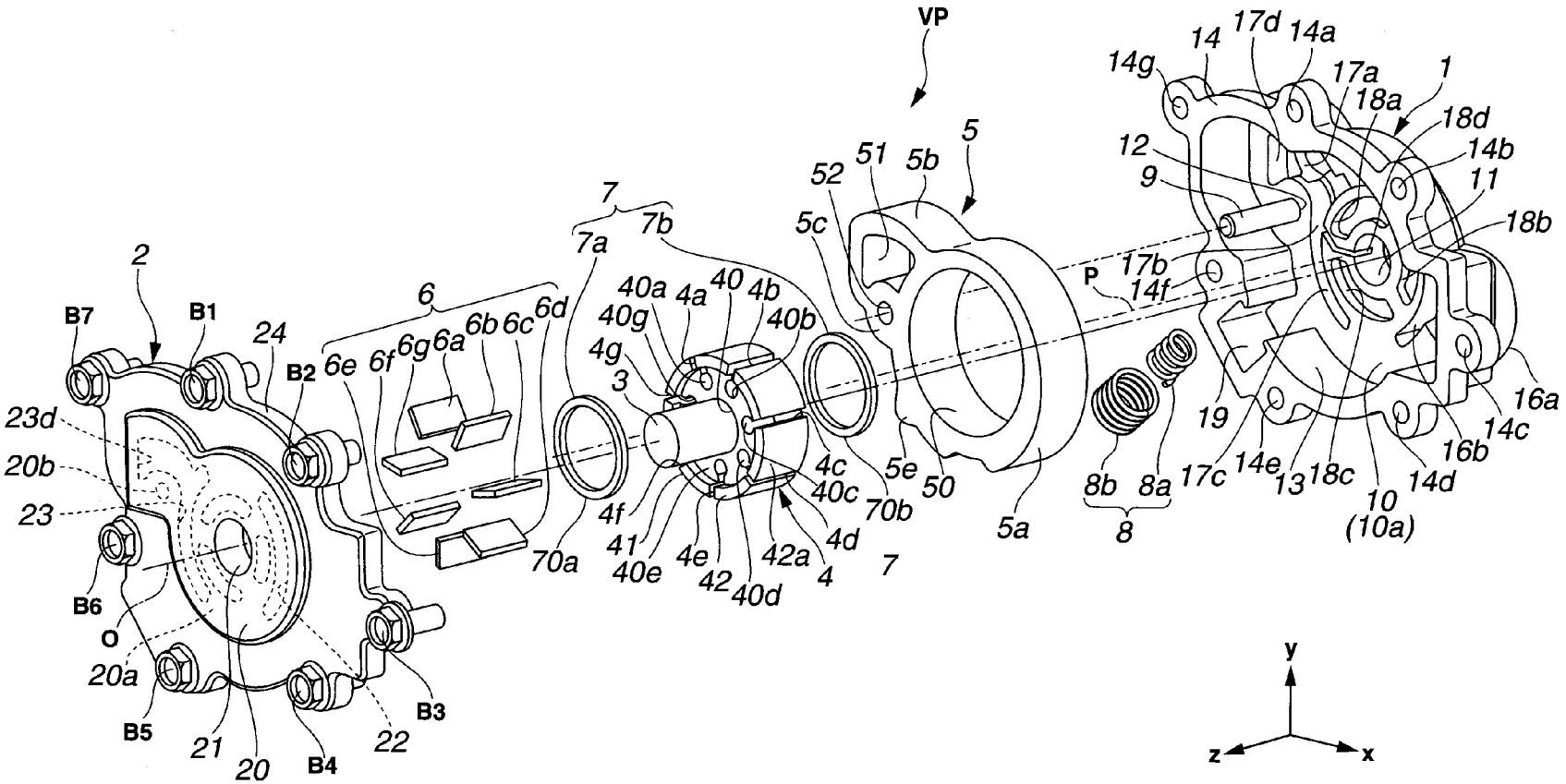
FIG. 18 is a disassembled view of a variable displacement vane pump of the second embodiment.

As seen in FIG. 18, in the vane pump system of the second embodiment, biasing member 8, having the same double spring structure (first and second coil springs 8*a*-8*b*) as the first embodiment, is installed coaxially in a spring chamber 19 formed in pump housing 1. Biasing member 8 forces cylindrical portion 5*a* of cam ring 5 in one direction by a biasing force, so as to produce a moment by which cam ring 5 can be rotated about pivot pin 9. Biasing member 8 permanently forces cam ring 5 in the maximum-eccentricity direction that the geometric center "P" of cam-ring inner peripheral surface 50 and the rotation center "O" of rotor 4 are spaced apart from each other.

Figure 19:
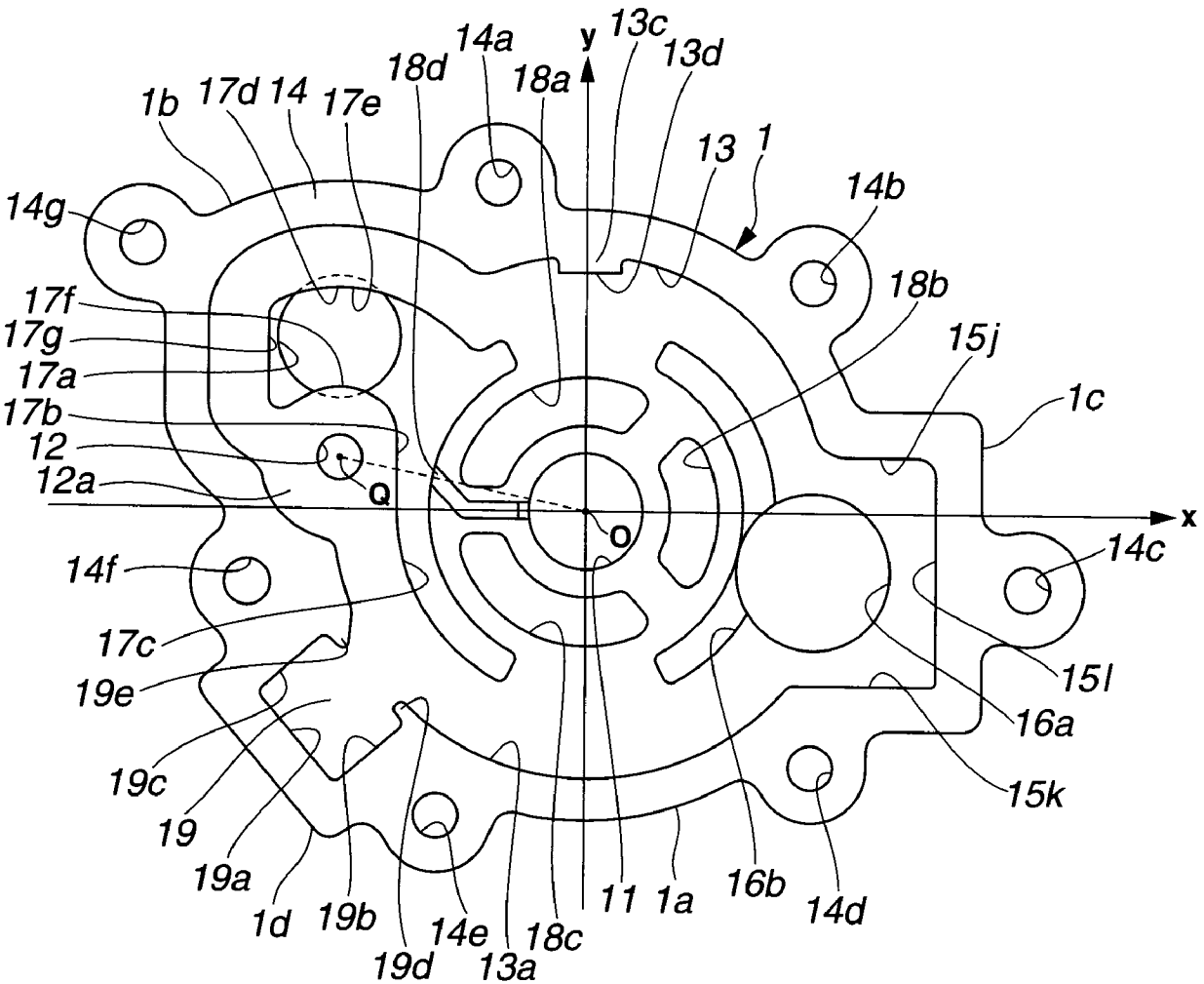
FIG. 19 is a front elevation view of a pump housing of the variable displacement vane pump of the second embodiment.

As seen in FIG. 19, a third swelling portion 1*d* is formed integral with peripheral wall 13 of pump housing 1 and located between female screw-threaded portions 14*e*-14*f* in such a manner as to swell radially outwards from pump-housing cylindrical portion 1*a* in a combined direction of the negative x-axis direction and the negative y-axis direction. That is, third swelling portion 1*d* is laid out within the third quadrant of the orthogonal coordinate system, which third quadrant is defined as $\{(x, y)|x<0, y<0\}$. Third swelling portion 1*d* is formed as a hollow rectangular parallelopiped. Third swelling portion 1*d* has spring chamber 19 formed therein.

As viewed from the z-axis direction, the inner peripheral surface of spring chamber 19 is formed into a substantially rectangular recessed shape. Spring chamber 19 is configured to be surrounded in three directions by two parallel wall surfaces 19*b*-19*c*, extending in the radial direction of cylindrical portion 1*a*, and a bottom face 19*a* formed to be substantially perpendicular to these surfaces 19*b*-19*c*. Spring chamber 19 is configured to open on inner peripheral surface 13*a* of peripheral wall 13 of cylindrical portion 1*a*. Two shoulder portions (engaging portions) 19*d*-19*e*, extending in the circumferential direction of cylindrical portion 1*a* and opposed to each other in the circumferential direction, are formed on peripheral wall 13 at the opening end of spring chamber 19.

As discussed above, in the second embodiment, third swelling portion 1*d* is formed with spring chamber 19, whereas second swelling portion 1*c* is not formed with any spring chamber. The dimension of the non-spring-chamber equipped second swelling portion 1*c* shown in FIG. 19, measured in the x-axis direction, is somewhat less than that of the spring-chamber equipped second swelling portion 1*c* shown in FIG. 4. As viewed from the z-axis direction in FIG. 19, the inner peripheral surface of second swelling portion 1*c* is formed into a substantially rectangular recessed shape. Second swelling portion 1*c* is configured to be surrounded in three directions by two parallel wall surfaces 15*j*-15*k*, extending from cylindrical portion 1*a* in the positive x-axis direction, and a wall surface 151 arranged parallel to the y-axis. Second swelling portion 1*c* is configured to open on the inner peripheral surface 13*a* of peripheral wall 13 of cylindrical portion 1*a*. Inlet hole 16*a* is arranged to bestride the boundary between the rightmost end of cylindrical portion 1*a* and the leftmost end of second swelling portion 1*c*.

The distance from wall surface 151, arranged on the side of second swelling portion 1*c* of the second embodiment (see FIG. 19) in the positive x-axis direction, to inlet hole 16*a* is dimensioned to be shorter than the distance from wall surface 15*c* (or wall surface 15*g*), arranged on the side of second swelling portion 1*c* of the first embodiment (see FIG. 4) in the positive x-axis direction, to inlet hole 16*a*. As viewed from the z-axis direction, in the first embodiment (see FIG. 4), the peripheral portion 13*b* and shoulder portion (engaging portion) 15*h* are configured to overlap with inlet hole 16*a*. In contrast, in the second embodiment (see FIG. 19), second swelling portion 1*c* is not formed with any spring chamber, and thus pump housing 1 does not have any obstruction that impedes the flow of working fluid from inlet hole 16*a* into pump housing 1.

As viewed in the direction of the axis "O", a cam-ring receiving portion 13*c* is formed on the inner peripheral surface 13*a* of cylindrical portion 1*a* and arranged on the side of cylindrical portion 1*a* in the positive y-axis, in such a manner as to slightly protrude radially inwards. A moderately curved concave stopper surface 13*d* is formed on cam-ring receiving portion 13*c*, while facing in the negative y-axis direction. As viewed from the z-axis direction, stopper surface 13*d* is formed into a circular-arc shape, which is substantially conformable to the shape (the curvature) of the outer peripheral surface of cam ring 5.

Figure 20:
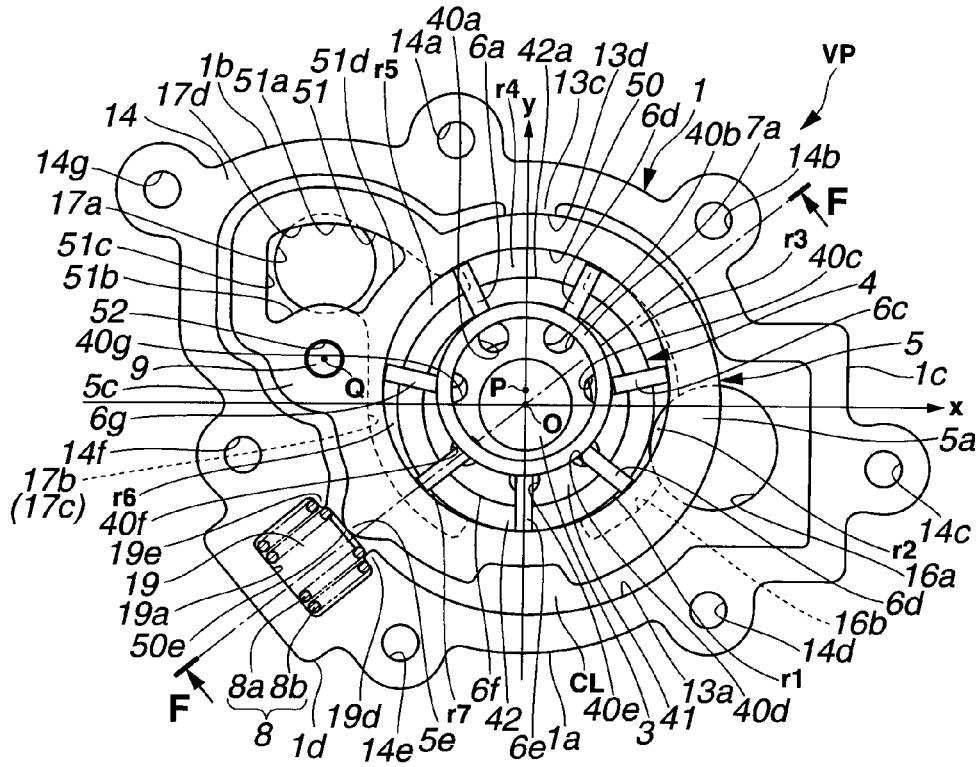
FIG. 20 is a front elevation view of the variable displacement vane pump of the second embodiment in the initial setting state.

FIG. 20 shows the initial setting state of cam ring 5. Cam-ring cylindrical portion 5*a* has a radially-protruding portion 5*e* formed integral with its outer periphery. The protruding portion 5*e* is formed to have the same length as cylindrical portion 5*a* in the z-axis direction. Protruding portion 5*e* is laid out on the side of the fulcrum "Q" of oscillating motion (pivot portion 5*c*) with respect to the geometric center "P" of cam-ring cylindrical portion 5*a*, and laid out on the side of the negative y-axis direction with respect to the fulcrum "Q" of oscillating motion. That is, protruding portion 5*e* is laid out within the third quadrant of the orthogonal coordinate system, which third quadrant is defined as $\{(x, y)|x<0, y<0\}$, in the same manner as third swelling portion 1*d* having spring chamber 19. The surface 50*e* of protruding portion 5*e* is formed as a curved surface. As viewed from the z-axis direction, protruding portion 5*e* is formed into a semicircle in cross section. The root (the basal end) of protruding portion 5*e* is contoured to be continuous with the outer peripheral surface of cylindrical portion 5*a*.

In the initial setting state of cam ring 5, as viewed in the radial direction of cylindrical portion 1*a*, the tip of protruding portion 5*e* is laid out substantially at the same position as the midpoint of two shoulder portions (engaging portions) 19*d*-19*e* of spring chamber 19 opposed to each other in the circumferential direction of cylindrical portion 1*a*. As viewed in the circumferential direction of cylindrical portion 1*a*, the centerline of protruding portion 5*e* is aligned with the centerline of spring chamber 19. The maximum width of protruding portion 5*e* is dimensioned to be less than the maximum width of the opening of spring chamber 19, in other words, the distance between the opposed shoulder portions 19*d*-19*e*. In the initial setting state of FIG. 20, the outer peripheral surface of the positive y-axis direction of cylindrical portion 5*a* (the uppermost end of cylindrical portion 5*a*, viewing FIG. 20)) is brought into wall-contact with stopper surface 13*d* of cam-ring receiving portion 13*c*. That is, in the initial setting state, cam-ring cylindrical portion 5*a* seats on stopper surface 13*d*.

Figure 21:
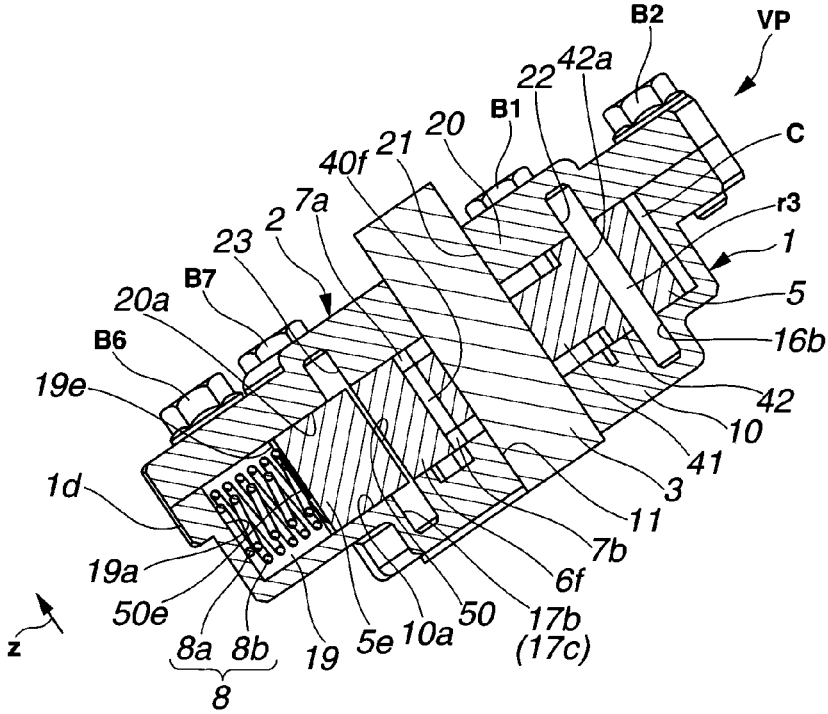
FIG. 21 is a cross section taken along the line F-F of FIG. 20.

FIG. 21 shows the cross section of pump VP whose pump cover is installed, taken along the line F-F of FIG. 20. The dimensional relationship between biasing member 8 and spring chamber 19 in the second embodiment is identical to that between biasing member 8 and spring chamber 15*d* in the first embodiment (see FIG. 6). In a similar manner to the first embodiment, first and second coil springs 8*a*-8*b*, constructing biasing member 8, are installed in spring chamber 19. First coil spring 8*a* is installed in spring chamber 19 and disposed between a spring-chamber bottom face 19*a* and cam-ring protruding portion 5*e* under a preloaded condition where first coil spring 8*a* is preloaded by an initial set load W1'. Second coil spring 8*b* is also installed in spring chamber 19 and disposed between spring-chamber bottom face 19*a* and the shoulder pair 19*d*-19*e* under a preloaded condition where second coil spring 8*b* is preloaded by an initial set load W3'.

Figure 22:
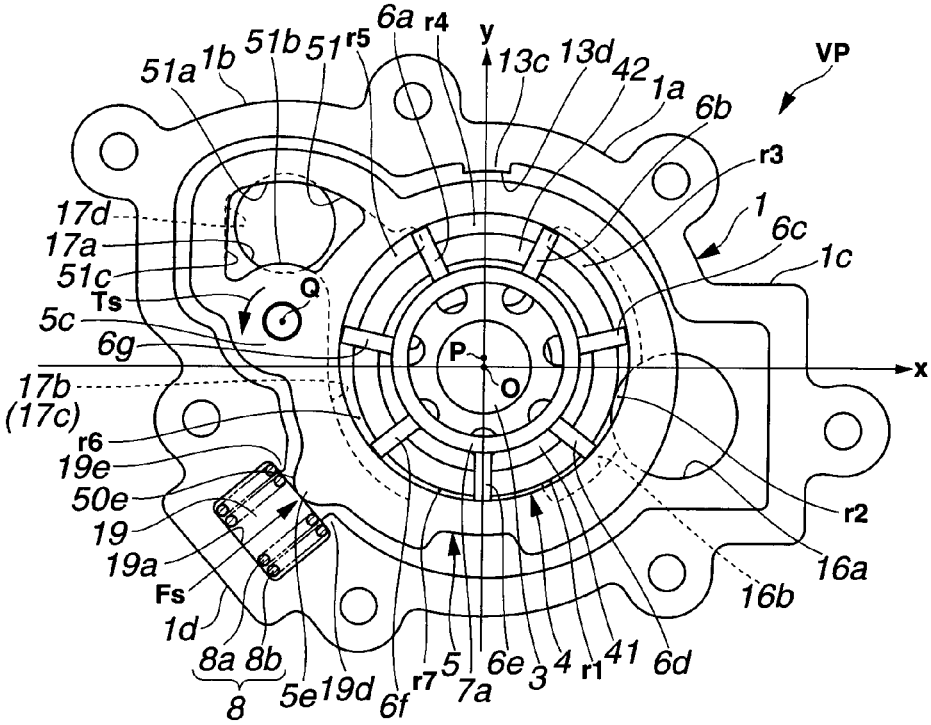
FIG. 22 is a front elevation view of the variable displacement vane pump of the second embodiment in a holding state where the cam-ring eccentricity is held at a substantially intermediate value between the maximum and minimum eccentricities.
Figure 23:
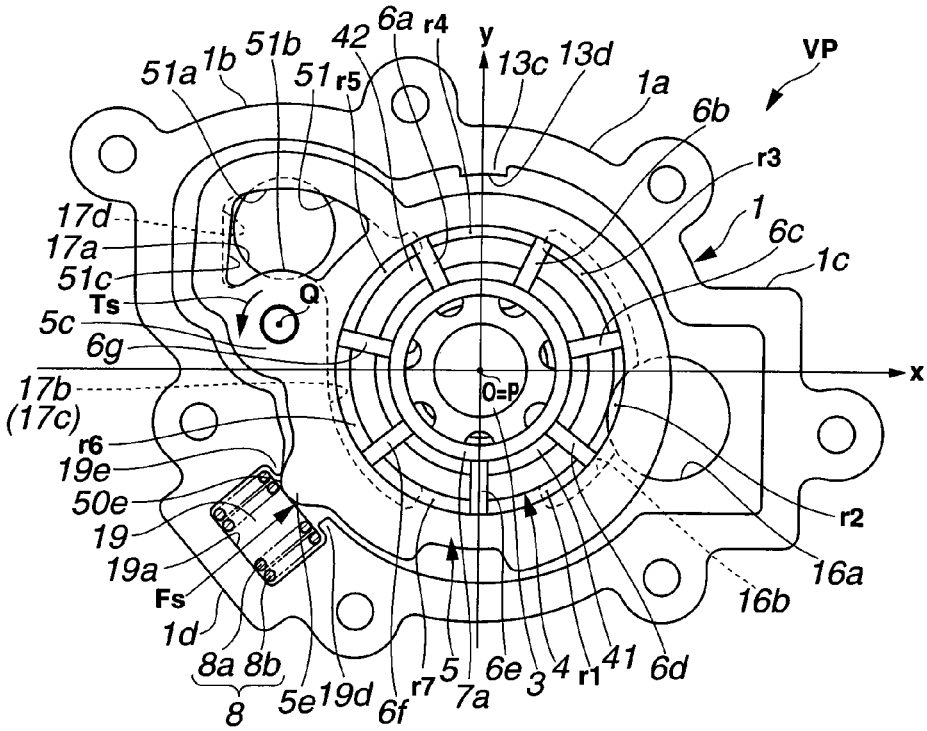
FIG. 23 is a front elevation view of the variable displacement vane pump of the second embodiment in the minimum-eccentricity state.

In a similar manner to FIG. 10 showing the holding state of cam ring 5 of pump VP of the first embodiment, FIG. 22 shows the cam-ring holding state of pump VP of the second embodiment, where the tip of protruding portion 5*e* is brought into abutted-engagement with the diametrically-opposing coil-end portions (opposed to each other in the z-axis direction) of the upper coil end of second coil spring 8*b*, facing radially inwards, and thus the eccentricity |OP| of geometric center "P" of cam-ring inner peripheral surface 50 with respect to the axis "O" of drive shaft 3 becomes a substantially intermediate value between the maximum and minimum eccentricities. In a similar manner to FIG. 11 showing the minimum-eccentricity state of cam ring 5 of pump VP of the first embodiment, FIG. 23 shows the cam-ring minimum-eccentricity state of pump VP of the second embodiment, where the eccentricity |OP| of geometric center "P" of cam-ring inner peripheral surface 50 with respect to the axis "O" of drive shaft 3 becomes minimum (zero), that is, the axis "O" and the geometric center "P" accord with each other. In the minimum-eccentricity state, the left-hand side surface (viewing FIG. 23) of protruding portion 5, facing pivot portion 5*c*, is brought into abutted-engagement with the left-hand side shoulder portion 19*e*. Under these conditions, the shoulder portion 19*e* serves as a stopper for restricting or preventing a further clockwise rotation of cam ring 5 about the fulcrum "Q".

Operation of Second Embodiment

Force Fs (a biasing force), produced by biasing member 8, acts on cam ring 5. In the second embodiment, force Fs corresponds to a force vector acting on protruding portion 5*e* of cam-ring cylindrical portion 5*a* in a combined direction of the positive x-axis direction and the positive y-axis direction. Force Fs produces a moment Ts by which cam ring 5 can be rotated about the fulcrum "Q" of oscillating motion in the counterclockwise direction that the eccentricity |OP| of geometric center "P" of cam-ring inner peripheral surface 50 with respect to the axis "O" of drive shaft 3 (or rotor 4) increases. The distance from the fulcrum "Q" to the point of application of force Fs (i.e., protruding portion 5*e*) in pump VP of the second embodiment is dimensioned to be shorter than the distance from the fulcrum "Q" to the point of application of force Fs (i.e., protruding portion 54 of cam-ring arm portion 5*d*) in pump VP of the first embodiment. Hence, to produce the same magnitude of moment Ts as the first embodiment, in the case of the second embodiment, the biasing force (the spring load) of biasing member 8 has to be set to a larger value. However, as described previously, by appropriately setting the position of the fulcrum "Q" of oscillating motion of cam ring 5, the cam-ring oscillating force, resulting from discharge pressure Pd, can be set to a smaller value. As a result, it is possible to set the spring force, produced by biasing member 8 against the cam-ring oscillating force resulting from discharge pressure Pd, to a smaller value. Accordingly, it is unnecessary to use a bigger biasing member 8 in the vane pump system of the second embodiment, as compared to the size of biasing member 8 used in pump VP of the first embodiment.

As previously discussed, in the second embodiment, the installation position of biasing member 8 and the location of spring chamber 19 are changed from second swelling portion 1*c* to third swelling portion 1*d*. Hence, the size of second swelling portion 1*c* can be suppressed or downsized to a minimum size that satisfies a space requirement for inlet hole 16*a*. Additionally, pump housing 1 does not have any obstruction that impedes the flow of working fluid from inlet hole 16*a* into pump housing 1. This enables a more smooth flow of working fluid from inlet hole 16*a* toward inlet port 16*b* or toward the pump chambers located on the pump inlet side, thus enhancing the pump suction efficiency. In the second embodiment, by optimizing the layout of biasing member 8

(or spring chamber 19) as set forth above, it is possible to reconcile or balance two contradictory requirements, that is, the compactly-designed vane pump VP and the enhanced pump efficiency, while providing the operation and effects as the first embodiment.

Effects of Second Embodiment

(20) Biasing member 8 is located outside of an outer periphery of cam ring 5 and laid out to be offset toward the fulcrum "Q" of oscillating motion with respect to the geometric center "P" of cam-ring inner peripheral surface 50. In this manner, by optimizing the layout of biasing member 8 (or spring chamber 19) with respect to the location of inlet hole 16*a* (or inlet port 16*b*), it is possible to enhance the pump suction efficiency, while realizing the compactly-designed vane pump VP.

Third Embodiment

Figure 24:
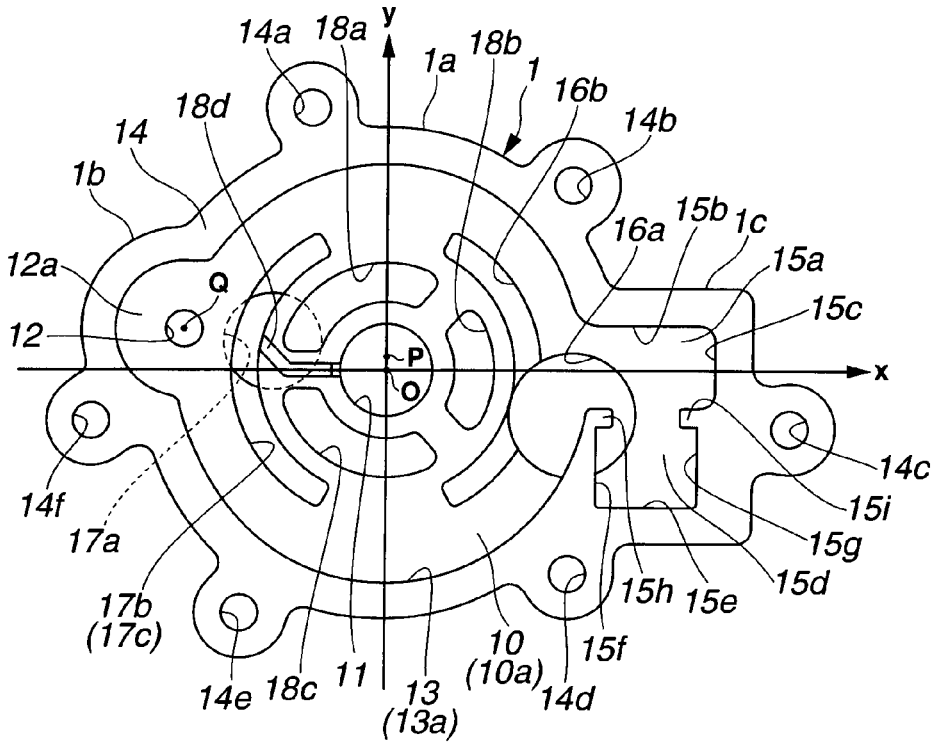
FIG. 24 is a front elevation view of a pump housing of a variable displacement vane pump of the third embodiment.
Figure 25:
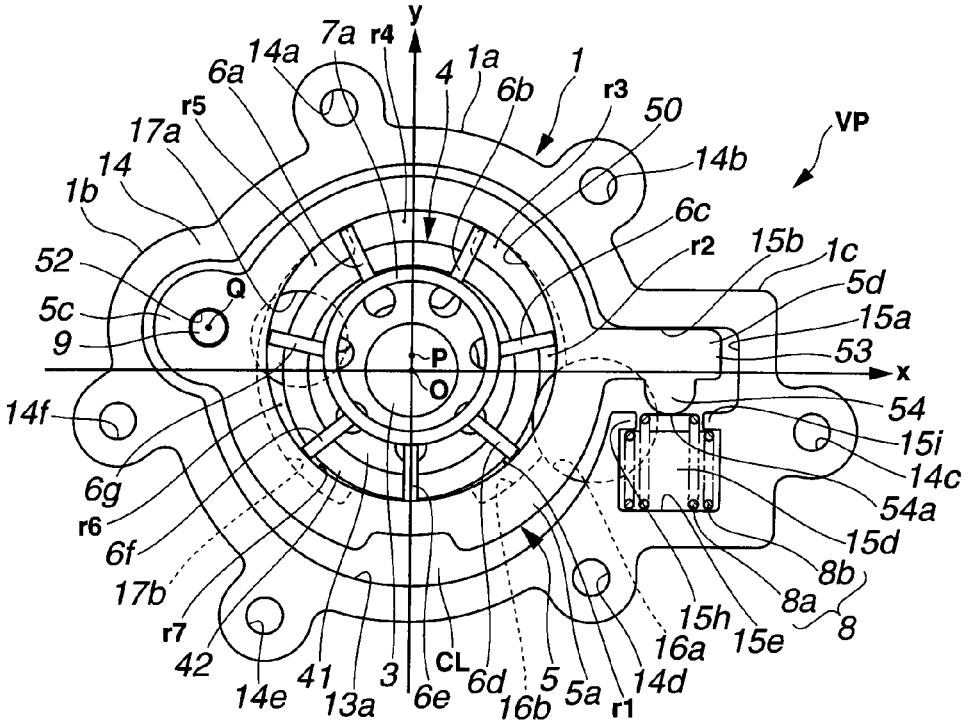
FIG. 25 is a front elevation view of the variable displacement vane pump of the third embodiment in the initial setting state.

Referring now to FIGS. 24-25, there is shown the variable displacement vane pump VP of the third embodiment. The construction of pump VP of the third embodiment is similar to that of the first embodiment, except that the shape of cam ring 5 and the location and shape of discharge port 17*b* of the third embodiment differ from those of the first embodiment. Concretely, in the first embodiment cam ring 5 is formed with communication hole 51, whereas in the third embodiment cam ring 5 is not formed with such a communication hole. The other pump construction of the third embodiment shown in FIGS. 24-25 is similar to the vane-pump construction of the first embodiment shown in respective FIGS. 4-5. Thus, the same reference signs used to designate elements in pump VP of the first embodiment shown in FIGS. 4-5 will be applied to the corresponding elements used in the third embodiment shown in FIGS. 24-25, for the purpose of comparison of the first and third embodiments. The different shape of cam ring 5 and the location and shape of discharge port 17*b* will be hereinafter described in detail with reference to the accompanying drawings, while detailed description of the other pump construction will be omitted because the above description thereon seems to be self-explanatory.

In a similar manner to FIG. 4 showing the front elevation view of pump VP of the first embodiment, FIG. 24 shows the structure of pump housing 1 of pump VP of the third embodiment. In the third embodiment, discharge port 17*b* has only the circular-arc shaped groove 17*c* arranged on bottom face 10*a* of cylindrical portion 1*a*, but not have sector groove 17*d*. First swelling portion 1*b* is formed to slightly swell radially outwards from pump-housing cylindrical portion 1*a* so as to be able to accommodate therein only the cam-ring pivot portion 5*c*. Pump cover 2 is configured to be substantially conformable to the shape of pump housing 1 having the slightly radially-outward extending first swelling portion 1*b*.

Discharge hole 17*a* is not located within first swelling portion 1*b*, but formed in bottom face 10*a* of pump-housing basal portion 10 in such a manner as to be laid out on the line segment linking the fulcrum "Q" of oscillating motion and the axis "O" of drive shaft 3 (or the rotation center of rotor 4). As viewed from the z-axis direction, discharge hole 17*a* is laid out on the side of the positive x-axis direction with respect to support portion 12*a*, in such a manner as to overlap with all of discharge port 17*b* (circular-arc shaped groove 17*c*), oil storage portion 18*a*, and bearing lubrication oil groove 18*d*. As viewed from the z-axis direction, discharge hole 17*a* is configured to open into only the discharge port 17*b* (circular-arc shaped groove 17*c*). Discharge hole 17*a* is communicated with the inside of pump housing 1 through discharge port 17*b* (circular-arc shaped groove 17*c*).

In a similar manner to FIG. 5 showing the initial setting state of cam ring 5 of pump VP of the first embodiment, FIG. 25 shows the cam-ring initial setting state of pump VP of the third embodiment. Cam ring 5 of pump VP of the third embodiment does not have sector portion 5*b* and communication hole 51. Cam ring 5 is configured to oscillate or rotate about pivot portion 5*c* (the fulcrum "Q" of oscillating motion) installed in first swelling portion 1*b*. By rotary motion of rotor 4, discharge pressure Pd is supplied from the pump chambers, defined on the side of the discharge portion, through discharge port 17*b* (circular-arc shaped groove 17*c*) into discharge hole 17*a*.

Effects of Third Embodiment

(21) As viewed from the z-axis direction, discharge hole 17*a* is laid out at a specified position where discharge hole 17*a* overlaps with discharge port 17*b* (circular-arc shaped groove 17*c*). In other words, as viewed from the z-axis direction, discharge hole 17*a* is laid out at a specified position where discharge hole 17*a* overlaps with the cam-ring inner peripheral surface 50 (the pump chambers), with which the tips of vanes 6*a*-6*g* are in sliding-contact.

That is to say, in the case of the vane pump construction of the first embodiment, in which discharge hole 17*a* is arranged radially outside of circular-arc shaped groove 17*c*, a working-fluid passage (i.e., sector groove 17*d*), intercommunicating circular-arc shaped groove 17*c* and discharge hole 17*a*, has to be formed in pump housing 1. For the purpose of increasing the number of fluid passages, required to communicate each of pump-housing side circular-arc shaped groove 17*c* and pump-cover side circular-arc shaped groove 23 with discharge hole 17*a*, in the first embodiment, cam ring 5 is formed with communication hole 51, and pump cover 2 is formed with sector groove 23*d*. In contrast, the layout of discharge hole 17*a* of pump VP of the third embodiment eliminates the necessity of communication hole 51 and pump-cover sector groove 23*d*. Additionally, cam ring 5 can be dimensioned or set to a minimum required size, thus realizing a compact vane pump design.

Fourth Embodiment

Figure 26:
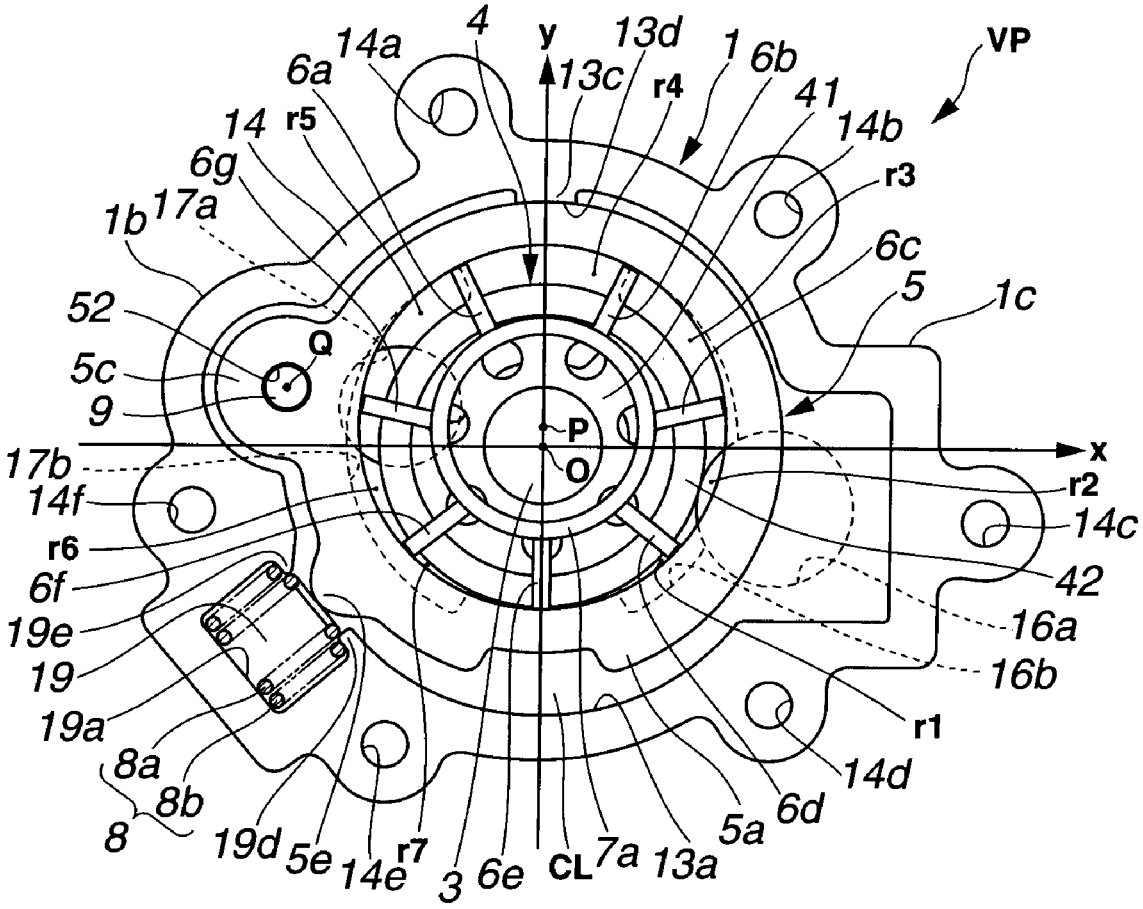
FIG. 26 is a front elevation view of a variable displacement vane pump of the fourth embodiment in the initial setting state.

Referring now to FIG. 26, there is shown the variable displacement vane pump VP of the fourth embodiment. Basically, the construction of pump VP of the fourth embodiment is similar to that of the first embodiment. However, the vane pump construction of the fourth embodiment somewhat differs from that of the first embodiment, in that the pump construction of the fourth embodiment is realized by combining the layout of biasing member 8 (and spring chamber 19) of the pump of the second embodiment (see FIGS. 18-23) with the layout of discharge hole 17*a* (the shape of and location of discharge port 17*b* and the shape of cam ring 5) of the pump of the third embodiment (see FIGS. 24-25). Hence, the fourth embodiment can provide the same effects as the above-mentioned items (20)-(21).

In the shown embodiments, variable displacement vane pump VP is applied to an internal combustion engine of an automotive vehicle. Variable displacement vane pump VP may be applied to another type of machineries, such as a hydraulically-operated crane.

In the shown embodiments, pump VP is used for supplying moving engine parts with lubricating oil and for delivering oil (serving as a working medium as well as a lubricating substance) to a variable valve actuation mechanism. Pump VP may be used as a drive source (a power steering pump) for a hydraulic power steering system.

In the shown embodiments, pump VP is driven by an internal combustion engine. Pump VP may be driven by another type of driving power source, such as an electric motor. Also, the vane rotor of pump VP is driven in synchronism with rotation of a crankshaft of an internal combustion engine. It is not necessary that rotation of the vane rotor should be synchronized with rotation of the crankshaft.

In the first embodiment, as a variable valve actuation system that utilizes discharge pressure Pd from pump VP, a variable valve timing control (VTC) system is used. Discharge pressure Pd from pump VP may be utilized for another type of variable valve actuation system, for example, a hydraulically-operated variable valve lift (VVL) system configured to variably control a valve lift and valve timing.

In the first embodiment, the VTC system is applied to only the intake-valve side of the engine. In lieu thereof, the VTC system may be applied to at least one of the intake-valve side and the exhaust-valve side of the engine.

In the first embodiment, a first group of grooves (inlet port 16*b* and discharge port 17*b*) are formed in pump housing 1, whereas a second group of grooves (inlet port 22 and discharge port 23) are formed in pump cover 2. For the purpose of more simplified pump construction, reduced machining time and costs, and lower pump system costs, grooves (a pump inlet port and a pump discharge port) may be formed only in either pump housing 1 or pump cover 2.

In the first embodiment, any seal member is not interleaved between pump-housing flanged portion 14 and pump-cover flanged portion 24. In order to certainly prevent oil leakage from the inside of pump VP and to enhance a fluid-tight performance of pump VP, a seal member may be interleaved between them.

In the first embodiment, vanes 6*a*-6*g*, each of which is fitted into rotor 4 to slide from rotor 4 toward inner peripheral surface 50 of cam ring 5 and set to be kept in abutted-engagement with cam-ring inner peripheral surface 50 by means of vane rings 7*a*-7*b*. It is not necessary that vanes 6*a*-6*g* should be kept in abutted-engagement with cam-ring inner peripheral surface 50. A slight clearance space defined between the tip of each of vanes 6*a*-6*g* and cam-ring inner peripheral surface 50 may be permitted to the extent that noise, caused by collision-contact between the tip of each of vanes 6*a*-6*g* with cam-ring inner peripheral surface 50 owing to radially-outward movements of vanes 6*a*-6*g* out of respective slits 4*a*-4*g*, is negligible at the beginning of rotation of pump VP.

In the first and third embodiments, biasing member 8 (or spring chamber 15*d*) is arranged outside of cam ring 5 and laid out at the position substantially symmetrical to the fulcrum "Q" of oscillating motion of cam ring 5 with respect to the rotation center "O" of vane rotor 4 (or with respect to the geometric center "P" of cam-ring inner peripheral surface 50). In contrast, in the second and fourth embodiments, biasing member 8 (or spring chamber 19) is arranged outside of cam ring 5 and laid out on the side of the fulcrum "Q" of oscillating motion of cam ring 5 with respect to the rotation center "O" of vane rotor 4 (or with respect to the geometric center "P" of cam-ring inner peripheral surface 50). That is, biasing member 8 may be laid out at an arbitrary circumferential position at which cam ring 5 can be forced in the direction that the volume difference between the volume of the largest pump chamber (pump chamber r4 in FIG. 5) of pump chambers r1-r7 and the volume of the smallest pump chamber (pump chambers r1, r7 in FIG. 5) increases.

In the shown embodiments, cam ring 5 is formed with an pin insertion hole (pivot bore 52) into which a pin (pivot pin 9), serving as a fulcrum of oscillating motion of cam ring 5, is fitted. In lieu thereof, pivot pin 9 may be pivotably supported by a pair of pin-support grooves formed in both of the inner periphery of pump housing 1 and the outer periphery of cam ring 5, such that both axial ends of pivot pin 9 are received by the respective pin-support grooves.

The entire contents of Japanese Patent Application No. 2008-133889 (filed May 22, 2008) are incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A variable displacement vane pump comprising:

a rotor driven by an internal combustion engine;

a cam ring configured to accommodate therein the rotor and further configured to oscillate about a fulcrum of oscillating motion along two axially opposed sidewalls facing both sides of the cam ring respectively;

a plurality of vanes, each of which is fitted into the rotor to slide from the rotor toward an inner peripheral surface of the cam ring and set to be kept in abutted-engagement with the inner peripheral surface of the cam ring, the vanes being configured to define a plurality of working chambers in cooperation with an outer peripheral surface of the rotor, the inner peripheral surface of the cam ring, and the two axially opposed sidewalls;

a biasing member configured to force the cam ring in a direction that a geometric center of the inner peripheral surface of the cam ring and a rotation center of the rotor are spaced apart from each other; and an inlet portion and a discharge portion both formed in at least one of the two axially opposed sidewalls, the inlet portion being configured to open into a first group of working chambers of the plurality of working chambers so as to extend over the first group of working chambers within an area where volumes of the first group of working chambers increase, and the discharge portion being configured to open into a second group of working chambers of the plurality of working chambers so as to extend over the second group of working chambers within an area where volumes of the second group of working chambers decrease, wherein an only force, acting on the inner peripheral surface of the cam ring to oscillate the cam ring against the biasing member, is a pressure in the discharge portion.

2. The variable displacement vane pump as claimed in claim 1, wherein:

a pressure, acting on an outer peripheral surface of the cam ring, is lower than the pressure in the discharge portion.

3. The variable displacement vane pump as claimed in claim 2, wherein:

atmospheric pressure is applied on the outer peripheral surface of the cam ring.

4. The variable displacement vane pump as claimed in claim 2, wherein:

the discharge portion comprises grooves formed in the two axially opposed sidewalls;

the cam ring has a communication hole, which is formed in the cam ring so as to axially penetrate the cam ring and through which the discharge portions formed in the respective sidewalls are communicated with each other; and working fluid is discharged through a grooved portion of at least one of the discharge portions, the grooved portion being configured to be substantially conformable to a shape of the communication hole of the cam ring, via a discharge hole to an exterior space.

5. The variable displacement vane pump as claimed in claim 4, wherein:

a fluid-flow passage cross-sectional area of the communication hole is dimensioned to be greater than or equal to a fluid-flow passage cross-sectional area of the discharge hole.

6. The variable displacement vane pump as claimed in claim 4, wherein:

the communication hole is formed into a circular-arc shape whose center is the fulcrum of oscillating motion of the cam ring.

7. The variable displacement vane pump as claimed in claim 4, wherein:

the communication hole is configured to displace without any change in an opening area of the communication hole opening into the discharge hole, during oscillating motion of cam ring 5.

8. The variable displacement vane pump as claimed in claim 1, wherein:

a radial wall thickness of a part of the cam ring, overlapping with the inlet portion and the discharge portion, is dimensioned to be greater than a radial wall thickness of the other part of the cam ring.

9. The variable displacement vane pump as claimed in claim 1, wherein:

the biasing member comprises a first biasing member that permanently forces the cam ring, and a second biasing member that exerts a biasing force on the cam ring only when the cam ring oscillates a predetermined distance, which distance is greater than or equal to a predetermined angular displacement.

10. The variable displacement vane pump as claimed in claim 1, wherein:

the cam ring has a through hole into which a pin, serving as the fulcrum of oscillating motion of the cam ring, is inserted.

11. The variable displacement vane pump as claimed in claim 1, wherein:

the sidewalls are made of an aluminum alloy material, whereas the cam ring is made of an iron-based material.

12. The variable displacement vane pump as claimed in claim 1, wherein:

working fluid, which is discharged from the discharge portion, is lubricating oil, which lubricating oil is supplied to moving engine parts of the internal combustion engine, the working fluid is also used as a power source for a variable valve actuation system configured to vary a valve characteristic of the internal combustion engine.

13. A variable displacement vane pump comprising:

a rotor driven in synchronism with rotation of an internal combustion engine;

a cam ring configured to accommodate the rotor in an inner peripheral surface of the cam ring and further configured to oscillate about a fulcrum of oscillating motion between two axially opposed sidewalls facing both sides of the cam ring respectively;

a plurality of vanes, each of which is fitted into the rotor to slide from an outer peripheral surface of the rotor toward the inner peripheral surface of the cam ring, the vanes being configured to define a plurality of working chambers in cooperation with the outer peripheral surface of the rotor, the inner peripheral surface of the cam ring, and the two axially opposed sidewalls;

a biasing member configured to force the cam ring in a direction that a volume difference between a volume of the largest working chamber of the plurality of working chambers and a volume of the smallest working chamber of the plurality of working chambers increases; and an inlet portion and a discharge portion both formed in at least one of the two axially opposed sidewalls, the inlet portion being configured to open into a first group of working chambers of the plurality of working chambers so as to extend over the first group of working chambers within an area where volumes of the first group of working chambers increase, and the discharge portion being configured to open into a second group of working chambers of the plurality of working chambers so as to extend over the second group of working chambers within an area where volumes of the second group of working chambers decrease, wherein the fulcrum of oscillating motion of the cam ring is laid out to be offset in a biasing direction of the biasing member within an opening range of the discharge portion wherein an only force, acting on the inner peripheral surface of the cam ring to oscillate the cam ring against the biasing member, is a pressure in the discharge portion.

14. The variable displacement vane pump as claimed in claim 13, wherein:

an approximately uniform pressure is applied around an entire circumference of an outer peripheral surface of the cam ring.

15. The variable displacement vane pump as claimed in claim 13, wherein:

the biasing member is located outside of an outer periphery of the cam ring and laid out to be offset toward the fulcrum of oscillating motion with respect to a geometric center of the inner peripheral surface of the cam ring.

16. The variable displacement vane pump as claimed in claim 13, wherein:

the biasing member comprises a plurality of springs;

the cam ring is forced only by one of the plurality of springs when an oscillated amount of the cam ring is less than or equal to a predetermined threshold value; and the cam ring is forced by the plurality of springs when the oscillated amount of the cam ring exceeds the predetermined threshold value.

17. The variable displacement vane pump as claimed in claim 16, wherein:

working fluid, which is discharged from the discharge portion, is supplied to a variable valve timing control system of the internal combustion engine;

the variable valve timing control system is configured to hold an engine valve timing at a locked state during a startup period of the engine, and further configured to release the locked state of the valve timing by a pressure of the working fluid discharged from the discharge portion after the engine has been started up, so as to permit the valve timing to be varied to a desired valve timing; and a pressure level of the working-fluid pressure, at which the locked state of the valve timing is released, is set to be lower than a pressure level of the working-fluid pressure, at which the cam ring begins to operate against a biasing force of the biasing member.

18. The variable displacement vane pump as claimed in claim 17, wherein:

the variable valve timing control system is configured to operate by the pressure of the working fluid, discharged from the discharge portion, and further configured to be able to operate in a state where the cam ring is forced only by one of the plurality of springs.

19. A variable displacement vane pump comprising:

a rotor rotated by a drive source;

a cam ring configured to accommodate therein the rotor and further configured to oscillate about a fulcrum of oscillating motion, while being kept in sliding-contact with two axially opposed sidewalls facing both sides of the cam ring respectively;

a plurality of vanes, each of which is fitted into the rotor to slide from the rotor toward an inner peripheral surface of the cam ring, the vanes being configured to define a plurality of working chambers in cooperation with an outer peripheral surface of the rotor, the inner peripheral surface of the cam ring, and the two axially opposed sidewalls;

a biasing member configured to force the cam ring in a biasing direction that a rate of change of a volume of each of the plurality of working chambers increases; and an inlet portion and a discharge portion both formed in at least one of the two axially opposed sidewalls, the inlet portion being configured to open into a first group of working chambers of the plurality of working chambers so as to extend over the first group of working chambers within an area where volumes of the first group of working chambers increase, and the discharge portion being configured to open into a second group of working chambers of the plurality of working chambers so as to extend over the second group of working chambers within an area where volumes of the second group of working chambers decrease, wherein an integral $\int S2dt$ of a second segmented pressure-receiving area of the inner peripheral surface of the cam ring, extending in the biasing direction of the biasing member with respect to the fulcrum of oscillating motion, for a given cycle, is less than an integral $\int S1dt$ of a first segmented pressure-receiving area of the inner peripheral surface of the cam ring, extending in the direction opposite to the biasing direction of the biasing member with respect to the fulcrum of oscillating motion, for the given cycle wherein an only force, acting on the inner peripheral surface of the cam ring to oscillate the cam ring against the biasing member, is a pressure in the discharge portion.

20. The variable displacement vane pump as claimed in claim 19, wherein:

the biasing member is configured such that a biasing force per unit oscillated amount increases, as an oscillated amount of the cam ring increases.

* * * * *